US012102205B2

(12) United States Patent
Tran et al.

(10) Patent No.: US 12,102,205 B2
(45) Date of Patent: Oct. 1, 2024

(54) HAIR CARE APPLIANCE WITH POWERED ATTACHMENT

(71) Applicant: SharkNinja Operating LLC, Needham, MA (US)

(72) Inventors: Carmen Tran, London (GB); Molly McGuinness, Brighton, MA (US); Michael Day, London (GB); Chris Hedges, Hampshire (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/416,526

(22) Filed: Jan. 18, 2024

(65) Prior Publication Data

US 2024/0245193 A1 Jul. 25, 2024

Related U.S. Application Data

(60) Provisional application No. 63/480,680, filed on Jan. 19, 2023.

(51) Int. Cl.
*A45D 20/50* (2006.01)
*A45D 1/28* (2006.01)
(Continued)

(52) U.S. Cl.
CPC ..... *A45D 20/12* (2013.01); *A45D 1/28* (2013.01); *A45D 2/367* (2013.01); *A45D 20/122* (2013.01);
(Continued)

(58) Field of Classification Search
CPC ..... A45D 20/50; A45D 20/48; A45D 20/52; A45D 20/525; A45D 20/122; A45D 2024/002
(Continued)

(56) References Cited

U.S. PATENT DOCUMENTS 2,685,292 A * 8/1954 Staiano ..... A45D 24/16 15/105
3,397,463 A 8/1968 Nikolaus
(Continued)

FOREIGN PATENT DOCUMENTS

CA 2863118 C 5/2020
CN 1257692 C 5/2006
(Continued)

OTHER PUBLICATIONS

U.S. Appl. No. 18/098,086 entitled "Hot Brush", filed on Jan. 17, 2023, 23 pages.
(Continued)

*Primary Examiner* — John P McCormack

(74) *Attorney, Agent, or Firm* — Mintz, Levin, Cohn, Ferris, Glovsky and Popeo, P.C.

(57) ABSTRACT

Various exemplary attachments for hair care appliances and methods of using attachments for hair care appliances are provided. In general, a hair care attachment in an exemplary embodiment is in the form of a brush accessory that has a hollow body having first and second region, an attachment collar at a first end of the hollow body and having an inlet for receiving airflow, a plurality of bristles positioned along the first region of the hollow body, a plurality of outlet openings positioned along the first region of the hollow body adjacent the plurality of bristles, and a heater assembly positioned along the second region of the hollow body.

18 Claims, 33 Drawing Sheets

(51) Int. Cl.

| | |
|---|---|
| ***A45D 2/36*** | (2006.01) |
| ***A45D 20/12*** | (2006.01) |
| ***A46B 5/00*** | (2006.01) |
| ***A46B 15/00*** | (2006.01) |
| *A46B 9/02* | (2006.01) |

(52) U.S. Cl.
CPC ..... *A45D 20/50* (2013.01); *A46B 5/0095* (2013.01); *A46B 15/0014* (2013.01); *A46B 15/003* (2013.01); *A46B 15/0051* (2013.01); *A46B 9/023* (2013.01); *A46B 9/025* (2013.01); *A46B 9/026* (2013.01); *A46B 2200/104* (2013.01)

(58) Field of Classification Search
USPC ..... 34/97, 96
See application file for complete search history.

(56) References Cited

U.S. PATENT DOCUMENTS 4,538,362 A * 9/1985 Andis ..... A45D 20/122 34/97
4,571,772 A 2/1986 Dyson
4,593,429 A 6/1986 Dyson
4,643,748 A 2/1987 Dyson
4,853,011 A 8/1989 Dyson
5,160,356 A 11/1992 Dyson
5,558,697 A 9/1996 Dyson et al.
5,568,691 A 10/1996 Rubin
5,628,123 A 5/1997 Chan
5,846,273 A 12/1998 Dyson
6,003,239 A 12/1999 Liebenthal et al.
6,222,988 B1 4/2001 Behrendt et al.
6,316,858 B1 11/2001 Phillips
6,408,481 B1 6/2002 Dyson
6,425,931 B1 7/2002 Croggon
6,478,291 B1 11/2002 Courtney
6,482,246 B1 11/2002 Dyson et al.
6,493,612 B1 12/2002 Bisset et al.
6,519,807 B1 2/2003 Thomson
6,526,623 B1 3/2003 Dyson
6,544,520 B1 4/2003 Murray et al.
6,572,078 B1 6/2003 Thomson et al.
6,601,265 B1 8/2003 Burlington
6,605,156 B1 8/2003 Clark et al.
6,691,849 B1 2/2004 Dyson et al.
6,774,596 B1 8/2004 Bisset
6,835,222 B2 12/2004 Gammack
6,974,488 B2 12/2005 Dyson
6,989,039 B2 1/2006 Vuijk
6,991,666 B2 1/2006 Organ
6,994,740 B2 2/2006 Gammack et al.
7,000,288 B2 2/2006 Nighy
7,018,439 B2 3/2006 Vuijk
7,085,624 B2 8/2006 Aldred et al.
7,165,341 B2 1/2007 Saida et al.
7,356,943 B2 4/2008 Behbehani
7,425,225 B2 9/2008 Genn et al.
7,437,799 B2 10/2008 Rocke
7,443,125 B2 10/2008 Clothier et al.
D598,532 S 8/2009 Dyson et al.
D602,143 S 10/2009 Gammack et al.
D602,144 S 10/2009 Dyson et al.
7,603,745 B2 10/2009 Frederickson
7,618,470 B2 11/2009 Eddington et al.
D605,748 S 12/2009 Gammack et al.
D614,280 S 4/2010 Dyson et al.
7,701,164 B2 4/2010 Clothier et al.
7,721,385 B2 5/2010 Genn et al.
7,731,770 B2 6/2010 Strutt et al.
7,750,594 B2 7/2010 Clothier et al.
7,757,343 B2 7/2010 Courtney
7,786,628 B2 8/2010 Childe et al.
7,823,251 B2 11/2010 Dyson et al.
7,828,866 B2 11/2010 Courtney et al.
7,979,959 B2 7/2011 Courtney
D643,098 S 8/2011 Wallace et al.
D645,615 S 9/2011 Eagle
8,042,224 B2 10/2011 White et al.
D648,893 S 11/2011 Kaizuka
D650,942 S 12/2011 Choi
8,100,999 B2 1/2012 Ashbee et al.
8,101,777 B2 1/2012 Dyson et al.
8,225,457 B2 7/2012 Sanderson et al.
8,240,317 B2 8/2012 Aguti et al.
D668,751 S 10/2012 Fitton et al.
D670,027 S 10/2012 Choi
D672,023 S 12/2012 Wallace et al.
D672,024 S 12/2012 Fitton et al.
D674,887 S 1/2013 Dyson
8,347,455 B2 1/2013 Dyson et al.
8,347,457 B2 1/2013 Dyson et al.
8,353,077 B2 1/2013 Dyson et al.
8,375,511 B2 2/2013 Dyson et al.
D679,055 S 3/2013 Dyson et al.
D682,472 S 5/2013 Dyson et al.
8,444,731 B2 5/2013 Gomiciaga-Pereda et al.
8,459,273 B2 6/2013 Silva
8,474,091 B2 7/2013 Dyson et al.
8,490,633 B1 7/2013 Kennedy et al.
8,529,226 B2 9/2013 Li
8,562,705 B2 10/2013 Courtney et al.
8,572,802 B2 11/2013 Dyson et al.
D694,952 S 12/2013 Choi
D698,994 S 2/2014 Xu
8,673,487 B2 3/2014 Churchill
8,707,508 B2 4/2014 Dyson et al.
D705,483 S 5/2014 Xu
8,720,002 B2 5/2014 Gammack et al.
8,734,121 B2 5/2014 Tsen
D706,983 S 6/2014 Courtney
D707,395 S 6/2014 Courtney
8,770,946 B2 7/2014 Fitton et al.
D711,042 S 8/2014 Kaizuka
8,826,492 B2 9/2014 Dyson et al.
D715,995 S 10/2014 Dyson et al.
D715,996 S 10/2014 Dyson et al.
D716,492 S 10/2014 Dyson et al.
8,882,451 B2 11/2014 Fitton et al.
D727,569 S 4/2015 Leonard
D728,092 S 4/2015 Poulton et al.
9,004,878 B2 4/2015 Gammack et al.
9,011,116 B2 4/2015 Li
D728,769 S 5/2015 Dyson et al.
D728,770 S 5/2015 Dyson et al.
D729,372 S 5/2015 McPherson et al.
D729,373 S 5/2015 Dos et al.
D729,374 S 5/2015 Dos et al.
D729,375 S 5/2015 Dos et al.
D729,376 S 5/2015 McPherson et al.
D729,447 S 5/2015 Gammack
D729,448 S 5/2015 Gammack
D729,925 S 5/2015 McPherson et al.
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,085,785 B2 7/2015 Reed et al.
9,095,246 B2 8/2015 Macnaughton
9,144,286 B2 9/2015 Courtney et al.
D741,544 S 10/2015 Gammack
9,173,468 B2 11/2015 Moloney et al.
9,185,957 B2 11/2015 Richmond et al.
9,186,027 B2 11/2015 Genn
D746,425 S 12/2015 Dyson et al.
9,217,445 B2 12/2015 Lo
D746,966 S 1/2016 Dyson et al.
D747,450 S 1/2016 Dyson et al.
D747,453 S 1/2016 Stewart et al.
9,226,560 B1 1/2016 Birk
9,237,789 B2 1/2016 Prehodka
D749,231 S 2/2016 Dyson et al.

(56) References Cited

U.S. PATENT DOCUMENTS

| | | | |
|---|---|---|---|
| 9,282,800 | B2 | 3/2016 | Courtney et al. |
| 9,282,859 | B2 | 3/2016 | Dyson et al. |
| 9,282,864 | B2 | 3/2016 | Guder et al. |
| D757,361 | S | 5/2016 | Gammack |
| D757,362 | S | 5/2016 | Dyson et al. |
| D758,010 | S | 5/2016 | Bates et al. |
| D758,011 | S | 5/2016 | Gammack |
| D758,012 | S | 5/2016 | Bates et al. |
| 9,366,449 | B2 | 6/2016 | Staniforth et al. |
| 9,370,286 | B2 | 6/2016 | Stephen et al. |
| 9,414,662 | B2 | 8/2016 | Moloney et al. |
| 9,420,864 | B2 | 8/2016 | Gammack et al. |
| 9,420,865 | B2 | 8/2016 | Gammack et al. |
| 9,420,927 | B2 | 8/2016 | Ventress et al. |
| D768,840 | S | 10/2016 | Steven et al. |
| 9,510,395 | B2 | 11/2016 | Coulton et al. |
| D775,418 | S | 12/2016 | Stephens et al. |
| D775,419 | S | 12/2016 | Stephens et al. |
| 9,512,959 | B2 | 12/2016 | Atkinson |
| 9,516,982 | B2 | 12/2016 | Stephen et al. |
| 9,521,937 | B2 | 12/2016 | Follows et al. |
| D776,345 | S | 1/2017 | Tang |
| D782,643 | S | 3/2017 | Poulton et al. |
| D782,731 | S | 3/2017 | Smith et al. |
| D782,732 | S | 3/2017 | Smith et al. |
| D782,733 | S | 3/2017 | Smith et al. |
| D782,734 | S | 3/2017 | Sutter et al. |
| D782,735 | S | 3/2017 | Stephens et al. |
| D782,736 | S | 3/2017 | Stephens et al. |
| 9,596,916 | B2 | 3/2017 | Moloney et al. |
| D783,140 | S | 4/2017 | Poulton et al. |
| D783,141 | S | 4/2017 | Poulton et al. |
| D783,142 | S | 4/2017 | Poulton et al. |
| D783,143 | S | 4/2017 | Poulton et al. |
| D784,614 | S | 4/2017 | Stephens et al. |
| D785,240 | S | 4/2017 | Smith et al. |
| D785,241 | S | 4/2017 | Stephens et al. |
| 9,609,986 | B2 | 4/2017 | Dimbylow et al. |
| 9,609,990 | B2 | 4/2017 | Stephen et al. |
| 9,627,717 | B1 | 4/2017 | Langlois et al. |
| D790,681 | S | 6/2017 | Poulton et al. |
| 9,681,726 | B2 | 6/2017 | Moloney et al. |
| 9,687,058 | B2 | 6/2017 | Francois |
| D791,407 | S | 7/2017 | Smith et al. |
| 9,788,697 | B2 | 10/2017 | Peace |
| 9,797,613 | B2 | 10/2017 | Staniforth et al. |
| 9,808,065 | B2 | 11/2017 | Moloney et al. |
| 9,808,066 | B2 | 11/2017 | Moloney et al. |
| 9,808,067 | B2 | 11/2017 | Sutter et al. |
| 9,848,745 | B2 | 12/2017 | Hill et al. |
| 9,879,290 | B2 | 1/2018 | Kurek et al. |
| D811,009 | S | 2/2018 | Smith et al. |
| 9,893,585 | B2 | 2/2018 | Cowdry |
| 9,927,136 | B2 | 3/2018 | Staniforth et al. |
| 9,929,440 | B2 | 3/2018 | Sastry et al. |
| 9,936,788 | B2 | 4/2018 | Stephens et al. |
| 9,936,789 | B2 | 4/2018 | Stephens et al. |
| 9,943,203 | B2 | 4/2018 | Samuels et al. |
| 9,949,605 | B2 | 4/2018 | Isley et al. |
| D817,007 | S | 5/2018 | Guy-Rabi et al. |
| 9,955,838 | B2 | 5/2018 | Millington et al. |
| 9,957,534 | B2 | 5/2018 | Kurek et al. |
| 9,986,810 | B2 | 6/2018 | Bobillier et al. |
| 10,004,313 | B2 | 6/2018 | Francois |
| 10,021,951 | B2 | 7/2018 | Bobillier et al. |
| 10,064,470 | B2 | 9/2018 | Warne |
| 10,076,172 | B2 | 9/2018 | Stephens et al. |
| 10,080,414 | B2 | 9/2018 | Douglas et al. |
| D830,630 | S | 10/2018 | Chia et al. |
| 10,085,537 | B2 * | 10/2018 | Maclaine ..... A45D 20/10 |
| 10,085,538 | B2 | 10/2018 | Saunders et al. |
| 10,094,581 | B2 | 10/2018 | Staniforth et al. |
| 10,117,491 | B2 | 11/2018 | Moloney et al. |
| 10,143,285 | B2 | 12/2018 | Stephens et al. |
| D838,907 | S | 1/2019 | Bates et al. |
| 10,165,843 | B2 | 1/2019 | Hedges |
| 10,165,844 | B2 | 1/2019 | Stephens et al. |
| 10,165,921 | B2 | 1/2019 | Millington et al. |
| 10,186,822 | B2 | 1/2019 | Hogan |
| 10,194,728 | B2 | 2/2019 | Stephens et al. |
| 10,213,001 | B2 | 2/2019 | Stephens et al. |
| D843,652 | S | 3/2019 | McLuckie et al. |
| D843,653 | S | 3/2019 | Teyu et al. |
| D843,654 | S | 3/2019 | Teyu et al. |
| 10,226,112 | B2 | 3/2019 | Kerr et al. |
| 10,238,199 | B2 | 3/2019 | Stephens et al. |
| D847,421 | S | 4/2019 | Tappenden et al. |
| D847,422 | S | 4/2019 | Tappenden et al. |
| D847,423 | S | 4/2019 | Tappenden et al. |
| D847,424 | S | 4/2019 | Tappenden et al. |
| D847,425 | S | 4/2019 | Tappenden et al. |
| D847,426 | S | 4/2019 | Tappenden et al. |
| 10,244,912 | B2 | 4/2019 | Box et al. |
| 10,258,211 | B2 | 4/2019 | McLeod |
| D848,063 | S | 5/2019 | Tappenden et al. |
| D848,064 | S | 5/2019 | Tappenden et al. |
| D848,065 | S | 5/2019 | Heffer et al. |
| D848,066 | S | 5/2019 | Coulton et al. |
| D848,067 | S | 5/2019 | Heffer et al. |
| D848,068 | S | 5/2019 | Heffer et al. |
| D848,675 | S | 5/2019 | Chia et al. |
| D850,001 | S | 5/2019 | Coulton et al. |
| D850,002 | S | 5/2019 | Bates et al. |
| 10,278,471 | B2 | 5/2019 | Shelton et al. |
| 10,299,648 | B2 | 5/2019 | Peters et al. |
| 10,304,324 | B2 | 5/2019 | Smith et al. |
| D852,415 | S | 6/2019 | Coulton et al. |
| D852,416 | S | 6/2019 | Coulton et al. |
| 10,306,965 | B2 | 6/2019 | Wilkinson et al. |
| 10,307,028 | B2 | 6/2019 | Gray |
| 10,307,029 | B2 | 6/2019 | Sharpley et al. |
| 10,327,528 | B2 | 6/2019 | Cowdry et al. |
| D853,637 | S | 7/2019 | Coulton et al. |
| D853,638 | S | 7/2019 | Tappenden et al. |
| D853,639 | S | 7/2019 | Tappenden et al. |
| D853,640 | S | 7/2019 | Tappenden et al. |
| D853,641 | S | 7/2019 | Tappenden et al. |
| D853,642 | S | 7/2019 | Coulton et al. |
| D854,316 | S | 7/2019 | Stockinger et al. |
| D854,745 | S | 7/2019 | Chia et al. |
| D855,252 | S | 7/2019 | Coulton et al. |
| 10,344,776 | B2 | 7/2019 | Lamb |
| D856,579 | S | 8/2019 | Chia et al. |
| D856,580 | S | 8/2019 | Chia et al. |
| 10,378,783 | B2 | 8/2019 | Tun |
| D860,528 | S | 9/2019 | Atkinson et al. |
| D860,529 | S | 9/2019 | Atkinson et al. |
| D860,530 | S | 9/2019 | Atkinson et al. |
| D860,531 | S | 9/2019 | Atkinson et al. |
| D860,532 | S | 9/2019 | Atkinson et al. |
| 10,403,937 | B2 | 9/2019 | Coowar et al. |
| D865,286 | S | 10/2019 | Atkinson et al. |
| 10,441,049 | B2 | 10/2019 | Douglas et al. |
| 10,441,050 | B2 | 10/2019 | Blanc et al. |
| 10,448,722 | B2 | 10/2019 | McLuckie |
| D866,067 | S | 11/2019 | Thompson et al. |
| 10,465,928 | B2 | 11/2019 | Staniforth et al. |
| 10,470,545 | B2 | 11/2019 | Thiebaut et al. |
| D869,763 | S | 12/2019 | Atkinson et al. |
| D869,764 | S | 12/2019 | Atkinson et al. |
| D875,310 | S | 2/2020 | Thompson et al. |
| 10,555,650 | B2 | 2/2020 | Genn et al. |
| 10,582,751 | B2 | 3/2020 | Courtney |
| 10,602,826 | B2 | 3/2020 | Wilkinson et al. |
| 10,610,000 | B2 | 4/2020 | Courtney et al. |
| 10,612,565 | B2 | 4/2020 | Staniforth et al. |
| D884,966 | S | 5/2020 | Flynn et al. |
| D885,663 | S | 5/2020 | Flynn et al. |
| D885,664 | S | 5/2020 | Dyson et al. |
| 10,648,486 | B2 | 5/2020 | Daly |
| 10,660,417 | B2 | 5/2020 | Bennett |
| 10,667,662 | B2 | 6/2020 | Carswell et al. |
| 10,687,595 | B2 | 6/2020 | Courtney et al. |
| D890,902 | S | 7/2020 | Carling et al. |

(56) References Cited

U.S. PATENT DOCUMENTS

D890,903 S 7/2020 Carling et al.
D891,597 S 7/2020 Carling et al.
10,702,037 B2 7/2020 Boateng et al.
10,722,017 B1 7/2020 Abehasera
D892,291 S 8/2020 Jennings et al.
10,729,218 B2 8/2020 Childe et al.
D895,781 S 9/2020 Peet et al.
D895,895 S 9/2020 Atkinson et al.
D896,440 S 9/2020 Lim et al.
10,765,191 B2 9/2020 Stephens et al.
10,786,061 B2 9/2020 Thiebaut et al.
D901,772 S 11/2020 Huang
D902,482 S 11/2020 Koenemann et al.
10,842,332 B2 11/2020 Nicolaou
D903,846 S 12/2020 Macqueen et al.
D903,941 S 12/2020 Koenemann et al.
10,869,529 B2 12/2020 Chia et al.
D908,956 S 1/2021 Kwok
10,893,785 B2 1/2021 Crouch et al.
10,918,184 B1 2/2021 Abehasera
10,939,747 B2 3/2021 Mikitovic et al.
10,953,359 B2 3/2021 Nicolaou et al.
10,973,298 B2 4/2021 Kennedy et al.
10,978,682 B2 4/2021 Chen et al.
D917,886 S 5/2021 Ma
D919,178 S 5/2021 Knox et al.
D919,179 S 5/2021 Knox et al.
D919,180 S 5/2021 Knox et al.
11,011,795 B2 5/2021 Kim et al.
D921,291 S 6/2021 Zhang
D923,874 S 6/2021 Kirkbride et al.
11,022,146 B2 6/2021 Mogridge et al.
11,033,088 B2 6/2021 Atkinson et al.
11,033,089 B2 6/2021 Goldman et al.
11,044,979 B2 6/2021 Maclaine
11,071,365 B2 7/2021 Maclaine et al.
11,110,380 B2 9/2021 Biltcliffe et al.
D935,692 S 11/2021 Courtney et al.
D936,367 S 11/2021 Goodsir et al.
11,168,924 B2 11/2021 Naicker et al.
11,172,745 B2 11/2021 Tam et al.
11,197,531 B2 12/2021 Hogan
11,253,040 B2 2/2022 Kim et al.
11,274,321 B2 3/2022 Reed et al.
11,330,884 B2 5/2022 Degrood et al.
11,344,834 B2 5/2022 Biltcliffe et al.
D955,636 S 6/2022 Zou
11,363,871 B2 6/2022 Bridgett
D957,054 S 7/2022 Yang
D957,612 S 7/2022 Francis et al.
11,375,792 B2 7/2022 Min et al.
D961,154 S 8/2022 Kirkbride et al.
D961,155 S 8/2022 Kirkbride et al.
11,425,979 B2 8/2022 Conrad
11,425,980 B2 8/2022 Conrad
11,454,247 B2 9/2022 Macqueen et al.
D967,520 S 10/2022 Smith et al.
11,457,713 B2 10/2022 Conrad
11,464,312 B2 10/2022 Pang et al.
11,510,472 B2 11/2022 Julemont
D973,273 S 12/2022 Kirkbride et al.
D973,274 S 12/2022 Kirkbride et al.
D973,275 S 12/2022 Flynn et al.
D973,370 S 12/2022 Guo
11,517,091 B2 12/2022 Conrad
11,517,166 B2 12/2022 Percy-Raine et al.
D975,918 S 1/2023 Yuan
D979,253 S 2/2023 Janowick et al.
11,571,056 B2 2/2023 Min et al.
11,576,474 B2 2/2023 Kim et al.
11,583,053 B2 2/2023 Kennedy et al.
11,583,153 B2 2/2023 Britain et al.
11,589,660 B2 2/2023 Thompson et al.
11,589,662 B2 2/2023 Kim et al.
11,602,208 B2 3/2023 Lo
11,633,028 B2 4/2023 Kim et al.
11,647,822 B2 5/2023 Kim et al.
11,680,581 B2 6/2023 Jukes et al.
11,682,988 B2 6/2023 Zheng et al.
11,712,098 B2 8/2023 Guerreiro et al.
11,744,689 B2 9/2023 Follows et al.
11,766,157 B2 9/2023 Percy-Raine et al.
11,767,853 B2 9/2023 Horton et al.
11,767,859 B2 9/2023 Peet et al.
11,802,571 B2 10/2023 Pouget et al.
11,815,099 B2 11/2023 Fanning et al.
11,857,052 B2 1/2024 Conrad
11,871,828 B2 1/2024 Nicolson et al.
2003/0170229 A1 9/2003 Friede et al.
2004/0096974 A1 5/2004 Herron et al.
2005/0152892 A1 7/2005 Friede et al.
2005/0214285 A1 9/2005 Dyson et al.
2009/0064529 A1* 3/2009 Kang ..... A45D 20/50
392/383
2009/0239761 A1 9/2009 Blackburn et al.
2010/0011532 A1 1/2010 Norton et al.
2011/0219636 A1 9/2011 Rowling
2011/0236219 A1 9/2011 Fitton et al.
2011/0236228 A1 9/2011 Fitton et al.
2012/0051884 A1 3/2012 Junkel et al.
2013/0045084 A1 2/2013 Tu et al.
2013/0111777 A1 5/2013 Jeong
2013/0142676 A1 6/2013 Zou
2013/0172408 A1 7/2013 Süss-Fink et al.
2013/0233336 A1 9/2013 Lazzaro et al.
2013/0234347 A1 9/2013 Staniforth et al.
2014/0115027 A1 4/2014 Akaiwa et al.
2015/0089828 A1 4/2015 Moloney et al.
2015/0157107 A1 6/2015 Gosnay et al.
2015/0265022 A1 9/2015 Maclaine
2015/0265024 A1 9/2015 Maclaine
2015/0320271 A1 11/2015 Dimbylow et al.
2016/0000201 A1 1/2016 Doran
2016/0206077 A1 7/2016 Stephens et al.
2016/0235178 A1 8/2016 Atkinson et al.
2016/0338466 A1 11/2016 Atkinson et al.
2017/0042303 A1* 2/2017 Kock ..... A46B 7/044
2017/0150796 A1 6/2017 Stephens et al.
2017/0150797 A1 6/2017 Imhasly et al.
2017/0150798 A1 6/2017 Bobillier et al.
2017/0164709 A1 6/2017 Laveni et al.
2017/0231358 A1 8/2017 Jeong
2017/0273421 A1 9/2017 Heffer et al.
2017/0273422 A1 9/2017 Heffer et al.
2017/0273423 A1 9/2017 Mason et al.
2017/0273425 A1 9/2017 Stephens et al.
2017/0273426 A1* 9/2017 Thompson ..... A45D 20/12
2017/0273430 A1 9/2017 Heffer et al.
2017/0273431 A1 9/2017 Courtney et al.
2017/0353095 A1 12/2017 Keil et al.
2018/0055177 A1 3/2018 Thompson et al.
2018/0055181 A1 3/2018 Spark et al.
2018/0055183 A1 3/2018 Carson et al.
2018/0055184 A1 3/2018 McVeigh et al.
2018/0055187 A1 3/2018 Galligan
2018/0106810 A1 4/2018 Tainsky et al.
2018/0172013 A1 6/2018 Dymond et al.
2018/0178154 A1 6/2018 David
2018/0185779 A1 7/2018 Nicolaou et al.
2018/0192841 A1 7/2018 Nicolaou et al.
2018/0193786 A1 7/2018 Imhasly
2018/0193788 A1 7/2018 Nicolaou et al.
2018/0271247 A1* 9/2018 Marston ..... A45D 1/16
2019/0098979 A1 4/2019 Atkinson et al.
2019/0098980 A1 4/2019 Atkinson et al.
2019/0170162 A1 6/2019 Jennings et al.
2019/0183224 A1 6/2019 Sunderland
2019/0242392 A1 8/2019 Whitmire
2019/0382808 A1 12/2019 Reed
2020/0085161 A1 3/2020 James et al.
2020/0093254 A1 3/2020 Charraud et al.
2020/0146413 A1 5/2020 Mathiaszyk et al.
2020/0163507 A1 5/2020 Percy-Raine et al.
2020/0172856 A1 6/2020 Reed et al.

(56) References Cited

U.S. PATENT DOCUMENTS

| | | | |
|---|---|---|---|
| 2020/0214516 | A1 | 7/2020 | Percy-Raine et al. |
| 2020/0260831 | A1 | 8/2020 | Buttery et al. |
| 2020/0280932 | A1 | 9/2020 | Down et al. |
| 2020/0315415 | A1 | 10/2020 | Carswell et al. |
| 2020/0400152 | A1 | 12/2020 | Shorter et al. |
| 2020/0400335 | A1 | 12/2020 | Shorter et al. |
| 2020/0412198 | A1 | 12/2020 | Dymond et al. |
| 2021/0007458 | A1 | 1/2021 | Nilsen |
| 2021/0095681 | A1 | 4/2021 | Adkin et al. |
| 2021/0219688 | A1 | 7/2021 | Courtney et al. |
| 2021/0251362 | A1 | 8/2021 | Loke et al. |
| 2021/0251364 | A1 | 8/2021 | Thompson et al. |
| 2021/0260414 | A1 | 8/2021 | Mundy et al. |
| 2021/0260415 | A1 | 8/2021 | Darling et al. |
| 2021/0270283 | A1 | 9/2021 | Macqueen et al. |
| 2021/0270292 | A1 | 9/2021 | Macqueen |
| 2021/0283544 | A1 | 9/2021 | Jennings et al. |
| 2021/0285328 | A1 | 9/2021 | Mahmoodilari et al. |
| 2021/0289909 | A1 | 9/2021 | Kirkbride et al. |
| 2021/0298445 | A1 | 9/2021 | Courtney |
| 2021/0315350 | A1 | 10/2021 | Kim et al. |
| 2021/0330052 | A1 | 10/2021 | Lelieveld |
| 2021/0353974 | A1 | 11/2021 | Courtney et al. |
| 2021/0393024 | A1 | 12/2021 | Forbes et al. |
| 2022/0047895 | A1 | 2/2022 | Moone |
| 2022/0074610 | A1 | 3/2022 | Morrison et al. |
| 2022/0087391 | A1 | 3/2022 | Nicolaou et al. |
| 2022/0148557 | A1 | 5/2022 | Reid et al. |
| 2022/0160092 | A1 | 5/2022 | Beaumont et al. |
| 2022/0169094 | A1 | 6/2022 | Harris et al. |
| 2022/0180850 | A1 | 6/2022 | Reid et al. |
| 2022/0180851 | A1 | 6/2022 | Reid et al. |
| 2022/0182749 | A1 | 6/2022 | Reid et al. |
| 2022/0183438 | A1 | 6/2022 | Beaumont et al. |
| 2022/0194166 | A1 | 6/2022 | Harris et al. |
| 2022/0296060 | A1 | 9/2022 | Cheung et al. |
| 2022/0325722 | A1 | 10/2022 | Barnes et al. |
| 2022/0330673 | A1 | 10/2022 | Shin et al. |
| 2022/0354231 | A1* | 11/2022 | Pulfrey ..... A46B 15/0051 |
| 2022/0357001 | A1 | 11/2022 | Dyson et al. |
| 2022/0361646 | A1 | 11/2022 | Valle |
| 2022/0400827 | A1 | 12/2022 | Yao et al. |
| 2022/0408895 | A1 | 12/2022 | Lelieveld |
| 2022/0408996 | A1 | 12/2022 | King et al. |
| 2023/0014059 | A1 | 1/2023 | Lee et al. |
| 2023/0087034 | A1 | 3/2023 | Williams et al. |
| 2023/0098664 | A1 | 3/2023 | Conrad |
| 2023/0166205 | A1 | 6/2023 | Sim et al. |
| 2023/0172348 | A1 | 6/2023 | Van Kempen et al. |
| 2023/0180920 | A1 | 6/2023 | Van Kempen |
| 2023/0181937 | A1 | 6/2023 | Darling et al. |
| 2023/0181938 | A1 | 6/2023 | Pattullo et al. |
| 2023/0181939 | A1 | 6/2023 | Leat et al. |
| 2023/0191168 | A1 | 6/2023 | Pattullo et al. |
| 2023/0209237 | A1 | 6/2023 | Darling et al. |
| 2023/0209243 | A1 | 6/2023 | Lowson et al. |
| 2023/0263347 | A1 | 8/2023 | Camplani et al. |
| 2023/0270221 | A1 | 8/2023 | Wei et al. |
| 2023/0270222 | A1 | 8/2023 | Hickey et al. |
| 2023/0292901 | A1 | 9/2023 | Hickey et al. |
| 2023/0292902 | A1 | 9/2023 | Hickey et al. |
| 2023/0292903 | A1 | 9/2023 | Hickey et al. |
| 2023/0309674 | A1 | 10/2023 | Hickey et al. |
| 2023/0321290 | A1 | 10/2023 | McLuckie et al. |
| 2023/0329413 | A1 | 10/2023 | Boon et al. |
| 2023/0329414 | A1 | 10/2023 | Tibbetts et al. |
| 2023/0337804 | A1 | 10/2023 | Hickey et al. |
| 2023/0346180 | A1 | 11/2023 | Teo et al. |
| 2023/0363509 | A1 | 11/2023 | Ford |
| 2023/0369999 | A1 | 11/2023 | Potgieter et al. |
| 2023/0375224 | A1 | 11/2023 | Ford |
| 2023/0380564 | A1 | 11/2023 | Huang et al. |
| 2023/0380567 | A1 | 11/2023 | Lim |
| 2023/0387838 | A1 | 11/2023 | Oakham et al. |
| 2023/0389671 | A1 | 12/2023 | Bracken-Lobb |
| 2023/0397705 | A1 | 12/2023 | Carlyle et al. |
| 2023/0404237 | A1 | 12/2023 | Beaumont et al. |
| 2023/0404238 | A1 | 12/2023 | Beaumont et al. |
| 2023/0413969 | A1 | 12/2023 | Beaumont et al. |
| 2024/0001172 | A1 | 1/2024 | Middleton et al. |
| 2024/0008616 | A1 | 1/2024 | Hickey et al. |
| 2024/0008618 | A1 | 1/2024 | Coulton et al. |
| 2024/0011494 | A1 | 1/2024 | Jukes |
| 2024/0015856 | A1 | 1/2024 | Ford |
| 2024/0016275 | A1 | 1/2024 | Conrad |
| 2024/0024817 | A1 | 1/2024 | Van Der Waals et al. |
| 2024/0081506 | A1 | 3/2024 | Purnell et al. |

FOREIGN PATENT DOCUMENTS

| | | | |
|---|---|---|---|
| CN | 201739198 | U | 2/2011 |
| CN | 201739199 | U | 2/2011 |
| CN | 201771875 | U | 3/2011 |
| CN | 201786778 | U | 4/2011 |
| CN | 101662969 | B | 8/2011 |
| CN | 103099418 | A | 5/2013 |
| CN | 102197913 | B | 3/2014 |
| CN | 203524053 | U | 4/2014 |
| CN | 203524054 | U | 4/2014 |
| CN | 102939706 | B | 6/2015 |
| CN | 102939713 | B | 6/2015 |
| CN | 102948068 | B | 6/2015 |
| CN | 103081341 | B | 8/2015 |
| CN | 102440717 | B | 9/2015 |
| CN | 102939710 | B | 12/2015 |
| CN | 103565076 | B | 12/2015 |
| CN | 102948067 | B | 1/2016 |
| CN | 103081342 | B | 3/2016 |
| CN | 103549750 | B | 3/2016 |
| CN | 103262406 | B | 4/2016 |
| CN | 103519541 | B | 8/2016 |
| CN | 102038459 | B | 9/2016 |
| CN | 102525080 | B | 12/2016 |
| CN | 103860103 | B | 4/2017 |
| CN | 103876440 | B | 8/2017 |
| CN | 108024674 | A | 5/2018 |
| CN | 108078142 | A | 5/2018 |
| CN | 108669760 | A | 10/2018 |
| CN | 108968289 | A | 12/2018 |
| CN | 109512119 | A | 3/2019 |
| CN | 105889034 | B | 4/2019 |
| CN | 109820321 | A | 5/2019 |
| CN | 208926670 | U | 6/2019 |
| CN | 110037425 | A | 7/2019 |
| CN | 110215039 | A | 9/2019 |
| CN | 110215040 | A | 9/2019 |
| CN | 110338542 | A | 10/2019 |
| CN | 110464101 | A | 11/2019 |
| CN | 110495694 | A | 11/2019 |
| CN | 110680070 | A | 1/2020 |
| CN | 110934408 | A | 3/2020 |
| CN | 106572731 | B | 5/2020 |
| CN | 108143072 | B | 5/2020 |
| CN | 111109814 | A | 5/2020 |
| CN | 111297027 | A | 6/2020 |
| CN | 111374420 | A | 7/2020 |
| CN | 111374421 | A | 7/2020 |
| CN | 111432684 | A | 7/2020 |
| CN | 111802776 | A | 10/2020 |
| CN | 111820569 | A | 10/2020 |
| CN | 111887565 | A | 11/2020 |
| CN | 106793856 | B | 1/2021 |
| CN | 112198831 | A | 1/2021 |
| CN | 112220184 | A | 1/2021 |
| CN | 112230588 | A | 1/2021 |
| CN | 112273830 | A | 1/2021 |
| CN | 212465222 | U | 2/2021 |
| CN | 212650551 | U | 3/2021 |
| CN | 111387670 | B | 4/2021 |
| CN | 212933307 | U | 4/2021 |
| CN | 106877556 | B | 5/2021 |
| CN | 107105858 | B | 6/2021 |
| CN | 112971308 | A | 6/2021 |
| CN | 113017227 | A | 6/2021 |

(56) References Cited

FOREIGN PATENT DOCUMENTS

| | | | |
|---|---|---|---|
| CN | 113040496 | A | 6/2021 |
| CN | 108433318 | B | 7/2021 |
| CN | 113080594 | A | 7/2021 |
| CN | 113080595 | A | 7/2021 |
| CN | 213639954 | U | 7/2021 |
| CN | 213639956 | U | 7/2021 |
| CN | 213639957 | U | 7/2021 |
| CN | 107224087 | B | 8/2021 |
| CN | 109998417 | B | 8/2021 |
| CN | 113243646 | A | 8/2021 |
| CN | 214047871 | U | 8/2021 |
| CN | 214072187 | U | 8/2021 |
| CN | 107259761 | B | 9/2021 |
| CN | 113545583 | A | 10/2021 |
| CN | 214340665 | U | 10/2021 |
| CN | 113576139 | A | 11/2021 |
| CN | 113576140 | A | 11/2021 |
| CN | 113576141 | A | 11/2021 |
| CN | 109645651 | B | 12/2021 |
| CN | 113762440 | A | 12/2021 |
| CN | 215603720 | * | 1/2022 |
| CN | 110150824 | B | 2/2022 |
| CN | 113219293 | B | 3/2022 |
| CN | 110051100 | B | 4/2022 |
| CN | 114599251 | A | 6/2022 |
| CN | 115023167 | A | 9/2022 |
| CN | 115098769 | A | 9/2022 |
| CN | 115227020 | A | 10/2022 |
| CN | 115245232 | A | 10/2022 |
| CN | 115245233 | A | 10/2022 |
| CN | 113163997 | B | 12/2022 |
| CN | 115517444 | A | 12/2022 |
| CN | 115474756 | B | 4/2023 |
| DE | 112014006549 | T5 | 12/2016 |
| DE | 202014011043 | U1 | 7/2017 |
| DE | 102012210275 | B4 | 8/2017 |
| DK | 1268076 | T3 | 2/2005 |
| EP | 1334670 | B1 | 12/2004 |
| EP | 1425986 | B1 | 11/2005 |
| EP | 1839520 | B1 | 11/2008 |
| EP | 2046476 | B1 | 6/2010 |
| EP | 2582280 | B8 | 10/2014 |
| EP | 2641500 | B1 | 5/2016 |
| EP | 2884866 | B1 | 11/2016 |
| EP | 2197312 | B1 | 5/2017 |
| EP | 3240455 | B1 | 11/2018 |
| EP | 3206524 | B1 | 12/2018 |
| EP | 3412172 | A1 | 12/2018 |
| EP | 3235397 | B1 | 2/2019 |
| EP | 2958479 | B1 | 5/2019 |
| EP | 3104761 | B1 | 5/2019 |
| EP | 3104760 | B1 | 7/2019 |
| EP | 3531862 | A1 | 9/2019 |
| EP | 2869726 | B1 | 4/2020 |
| EP | 3264935 | B1 | 6/2021 |
| EP | 3927209 | A1 | 12/2021 |
| EP | 3758547 | B1 | 9/2022 |
| ES | 2683018 | T3 | 9/2018 |
| GB | 179201 | A | 4/1922 |
| GB | 278037 | A | 9/1927 |
| GB | 314909 | A | 7/1929 |
| GB | 420822 | A | 12/1934 |
| GB | 517682 | A | 2/1940 |
| GB | 1565911 | A | 4/1980 |
| GB | 2372434 | A | 8/2002 |
| GB | 2372470 | A | 8/2002 |
| GB | 2413943 | B | 6/2007 |
| GB | 2416483 | B | 12/2007 |
| GB | 2469039 | B | 2/2013 |
| GB | 2469052 | B | 2/2013 |
| GB | 2501176 | A | 10/2013 |
| GB | 2475312 | B | 1/2014 |
| GB | 2475313 | B | 1/2014 |
| GB | 2505927 | B | 8/2014 |
| GB | 2484121 | B | 10/2014 |
| GB | 2507074 | B | 11/2014 |
| GB | 2508901 | B | 11/2014 |
| GB | 2510359 | B | 4/2015 |
| GB | 2500007 | B | 6/2015 |
| GB | 2500008 | B | 6/2015 |
| GB | 2515816 | B | 12/2015 |
| GB | 2515812 | B | 2/2016 |
| GB | 2510197 | B | 4/2016 |
| GB | 2521145 | B | 4/2016 |
| GB | 2521146 | B | 4/2016 |
| GB | 2518641 | B | 6/2016 |
| GB | 2510196 | B | 7/2016 |
| GB | 2515814 | B | 9/2016 |
| GB | 2518642 | B | 9/2016 |
| GB | 2524093 | B | 11/2016 |
| GB | 2524305 | B | 11/2016 |
| GB | 2521144 | B | 12/2016 |
| GB | 2503683 | B | 4/2017 |
| GB | 2524304 | B | 4/2017 |
| GB | 2503684 | B | 9/2017 |
| GB | 2548817 | A | 10/2017 |
| GB | 2503685 | B | 11/2017 |
| GB | 2539440 | B | 12/2017 |
| GB | 2503686 | B | 1/2018 |
| GB | 2539438 | B | 1/2018 |
| GB | 2542423 | B | 1/2018 |
| GB | 2543313 | B | 1/2018 |
| GB | 2552445 | A | 1/2018 |
| GB | 2539439 | B | 5/2018 |
| GB | 2544104 | B | 5/2018 |
| GB | 2539434 | B | 10/2018 |
| GB | 2563667 | A | 12/2018 |
| GB | 2555418 | B | 3/2019 |
| GB | 2561093 | B | 4/2019 |
| GB | 2567448 | A | 4/2019 |
| GB | 2567753 | A | 4/2019 |
| GB | 2548820 | B | 5/2019 |
| GB | 2561094 | B | 5/2019 |
| GB | 2548822 | B | 8/2019 |
| GB | 2548814 | B | 9/2019 |
| GB | 2574026 | A | 11/2019 |
| GB | 2574027 | A | 11/2019 |
| GB | 2565356 | B | 12/2019 |
| GB | 2574604 | A | 12/2019 |
| GB | 2574606 | A | 12/2019 |
| GB | 2565698 | B | 1/2020 |
| GB | 2548813 | B | 2/2020 |
| GB | 2565360 | B | 3/2020 |
| GB | 2563668 | B | 4/2020 |
| GB | 2565368 | B | 6/2020 |
| GB | 2567449 | B | 7/2020 |
| GB | 2567450 | B | 7/2020 |
| GB | 2576017 | B | 4/2021 |
| GB | 2585280 | B | 5/2021 |
| GB | 2580339 | B | 7/2021 |
| GB | 2580340 | B | 7/2021 |
| GB | 2590612 | A | 7/2021 |
| GB | 2581371 | B | 9/2021 |
| GB | 2580337 | B | 10/2021 |
| GB | 2580338 | B | 10/2021 |
| GB | 2581372 | B | 12/2021 |
| GB | 2588155 | B | 12/2021 |
| GB | 2591833 | B | 12/2021 |
| GB | 2596086 | A | 12/2021 |
| GB | 2597677 | A | 2/2022 |
| GB | 2590382 | B | 4/2022 |
| GB | 2590387 | B | 4/2022 |
| GB | 2599397 | A | 4/2022 |
| GB | 2575621 | B | 5/2022 |
| GB | 2603177 | A | 8/2022 |
| GB | 2580416 | B | 9/2022 |
| GB | 2597679 | B | 9/2022 |
| GB | 2597682 | B | 9/2022 |
| GB | 2577855 | B | 10/2022 |
| GB | 2597676 | B | 10/2022 |
| GB | 2597687 | B | 11/2022 |
| GB | 2606415 | A | 11/2022 |
| GB | 2600734 | B | 12/2022 |
| GB | 2600739 | B | 12/2022 |

(56) References Cited

FOREIGN PATENT DOCUMENTS

| | | | |
|---|---|---|---|
| GB | 2608119 | A | 12/2022 |
| GB | 2608120 | A | 12/2022 |
| GB | 2590396 | B | 2/2023 |
| GB | 2587506 | B | 3/2023 |
| GB | 2599385 | B | 3/2023 |
| GB | 2610691 | A | 3/2023 |
| GB | 2600730 | B | 4/2023 |
| GB | 2600733 | B | 4/2023 |
| GB | 2600736 | B | 4/2023 |
| GB | 2612567 | A | 5/2023 |
| GB | 2599384 | B | 7/2023 |
| GB | 2600735 | B | 7/2023 |
| GB | 2600737 | B | 7/2023 |
| GB | 2600738 | B | 7/2023 |
| GB | 2605750 | B | 7/2023 |
| GB | 2614601 | A | 7/2023 |
| GB | 2614604 | A | 7/2023 |
| GB | 2599399 | B | 8/2023 |
| GB | 2601788 | B | 8/2023 |
| GB | 2616031 | A | 8/2023 |
| GB | 2591811 | B | 9/2023 |
| GB | 2601995 | B | 9/2023 |
| GB | 2616902 | A | 9/2023 |
| GB | 2603101 | B | 10/2023 |
| GB | 2617152 | A | 10/2023 |
| GB | 2603174 | B | 11/2023 |
| GB | 2618449 | A | 11/2023 |
| GB | 2618927 | A | 11/2023 |
| GB | 2618948 | A | 11/2023 |
| GB | 2619446 | A | 12/2023 |
| IN | 237954 | B | 1/2010 |
| JP | 2006524062 | A | 10/2006 |
| JP | 2007525298 | A | 9/2007 |
| JP | 2007536049 | A | 12/2007 |
| JP | 2008018260 | A | 1/2008 |
| JP | 2008506488 | A | 3/2008 |
| JP | 2009061286 | A | 3/2009 |
| JP | 2009520542 | A | 5/2009 |
| JP | 2009523046 | A | 6/2009 |
| JP | 2009523224 | A | 6/2009 |
| JP | 2009528875 | A | 8/2009 |
| JP | 2009541020 | A | 11/2009 |
| JP | 4482034 | B2 | 3/2010 |
| JP | 4598060 | B2 | 10/2010 |
| JP | 2011125859 | A | 6/2011 |
| JP | 4944285 | B2 | 3/2012 |
| JP | 4961507 | B2 | 3/2012 |
| JP | 5068893 | B2 | 8/2012 |
| JP | 5087810 | B2 | 9/2012 |
| JP | 5137986 | B2 | 11/2012 |
| JP | 5227451 | B2 | 3/2013 |
| JP | 2013050113 | A | 3/2013 |
| JP | 5249981 | B2 | 4/2013 |
| JP | 2013075169 | A | 4/2013 |
| JP | 2013106958 | A | 6/2013 |
| JP | 2013141610 | A | 7/2013 |
| JP | 5346325 | N2 | 8/2013 |
| JP | 5368606 | B2 | 9/2013 |
| JP | 5456859 | B2 | 1/2014 |
| JP | 5466039 | B2 | 1/2014 |
| JP | 2014000405 | A | 1/2014 |
| JP | 5506855 | B2 | 3/2014 |
| JP | 2014040771 | A | 3/2014 |
| JP | 5511852 | B2 | 4/2014 |
| JP | 5519335 | B2 | 4/2014 |
| JP | 5546607 | B2 | 5/2014 |
| JP | 5562389 | B2 | 6/2014 |
| JP | 5589039 | B2 | 8/2014 |
| JP | 5635042 | B2 | 10/2014 |
| JP | 5635043 | B2 | 10/2014 |
| JP | 5635147 | B2 | 10/2014 |
| JP | 5680560 | B2 | 1/2015 |
| JP | 5686907 | B2 | 1/2015 |
| JP | 5721283 | B2 | 4/2015 |
| JP | 5771260 | B2 | 7/2015 |
| JP | 5773507 | B2 | 7/2015 |
| JP | 5786908 | B2 | 8/2015 |
| JP | 5849325 | B2 | 12/2015 |
| JP | 5853340 | B2 | 12/2015 |
| JP | 5916167 | B2 | 4/2016 |
| JP | 5923834 | B2 | 4/2016 |
| JP | 5923835 | B2 | 4/2016 |
| JP | 2016148338 | A | 8/2016 |
| JP | 6111777 | B2 | 3/2017 |
| JP | 6143031 | B2 | 5/2017 |
| JP | 2017127641 | A | 7/2017 |
| JP | 6253207 | B2 | 12/2017 |
| JP | 6336514 | B2 | 5/2018 |
| JP | 2018069065 | A | 5/2018 |
| JP | 6375320 | B2 | 7/2018 |
| JP | 2018110855 | A | 7/2018 |
| JP | 6469891 | B2 | 1/2019 |
| JP | 2019072485 | A | 5/2019 |
| JP | 2019072488 | A | 5/2019 |
| JP | 2019075982 | A | 5/2019 |
| JP | 6578045 | B2 | 8/2019 |
| JP | 6615245 | B2 | 11/2019 |
| JP | 6639569 | B2 | 1/2020 |
| JP | 6644112 | B2 | 1/2020 |
| JP | 6689318 | B2 | 4/2020 |
| JP | 2020530387 | A | 10/2020 |
| JP | 6802823 | B2 | 12/2020 |
| JP | 2021504052 | A | 2/2021 |
| JP | 6869036 | B2 | 4/2021 |
| JP | 2021514766 | A | 6/2021 |
| JP | 6945798 | B2 | 9/2021 |
| JP | 6999506 | B2 | 12/2021 |
| JP | 7077410 | B2 | 5/2022 |
| JP | 7113734 | B2 | 7/2022 |
| JP | 7125497 | B2 | 8/2022 |
| JP | 2023001837 | A | 1/2023 |
| KR | 20090034399 | A | 4/2009 |
| KR | 20110122699 | A | 11/2011 |
| KR | 20120027357 | A | 3/2012 |
| KR | 101501673 | B1 | 3/2015 |
| KR | 20150032595 | A | 3/2015 |
| KR | 20150036773 | A | 4/2015 |
| KR | 20150036774 | A | 4/2015 |
| KR | 101836299 | B1 | 3/2018 |
| KR | 102153115 | B1 | 9/2020 |
| PT | 2271842 | E | 7/2012 |
| RU | 2578998 | C2 | 3/2016 |
| RU | 2620750 | C1 | 5/2017 |
| RU | 2631939 | C2 | 9/2017 |
| SG | 10201810752 | R | 6/2020 |
| TH | 69500 | B | 4/2019 |
| TH | 79493 | B | 10/2020 |
| TW | 200826892 | A | 7/2008 |
| TW | 201640388 | A | 11/2016 |
| TW | 201909818 | A | 3/2019 |
| TW | 201929389 | A | 7/2019 |
| WO | 9400046 | A1 | 1/1994 |
| WO | 0050460 | A1 | 8/2000 |
| WO | 0050461 | A1 | 8/2000 |
| WO | 0050077 | A9 | 8/2001 |
| WO | 02067750 | A1 | 9/2002 |
| WO | 02067755 | A1 | 9/2002 |
| WO | 02067756 | A1 | 9/2002 |
| WO | 2005029680 | A1 | 3/2005 |
| WO | 2008009886 | A1 | 1/2008 |
| WO | 2008009891 | A1 | 1/2008 |
| WO | 2011056183 | A1 | 5/2011 |
| WO | 2011131965 | A1 | 10/2011 |
| WO | 2011139804 | A2 | 11/2011 |
| WO | 2013014093 | A1 | 1/2013 |
| WO | 2013014094 | A1 | 1/2013 |
| WO | 2013026272 | A1 | 2/2013 |
| WO | 2013082309 | A1 | 6/2013 |
| WO | 2013148348 | A1 | 10/2013 |
| WO | 2013190311 | A1 | 12/2013 |
| WO | 2014088157 | A1 | 6/2014 |
| WO | 2014170638 | A1 | 10/2014 |
| WO | 2016078346 | A1 | 5/2016 |
| WO | 2017001831 | A1 | 1/2017 |

(56) References Cited

FOREIGN PATENT DOCUMENTS

| | | | |
|---|---|---|---|
| WO | 2017001838 | A1 | 1/2017 |
| WO | 2017001839 | A1 | 1/2017 |
| WO | 2017129931 | A1 | 8/2017 |
| WO | 2017163066 | A1 | 9/2017 |
| WO | 2017163068 | A1 | 9/2017 |
| WO | 2018051113 | A1 | 3/2018 |
| WO | 2019042763 | A1 | 3/2019 |
| WO | 2019120180 | A1 | 6/2019 |
| WO | 2019141971 | A1 | 7/2019 |
| WO | 2020025956 | A1 | 2/2020 |
| WO | 2020055519 | A1 | 3/2020 |
| WO | 2020089580 | A1 | 5/2020 |
| WO | 2020152433 | A1 | 7/2020 |
| WO | 2020201686 | A1 | 10/2020 |
| WO | 2020229790 | A1 | 11/2020 |
| WO | 2021009478 | A1 | 1/2021 |
| WO | 2021123719 | A1 | 6/2021 |
| WO | 2021195773 | A1 | 10/2021 |
| WO | 2021234339 | A1 | 11/2021 |
| WO | 2022003310 | A1 | 1/2022 |
| WO | 2022069873 | A1 | 4/2022 |
| WO | 2022069881 | A1 | 4/2022 |
| WO | 2022089132 | A1 | 5/2022 |
| WO | 2022090683 | A1 | 5/2022 |
| WO | 2022123198 | A1 | 6/2022 |
| WO | 2022129826 | A1 | 6/2022 |
| WO | 2022129827 | A1 | 6/2022 |
| WO | 2022129828 | A1 | 6/2022 |
| WO | 2022129829 | A1 | 6/2022 |
| WO | 2022129830 | A1 | 6/2022 |
| WO | 2022129831 | A1 | 6/2022 |
| WO | 2022129832 | A1 | 6/2022 |
| WO | 2022129833 | A1 | 6/2022 |
| WO | 2022129834 | A1 | 6/2022 |
| WO | 2022129835 | A1 | 6/2022 |
| WO | 2022129836 | A1 | 6/2022 |
| WO | 2022129837 | A1 | 6/2022 |
| WO | 2022129846 | A1 | 6/2022 |
| WO | 2022129855 | A1 | 6/2022 |
| WO | 2022136821 | A1 | 6/2022 |
| WO | 2022136825 | A1 | 6/2022 |
| WO | 2022136826 | A1 | 6/2022 |
| WO | 2022136827 | A1 | 6/2022 |
| WO | 2022136829 | A1 | 6/2022 |
| WO | 2022136830 | A1 | 6/2022 |
| WO | 2022136833 | A1 | 6/2022 |
| WO | 2022136834 | A1 | 6/2022 |
| WO | 2022136837 | A1 | 6/2022 |
| WO | 2022136866 | A2 | 6/2022 |
| WO | 2022146119 | A1 | 7/2022 |
| WO | 2022153029 | A1 | 7/2022 |
| WO | 2022153030 | A1 | 7/2022 |
| WO | 2022156300 | A1 | 7/2022 |
| WO | 2022162336 | A1 | 8/2022 |
| WO | 2022162338 | A1 | 8/2022 |
| WO | 2022162339 | A1 | 8/2022 |
| WO | 2022162340 | A1 | 8/2022 |
| WO | 2022180384 | A1 | 9/2022 |
| WO | 2022180387 | A1 | 9/2022 |
| WO | 2022180389 | A1 | 9/2022 |
| WO | 2022214782 | A1 | 10/2022 |
| WO | 2022214783 | A1 | 10/2022 |
| WO | 2022214791 | A1 | 10/2022 |
| WO | 2022214792 | A1 | 10/2022 |
| WO | 2022229597 | A1 | 11/2022 |
| WO | 2022229598 | A1 | 11/2022 |
| WO | 2022229599 | A1 | 11/2022 |
| WO | 2022229600 | A1 | 11/2022 |
| WO | 2022229613 | A1 | 11/2022 |
| WO | 2022234251 | A1 | 11/2022 |
| WO | 2022234253 | A1 | 11/2022 |
| WO | 2022234254 | A1 | 11/2022 |
| WO | 2022234255 | A1 | 11/2022 |
| WO | 2022238685 | A1 | 11/2022 |
| WO | 2022238686 | A1 | 11/2022 |
| WO | 2022248825 | A1 | 12/2022 |
| WO | 2022248826 | A1 | 12/2022 |
| WO | 2022248827 | A1 | 12/2022 |
| WO | 2022248828 | A1 | 12/2022 |
| WO | 2022248829 | A1 | 12/2022 |
| WO | 2022248830 | A1 | 12/2022 |
| WO | 2022248831 | A1 | 12/2022 |
| WO | 2022248832 | A1 | 12/2022 |
| WO | 2022248833 | A1 | 12/2022 |
| WO | 2022248834 | A1 | 12/2022 |
| WO | 2022254186 | A1 | 12/2022 |
| WO | 2022254187 | A1 | 12/2022 |
| WO | 2022254188 | A1 | 12/2022 |
| WO | 2022254189 | A1 | 12/2022 |
| WO | 2022269223 | A1 | 12/2022 |
| WO | 2022269224 | A1 | 12/2022 |
| WO | 2022269225 | A1 | 12/2022 |
| WO | 2022269226 | A1 | 12/2022 |
| WO | 2022269227 | A1 | 12/2022 |
| WO | 2022269228 | A1 | 12/2022 |
| WO | 2022269230 | A1 | 12/2022 |
| WO | 2022269232 | A1 | 12/2022 |
| WO | 2022269234 | A1 | 12/2022 |
| WO | 2023285448 | A1 | 1/2023 |
| WO | 2023285806 | A1 | 1/2023 |
| WO | 2023285808 | A1 | 1/2023 |
| WO | 2023285809 | A1 | 1/2023 |
| WO | 2023285810 | A1 | 1/2023 |
| WO | 2023285811 | A1 | 1/2023 |
| WO | 2023012445 | A1 | 2/2023 |
| WO | 2023012447 | A1 | 2/2023 |
| WO | 2023012457 | A1 | 2/2023 |
| WO | 2023012458 | A1 | 2/2023 |
| WO | 2023025057 | A1 | 3/2023 |
| WO | 2023031588 | A1 | 3/2023 |
| WO | 2023037104 | A1 | 3/2023 |
| WO | 2023037106 | A1 | 3/2023 |
| WO | 2023047105 | A1 | 3/2023 |
| WO | 2023073340 | A1 | 5/2023 |
| WO | 2023075998 | A1 | 5/2023 |
| WO | 2023079270 | A1 | 5/2023 |
| WO | 2023079272 | A1 | 5/2023 |
| WO | 2023084183 | A1 | 5/2023 |
| WO | 2023084197 | A1 | 5/2023 |
| WO | 2023089296 | A1 | 5/2023 |
| WO | 2023099862 | A1 | 6/2023 |
| WO | 2023105182 | A1 | 6/2023 |
| WO | 2023105192 | A1 | 6/2023 |
| WO | 2023111500 | A1 | 6/2023 |
| WO | 2023111501 | A1 | 6/2023 |
| WO | 2023111502 | A1 | 6/2023 |
| WO | 2023111503 | A1 | 6/2023 |
| WO | 2023111504 | A1 | 6/2023 |
| WO | 2023111507 | A1 | 6/2023 |
| WO | 2023111532 | A1 | 6/2023 |
| WO | 2023111556 | A1 | 6/2023 |
| WO | 2023118806 | A1 | 6/2023 |
| WO | 2023118807 | A1 | 6/2023 |
| WO | 2023118808 | A1 | 6/2023 |
| WO | 2023118809 | A1 | 6/2023 |
| WO | 2023131770 | A1 | 7/2023 |
| WO | 2023131773 | A1 | 7/2023 |
| WO | 2023166300 | A1 | 9/2023 |

OTHER PUBLICATIONS

U.S. Appl. No. 18/416,034 entitled "Hair Care Appliance with Powered Attachment", filed on Jan. 18, 2024, 40 pages.

U.S. Appl. No. 18/480,017 entitled "Identification of Hair Care Appliance Attachments", filed on Oct. 3, 2023, 49 pages.

U.S. Appl. No. 18/417,925, filed Jan. 19, 2024, Hair Care Appliance with Powered Attachment.

U.S. Appl. No. 18/417,941, filed Jan. 19, 2024, Hair Care Appliance with Powered Attachment.

(56) References Cited

OTHER PUBLICATIONS

International Search Report and Written Opinion received for PCT Patent Application No. PCT/US2023/012205, mailed on Apr. 30, 2024, 18 pages.

* cited by examiner

HAIR CARE APPLIANCE WITH POWERED ATTACHMENT

CROSS REFERENCE TO RELATED APPLICATIONS

The present application claims priority to U.S. Provisional Patent Application No. 63/480,680 entitled "Hair Care Appliance With Powered Attachment" filed on Jan. 19, 2023, which is hereby incorporated by reference in its entirety.

FIELD

The present disclosure relates generally to hair care appliances and accessories for use with hair care appliances.

BACKGROUND

Hair care appliances are devices used for drying and styling of hair. Hair care appliances can include a variety of components operable to provide a fluid flow via a fluid flow path extending through the device. The fluid flow path receives ambient air and directs the ambient air through the hair care appliance via a motor and fan assembly. The fluid flow path is directed across a heating assembly to generate heated air at an outlet of the hair care appliance. Air is expelled from the hair care appliance via the fluid flow path to enable a user to dry or style hair. One or more attachments are often used with the hair care appliance depending on the user's hair styling or treatment needs. The attachments are typically designed for a single purpose, such as drying, curling, or straightening hair. Therefore, typical users must have multiple devices to achieve a variety of hair styles, which adds complexity to their styling routines.

SUMMARY

In general, attachments for hair care appliances and methods of using attachments for hair care appliances are provided.

In one aspect, a brush accessory is provided that in one implementation includes a hollow body having first and second regions, an attachment collar at a first end of the hollow body and having an inlet for receiving airflow, a plurality of bristles positioned along the first region of the hollow body, a plurality of outlet openings positioned along the first region of the hollow body adjacent the plurality of bristles, and a heater assembly positioned along the second region of the hollow body. The first region has a circular cross-sectional shape and the second region has a triangular cross-sectional shape. The heater assembly has at least two tines configured to receive hair therebetween.

The brush accessory can vary in any number of ways. For example, the heater assembly can have a heater shell with an opening and at least two tines can be positioned within the opening. The heater assembly can have between 20 tines and 40 tines. Each tine of the at least two tines can have a top surface and a bottom surface, and each of the top and bottom surfaces can be substantially planar. The plurality of bristles can be arranged in a plurality of rows spaced circumferentially around the first region. The plurality of rows can be between 5 and 10 rows.

Each opening of the plurality of outlet openings can be configured as an outlet for airflow. The brush accessory can have a baffle positioned within the hollow body and configured to direct air through each of the openings of the plurality of openings.

In another implementation, a brush accessory includes a hollow body having a rounded sidewall with a first section and a second section, an attachment collar at a first end of the hollow body and having an inlet for receiving airflow, a plurality of outlet openings positioned along the first section of the hollow body, and a heater assembly positioned along the second section of the hollow body. The first and second sections are joined together. The heater assembly includes a plurality of slots oriented perpendicular to a longitudinal axis of the hollow body.

The brush accessory can vary in any number of ways. For example, the heater assembly comprises a heater shell with an opening, and wherein at least one slot is positioned within the opening. The heater assembly can include between 20 slots and 40 slots. Each slot of the plurality of slots can be defined by a pair of tines. Each tine of the pair of tines can have a top surface and a bottom surface, where each of the top and bottom surfaces can be substantially planar.

A plurality of bristles can extend from the first section. The plurality of bristles can be arranged in a plurality of rows spaced circumferentially around the first section. The plurality of rows can be between 5 and 10 rows. Each outlet opening of the plurality of outlet openings can be configured as an outlet for airflow.

In another implementation, a brush accessory includes a hollow body having first and second regions and an attachment collar at a first end of the hollow body and having an inlet for receiving air flow. The first region has a circular cross-sectional shape and a plurality of bristles thereon and the second region has a triangular cross-sectional shape and a heater assembly thereon. The first region has a circumference of a first arc length and the second region is joined to the first region along a second arc length, and wherein a ratio of the second arc length to the first arc length is about 3:20 or greater.

The brush accessory can vary in any number of ways. For example, the ratio can be less than 5:20. The first arc length can be between about 100 mm and about 150 mm. The second arc length can be between about 10 mm and about 30 mm.

The heater assembly can include a plurality of tines. The plurality of tines can be between 20 and 40 tines. Each tine of the plurality of tines can have a triangular cross-sectional shape. Each tine of the plurality of tines can have a top surface and a bottom surface, and each of the top and bottom surfaces can be substantially planar.

The brush accessory can include a plurality of outlet openings positioned along the first region of the hollow body. The plurality of bristles can be arranged in a plurality of rows spaced circumferentially around the first region. The plurality of rows can be between 5 and 10 rows.

In still another implementation, a brush accessory includes a hollow body having first and second regions and an attachment collar at a first end of the hollow body and having an inlet for receiving air flow. The first region has a circular cross-sectional shape and a plurality of bristles thereon and the second region has a triangular cross-sectional shape and a heater assembly thereon. The first region has a portion configured to contact hair of a first arc length and the second region is joined to the first region along a second arc length, and wherein a ratio of the second arc length to the first arc length is about 4:20 or greater.

In yet another implementation, a brush accessory includes a rounded body having a lumen extending therethrough and an attachment collar at one end thereof, at least two bristles positioned along a first section of the rounded body, and a heater assembly positioned along a second section of the rounded body. The heater assembly includes a plurality of tines where a distance between adjacent tines of the plurality of tines is between about 0.5 mm and about 0.7 mm. The first section includes at least one opening positioned between the at least two bristles.

The brush accessory can vary in any number of ways. For example, the distance between adjacent tines of the plurality of tines can be about 0.6 mm.

The heater assembly can include a heater shell with an opening and at least two tines of the plurality of tines can be positioned within the opening. The plurality of tines can be between 20 tines and 40 tines. Each tine of the plurality of tines can have a triangular cross-sectional shape. Each tine of the plurality of tines can be positioned perpendicular to a longitudinal dimension of the hollow body. Each tine of the at least two tines can have a top surface and a bottom surface, where each of the top and bottom surfaces can be substantially planar.

The at least two bristles are arranged in a plurality of rows spaced circumferentially around the first region. The plurality of rows can be between 5 and 10 rows. The at least one outlet opening can be configured as an outlet for airflow.

In still another implementation, a brush accessory includes a rounded body having a lumen extending therethrough and an attachment collar at one end thereof, at least two bristles positioned along a first section of the rounded body, the first section including at least one outlet opening positioned between the at least two bristles, and a heater assembly positioned along a second section of the rounded body. The heater assembly includes a first tine support having a first set of tines and a second tine support having a second set of tines. The first and second tine supports interlock such that a tine of the second set of tines is positioned between two tines of the first set of tines.

The brush accessory can vary in any number of ways. For example, the first tine support can include a plurality of tine openings configured to receive the second set of tines. The heater assembly can include a heater shell that covers at least a portion of each of the first and second tine supports. Each tine of the first and second sets of tines can have a triangular cross-sectional shape. Each tine of the first and second sets of tines can be positioned perpendicular to a longitudinal dimension of the rounded body. Each tine of the first and second sets of tines can have a top surface and a bottom surface, where each of the top and bottom surfaces can be substantially planar. Each of the first and second sets of tines can have 16 tines.

The at least two bristles can be arranged in a plurality of rows spaced circumferentially around the first region. The plurality of rows can be between 5 and 10 rows. The at least one outlet opening can be configured as an outlet for airflow.

DESCRIPTION OF DRAWINGS

These and other features will be more readily understood from the following detailed description taken in conjunction with the accompanying drawings, in which.

Figure 2:
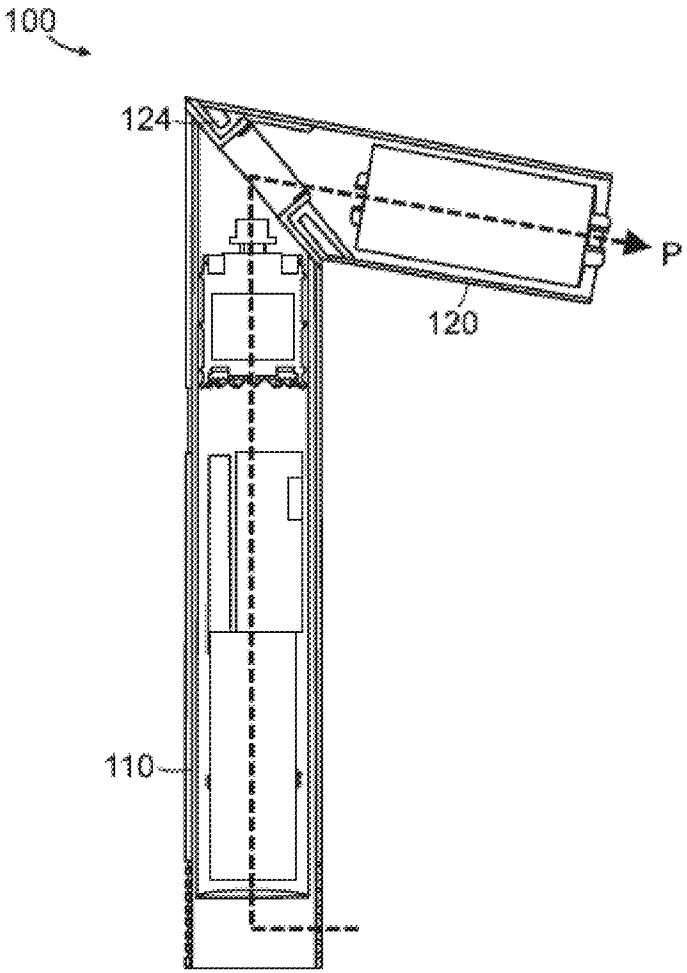
FIG. 2 is a side cross-sectional view of the hair care appliance of FIG. 1 shown in an angled or bent configuration.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary hair care appliances and accessories for use with a hair care appliance are provided herein. In general, various hair care accessories (also referred to herein as "attachments") are provided for use with a hair care appliance, such as a hair dryer or with any other hair care appliance known in the art. The exemplary hair care accessories described herein can include a brush accessory used for drying, heating, and/or styling hair. For example, the brush accessory can have a body that includes a region configured for drying hair and a region configured for heating hair to aid in straightening hair, with the regions arranged about a circumference of the body. To enable drying of hair, air may flow along a fluid flow path extending along an inner lumen of a body of the brush accessory. The air may be provided by a handle of a hair care appliance. The body can include a baffle positioned therein and configured to evenly distribute the air along a length of the body to outlet openings located throughout the body. The outlet openings can be located at one or more locations in the drying regions of the body. The body can also include bristles positioned within the drying regions of the body. The bristles and the outlet openings of the body enable a user to brush their hair as they are drying their hair. To enable heating of hair for styling, the heating regions can include one or more heater assemblies. The heater assemblies can include a plurality of tines (also referred to as plates) configured to receive and heat hair therebetween. The tines can be heated such that a user can apply heat to their hair as they are brushing their hair. The tines can be separated such that a slot is defined between adjacent tines. The distance separating the tines can be greater than a width of a human hair.

The hair care appliance and attachments described herein are configured to couple so that the hair care appliance and an attachment coupled to the hair care appliance are in electrical communication. Power can be conveyed between the hair care appliance and an attachment coupled to the hair care appliance. In some embodiments, data signals can be conveyed between the hair care appliance and an attachment coupled to the hair care appliance. Conventional hair care appliances and their attachments may not include the ability to transmit power to an attachment coupled to the hair care appliance or to exchange data signals between the hair care appliance and the attachment. As a result, users may perform certain styling methods poorly and the resulting hair styling may be undesirable or unintended, causing a negative user experience. In contrast, the hair care appliances and attachments described herein can provide a more robust styling experience by conveying power and/or data signals between the hair care appliance and the attachment coupled thereto, such as by virtue of sensors, user interfaces, and programmable styling routines as described herein. The hair care appliances and attachments described herein can enhance the overall styling experience, regardless of user skill, and provide a modular styling device that can adapt to a variety of styling needs via a broad selection of attachments configured for use with the hair care appliance.

With an attachment coupled to the hair care appliance, a user can receive indications of feedback from a user interface of the attachment indicating at least one setting (e.g., timing, temperature, etc.) required to achieve optimal styling results. In some embodiments, powered sensors provided in the attachments can further enable automated operation of the hair care appliance to ensure the user is employing the device in a manner that will generate the best results possible for a desired styling method.

Figure 1:
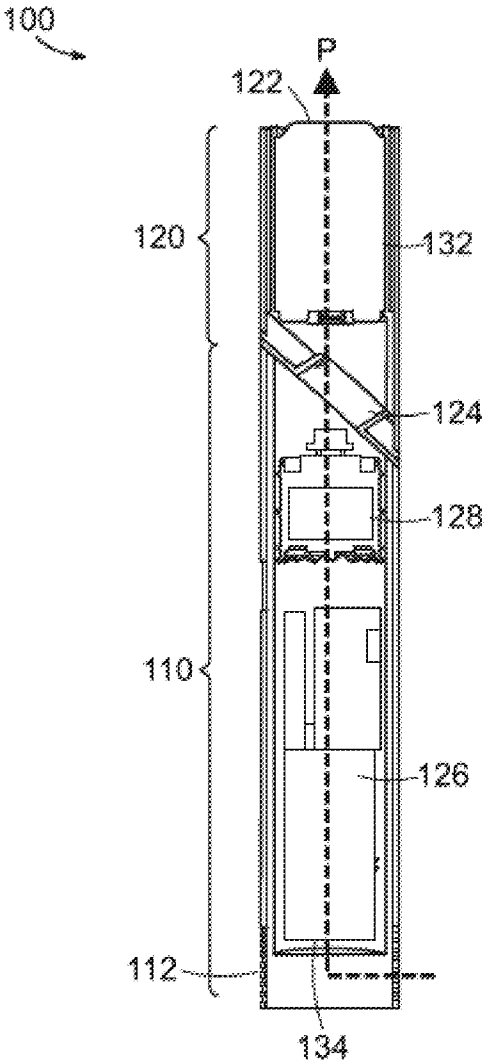
FIG. 1 is a side cross-sectional view of one exemplary embodiment of a hair care appliance shown in a straight configuration.

FIGS. 1 and 2 illustrate one exemplary embodiment of a hair care appliance 100. The illustrated hair care appliance 100 has straight and bent configurations, as respectively shown, however the hair care appliance 100 can have various other configurations. As in this illustrated embodiment, the hair care appliance 100 can generally include a handle 110 movably coupled to a body 120 by a rotational hinge joint 124. In the straight configuration, shown in FIG. 1, the appliance 100 has a generally elongate cylindrical shape. The handle 110 has an inlet 112 at a first end of the appliance 100, and the body 120 has an outlet 122 at a second end of the appliance 100. A fluid flow path P (shown as a dashed line) is formed between the inlet 112 and the outlet 122. The rotational hinge joint 124 formed between the handle 110 and the body 120 is configured to articulate via user operation to alter the configuration of the hair care appliance 100 and the fluid flow path P from the straight configuration to the bent configuration (also referred to herein an as "angled configuration"). As shown in FIG. 2, in the angled configuration, the handle 110 and the body 120 are angled relative to one another as a result of articulation of the rotational hinge joint 124. As a result, as shown in FIG. 2, the fluid flow path P shown by a dashed line is angled between the handle 110 and the body 120. In FIG. 1, the fluid flow path P is substantially straight from the inlet 112 to the outlet 122.

A person skilled in the art will appreciate that the hair care appliance 100 can be operated while the rotational hinge joint 124 is unlatched, and/or while the rotational hinge joint 124 is rotated to any position that is between the position of the rotational hinge joint 124 in the straight configuration and the angled configuration. In other aspects, the hair care appliance 100 and the rotational hinge joint 124 can be configured to prevent over-rotation of the rotational hinge joint 124 beyond its position in the angled configuration. The hair care appliance 100 can be configured in a fully straight configuration, as shown in FIG. 1, in which the rotational hinge joint locks the body 120 so as to be substantially longitudinally aligned with the handle 110. The hair care appliance 100 can be configured in a fully bent configuration, as shown in FIG. 2, in which the rotational hinge joint 124 locks the body 120 at an angle relative to the handle 110. The hair care appliance 100 can also be configured in a rotated configuration in which the rotational hinge joint 124 positions the body 120 relative to the handle 110 in a range of angled positions that are in between those of the straight configuration and the bent configuration. A fully angled configuration of the hair care appliance 100 is illustrated in FIG. 2. At any angled configuration, the fluid flow path P will be angled between the handle 110 and the body 120 and thus from the inlet 112 to the outlet 122.

The hair care appliance 100 includes various internal electrical components 126 configured for operating the appliance 100. In general, as in this illustrated embodiment, the handle 110 can include the electrical components 126 that are configured to control operation of a fan assembly 128 disposed within the handle 110 and a heater assembly 132 disposed in the body 120. In an exemplary embodiment, as shown, the fan assembly 128 is placed downstream of the rotational hinge joint 124 and in proximity of the heater assembly 132, which is disposed upstream of the rotational hinge joint 124. This can help improve fluid flow within the hair care appliance 100. The fan assembly 128 is configured to generate a fluid flow along the fluid flow path P such that air is drawn into the inlet 112, passes through the handle 110, and into the body 120 to be exhausted via the outlet 122. As the air passes through the body 120, the air is heated via the heater assembly 132.

Figure 4:
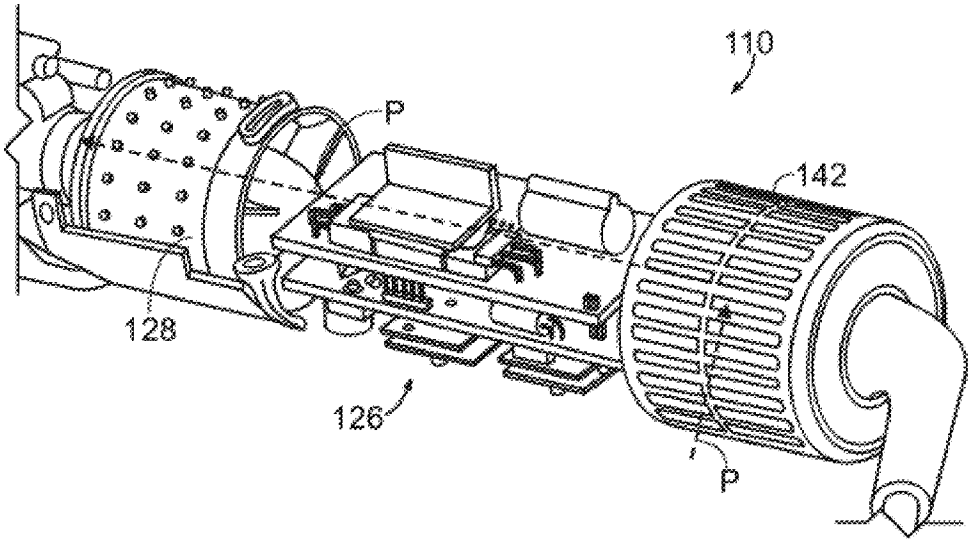
FIG. 4 is a perspective view of the handle of FIG. 1 shown with the inlet housing removed.
Figure 3:
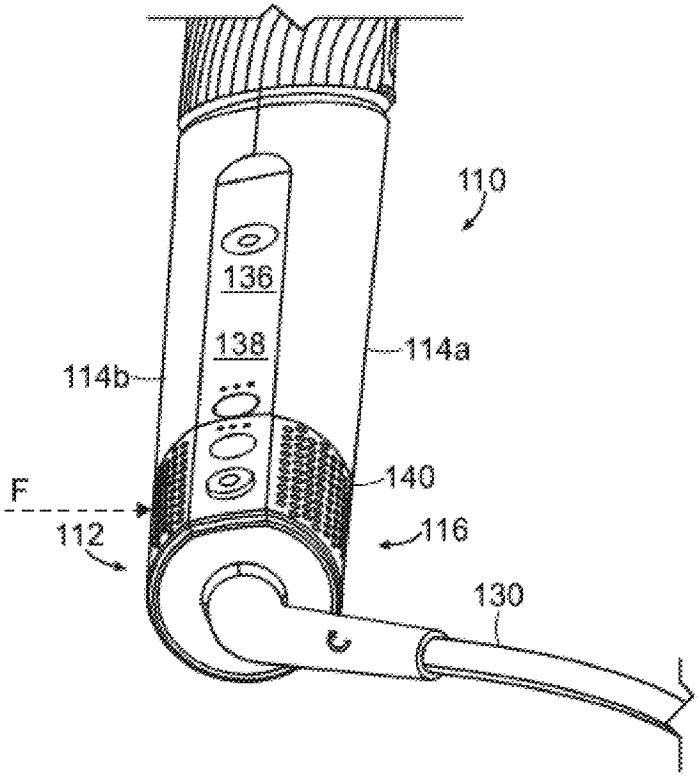
FIG. 3 is a perspective end view of a handle of the hair care appliance of FIG. 1.

The electrical components 126 are configured to couple to a power supply. FIG. 3 illustrates a power supply cord 130 extending from a proximal base of the handle 110. The power supply cord 130 has a terminal end (not shown) configured to couple to a power source, e.g., the terminal end can be configured to plug into an electrical outlet. The power supply cord 130 includes internal electrical wiring configured to deliver power to the electrical components 126 in the handle 110. The power supply cord 130 may be connected to an electronics housing containing the electrical components 126, which as in this illustrated embodiment can include at least one controller or printed circuit board (PCB) as shown in FIG. 4.

As further shown in FIG. 3, the proximal base of the handle 110 includes a filter assembly 116 configured to filter air drawn in through the inlet 112. In the illustrated embodiment, the filter assembly 116 extends around a proximal end portion of the handle 110, but is not formed in the end wall of the handle 110. Thus, fluid F is configured to drawn in circumferentially around the sidewalls of the handle 110. The illustrated filter assembly 116 includes an inlet housing 140 that is generally C-shaped and that is flexible for allowing the inlet housing 140 to be removed for cleaning. A user interface 138 intersects the inlet housing 140 in this illustrated embodiment. The inlet housing 140 has a plurality of holes through which the fluid F is configured to flow into the fluid flow path P. The holes can have any configuration and can be arranged in any pattern. The inlet housing 140 is configured to cover a filter 142 positioned behind the inlet housing 140, as shown in FIG. 4 in which the inlet housing 140 is removed. The filter 142 can be a porous element, as shown, configured to block debris and hair that may have entered the inlet housing 140, thus preventing debris from entering the fluid flow path P. As further shown in FIG. 4, the electrical components 126 are positioned just downstream of the filter 142, but upstream of the fan assembly 128, thus the fluid flow path P flows over and around the electrical components 126 as the fluid F is drawn toward and into the fan assembly 128 in operation. This can aid in cooling the electrical components 126.

Figure 5:
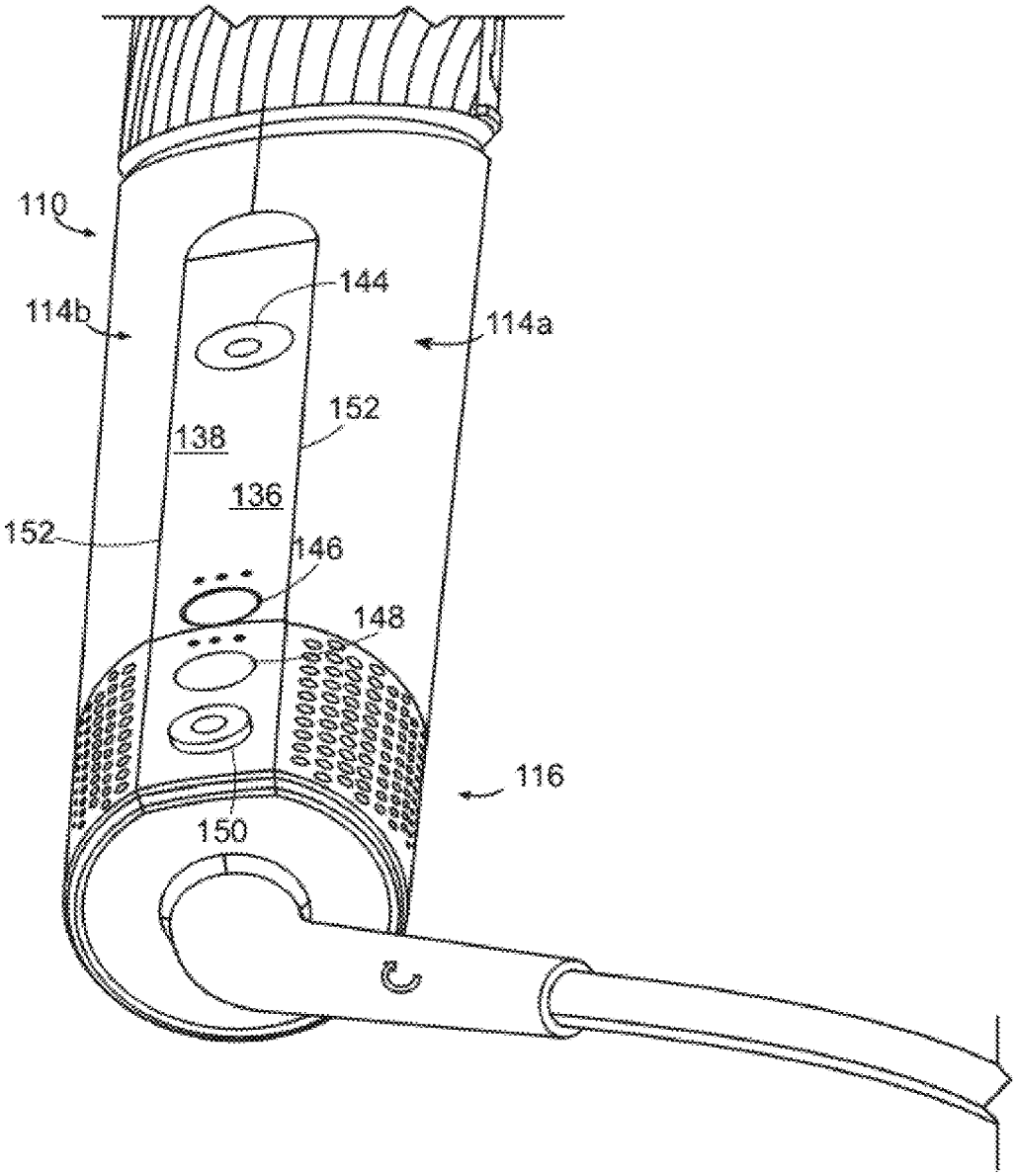
FIG. 5 is a perspective end view of a user interface of the hair care appliance of FIG. 1.

The handle 110 also includes the user interface 138 configured to enable the user to provide inputs for operating the appliance 100, as shown in FIG. 5. In particular, as in this illustrated embodiment, the user interface 138 can include one or more actuators (e.g., buttons, switches, etc.) for powering the hair care appliance 100 on and off, adjusting a temperature setting of the heater assembly 132 (and thus adjusting a temperature of the fluid F heated by the heater assembly 132), and adjusting a fan speed of the fan assembly 128 (and thus adjusting a velocity of the fluid F expelled via the outlet 122). The user interface 138 also includes one or more actuators for powering or otherwise controlling an accessory attached to the hair care appliance 100, as will be discussed in more detail below. The user interface 138 also includes an actuator for disengaging the heating assembly 132 thus providing a cool, non-heated fluid from the outlet 122. In some embodiments, the user interface 138 can include one or more light emitting diodes (LEDs), and/or other type of light, configured to provide a visual indication of an operating mode of the hair care appliance 100. In some embodiments, the user interface 138 can include one or more speakers configured to provide an audible indication of an operating mode of the hair care appliance 100. In some embodiments, the user interface 138 can include one or more haptic feedback mechanisms configured to provide a tactile indication, such as a vibration, of an operating mode of the hair care appliance 100.

While the user interface 138 can be positioned at various locations, in an exemplary embodiment, the user interface 138 extends longitudinally along at least a portion of the handle 110. As shown in FIG. 5, the user interface 138 in this illustrated embodiment extends along the base of the handle 110, intersects the filter assembly 116 as shown, and extends toward the rotational hinge joint 124, terminating a small distance from the rotational hinge joint 124. The user interface 138 is provided on a scalloped portion 136 of the handle 110 in this illustrated embodiment. The scalloped portion 136 includes raised edges along opposed lateral sides of the user interface 138 configured to facilitate gripping of the handle 110 by a user. The user interface 138 extends between a first handle housing 114*a* of the handle 110 and a second handle housing 114*b* of the handle 110 in this illustrated embodiment. In another embodiment, the user interface 138 can intersect the filter 142.

The wiring coupling the user interface 138 to the electrical components 126 is routed to the sides of the user interface 138, and not directly under the user interface 138, to ensure that the fluid flow path P is not restricted or has limited fluid flow.

As indicated above, the user interface 138 can include one or more actuators configured to control operation of the hair care appliance 100 based on user inputs. For example, the user interface 138 can include a blow-out feature 144, which is shown as a button in this illustrated embodiment. Actuation of the blow-out feature 144 is configured to cause the heater assembly 132 to shut off so that only non-heated air is exhausted through the outlet 122. In some embodiments, the blow-out feature 144 can be located remotely from the user interface 138 or within the user interface 138 but remotely from other features of the user interface 138.

The user interface 138 can also include a fan setting feature 146, which is shown as a button in this illustrated embodiment. Actuation of the fan setting feature 146 is configured to control a speed of the fan assembly 128. The fan setting feature 146 is configured to be repeatedly selectable to generate high, medium, and low velocity fluid flow by the fan assembly 128.

The user interface 138 also includes a temperature setting feature 148, which is shown as a button in this illustrated embodiment. Actuation of the temperature setting feature 148 is configured to control a temperature of the heater assembly 132 and thus the fluid flow exiting the outlet 122 of the hair care appliance 100. The temperature setting feature 148 is configured to be repeatedly selectable to heat the fluid flow to very high, high, medium, or low temperatures. In some embodiments, the high temperature setting can cause the heater assembly 132 to heat the fluid flow to 100 degrees C.

As further shown in FIG. 5, the user interface 138 includes a power feature 150, which is shown as a button in this illustrated embodiment. Actuation of the power feature 150 is configured to control provision of power from the power supply to the electrical components 126 of the hair care appliance 100, and/or to electrical components of an accessory releasably coupled to the hair care appliance 100 as discussed further below. The user interface 138 also includes one or more tactile features 152, as indicated above. The tactile features 152 can, as in this illustrated embodiment, be raised edges or gripping features configured to improve the user's grip and manual dexterity when holding or operating the hair care appliance 100.

In some embodiments, the actuators (e.g., the features 144, 146, 148, 150) of the user interface 138 can be configured to avoid accidental engagement by the user. For example, one or more of the features 144, 146, 148, 150 of the user interface 138 can be recessed and require explicit engagement to trigger a particular user engagement feature. The low-profile or recessed design of the actuators of the user interface 138 is configured to enable a user to operate the hair care appliance 100 without mistakenly contacting an unintended actuator. In some embodiments, any of the actuators of the user interface 138 described herein can be configured with lighting or illuminated elements that can illuminate an actuator or surface of the user interface 138, such as an inner or under surface of the user interface 138. The arrangement and styling of the user interface features described herein can be provided in a variety of non-limiting configurations on the handle 110 of the hair care appliance 100 described herein.

The hair care appliances described herein, such as the hair care appliance 100 of FIGS. 1-5, includes a variety of features configured to improve the ease of styling hair, heating hair, and the longevity of hair styles applied using the appliance. For example, in one embodiment, the hair care appliance includes an attachment mating assembly configured to couple the appliance to a selected one of various attachments, also referred to as accessories, which can be powered attachments in some embodiments. The use of powered attachments can advantageously enhance hair styling by positioning heating elements and/or sensors in the attachment and thus closer to the hair being styled than if the heating elements and/or sensors were in the hair care appliance. Powered attachments can also include user interface elements configured to provide a user with visual, audio, and/or haptic feedback about the styling process and/or operation of the hair care appliance to which the powered attachment is releasably coupled. A user's styling experience can be enhanced using powered attachments that can be easily coupled to the hair care appliance via the attachment mating assembly configured to couple with an attachment mating mechanism of a selected powered attachment. Providing power and/or communications circuitry between the hair care appliance and a powered attachment via the attachment mating mechanism can expand the operation and function of the hair care appliance.

Various exemplary embodiments of attachments and powered attachments are further described, for example, in U.S. patent application Ser. No. 18/098,086 entitled "Hot Brush" filed on Jan. 17, 2023, U.S. patent application Ser. No. 18/480,017 entitled "Identification Of Hair Care Appliance Attachments" filed on Oct. 3, 2023 and in U.S. patent application Ser. No. 18/416,034 entitled "HAIR CARE APPLIANCE WITH POWERED ATTACHMENT" filed on Jan. 18, 2024, which are hereby incorporated by reference in their entireties.

Figure 6:
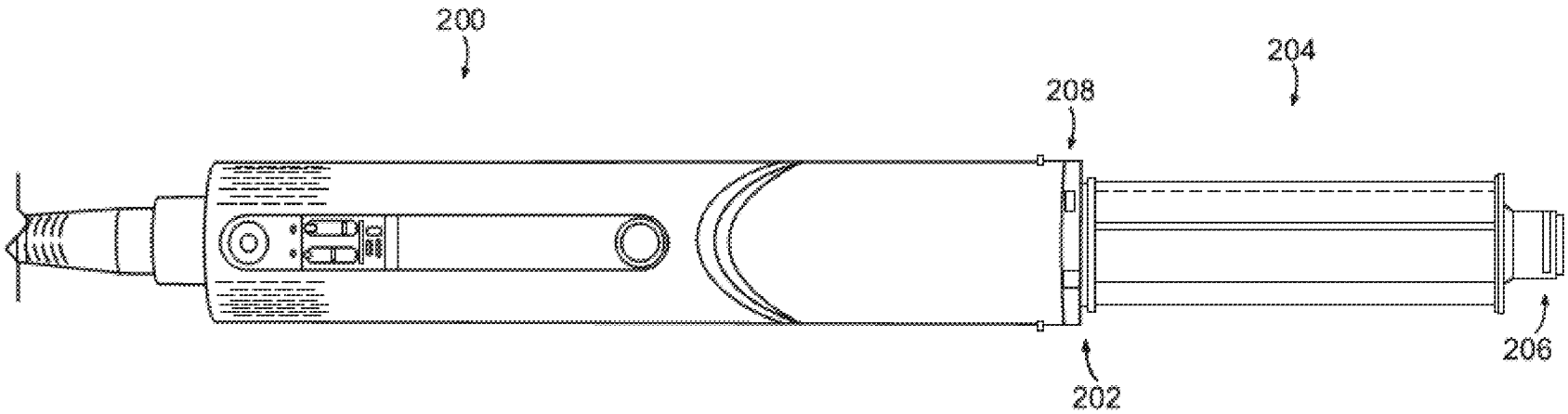
FIG. 6 is a side view of an exemplary embodiment of a hair care appliance and a powered attachment as described herein.

FIG. 6 illustrates one exemplary embodiment of a hair care appliance 200 having an attachment mating assembly 202 configured to couple an attachment 204 to the hair care appliance 200. In this embodiment, the attachment 204 is a curling attachment configured to curl hair. The curling attachment 204 in this illustrated embodiment has a generally elongate cylindrical configuration with a plurality of heating plates thereon, as discussed further below. The illustrated curling attachment 204 further includes a user interface 206 at a distal end of the attachment 204. In some embodiments, as in this illustrated embodiment, the hair care appliance 200 can also include a user interface 208 at a distal end of the hair care appliance 200. In some embodiments, one or both of the user interfaces 206, 208 can include at least one LED and/or other type of light, at least one speaker, and/or at least one haptic feedback mechanisms. Although FIG. 6 shows a curling attachment 204, a variety of non-limiting attachments can be envisioned that can be configured to couple to the hair care appliance 200 via the attachment mating assembly 202 described herein. Other examples of attachments are discussed herein.

Figure 7:
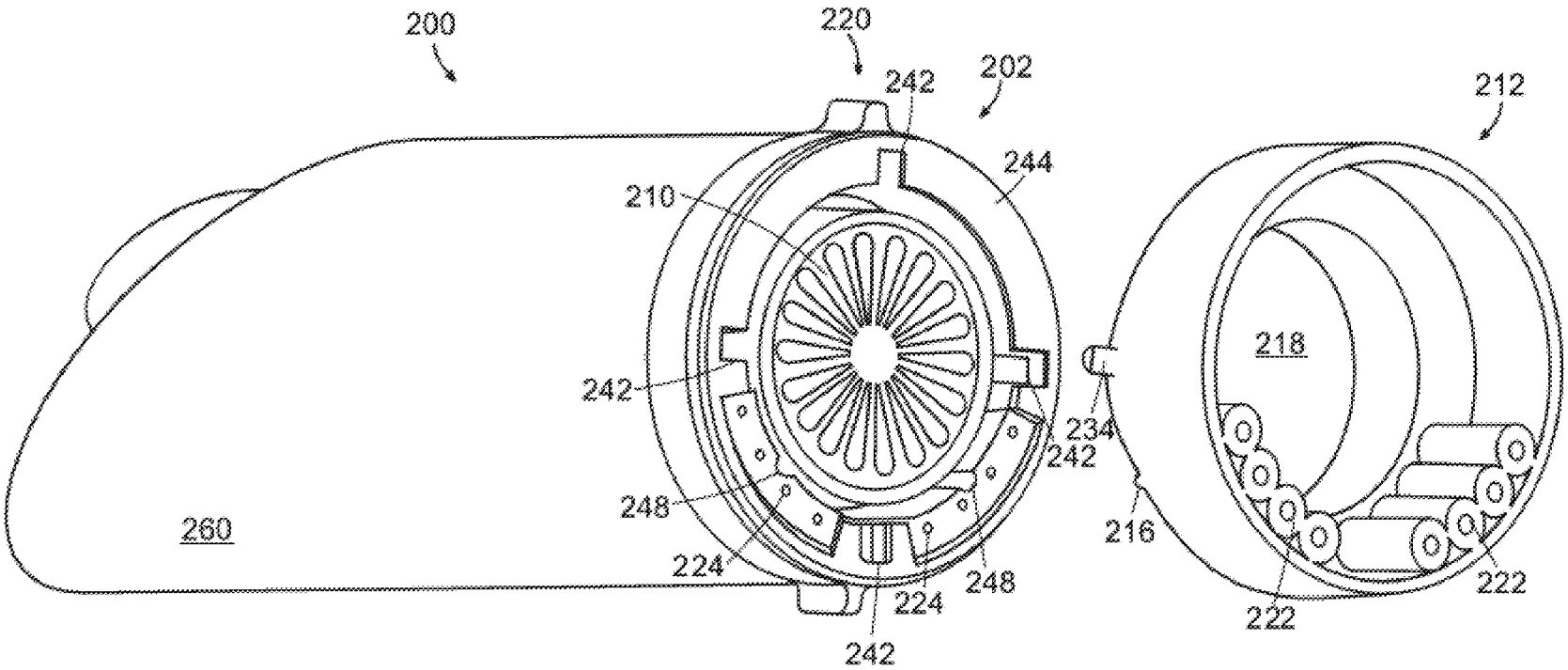
FIG. 7 is an perspective view of an exemplary embodiment of an attachment mating assembly of the hair care appliance of FIG. 6 and an attachment coupling configured for use with the powered attachment of FIG. 6.

The attachment mating assembly 202 is provided at the distal end of the hair care appliance 200 and surrounds an outlet 210 of the hair care appliance 200. As shown in FIG. 7, the attachment mating assembly 202 is in the form of a ring-shaped body having mating features thereon. An attachment coupling 212, which can be referred to as an attachment collar, provided on an attachment (such as the curling attachment 204 or another attachment) can be coupled to the attachment mating assembly 202. In the illustrated embodiment of FIG. 7, the attachment coupling 212 is likewise in the form of a ring-shaped body having mating features 234 thereon configured to mate with the corresponding mating features on the attachment mating assembly 202. The attachment coupling 212 includes an opening 218 through which, with the attachment that includes the attachment coupling 212 coupled to the hair care appliance 200, air flow exiting the outlet 210 of the hair care appliance 200 enters the attachment.

Figure 8B:
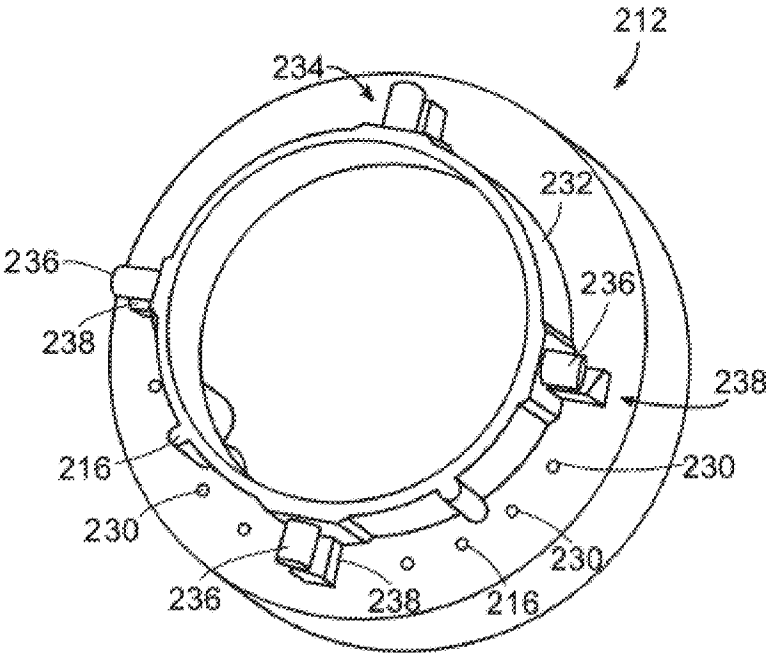
FIG. 8B is a perspective view of a second side of the attachment coupling of FIG. 7.
Figure 9:
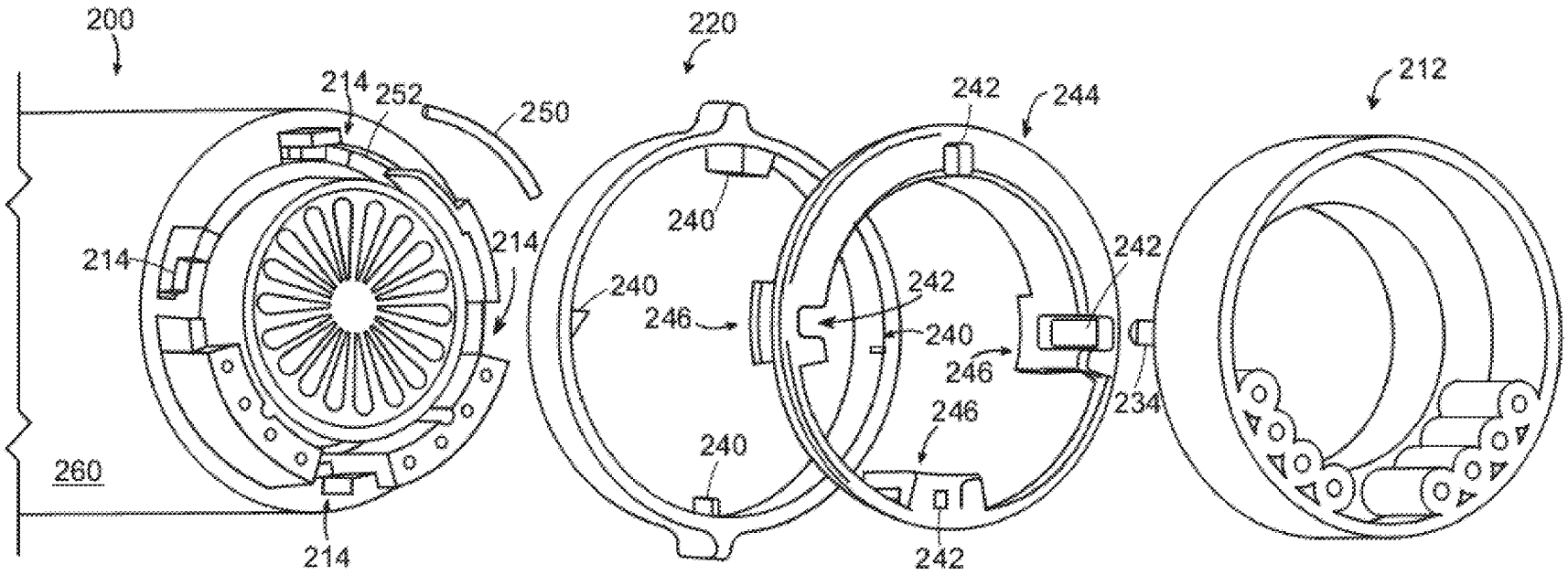
FIG. 9 is an exploded view of the attachment mating assembly and the attachment coupling of FIG. 7.

While various mating features can be utilized to mate the attachment coupling 212 to the attachment mating assembly 202, in the illustrated embodiment the attachment coupling 212 includes a plurality of projections 236, 238 (see FIG. 8B) configured to extend into corresponding slots 214, 242 (see FIGS. 7 and 9) formed in the attachment mating assembly 202. The attachment that includes the attachment coupling 212 is thus configured to be coupled to the attachment mating assembly 202 by aligning the projections 236, 238 with the slots 214, 242 of the attachment mating assembly 202 and applying a linear force along a longitudinal axis of the attachment and the appliance 200. The attachment mating assembly 202 further includes a rotatable release mechanism 220, such as a rotatable ring as shown (see FIG. 9), configured to engage the projections 236, 238 within the slots 214, 242 to prevent removal thereof. The ring 220 is spring-biased to an engaged position. Thus, during insertion of the projections 236, 238 into the slots 214, 242, the projections 216 are configured to cause the ring 220 to rotate out of the way, e.g., to move out of the engaged position, thus allowing the projections 236, 238 to fully extend into the slots 214, 242. Once fully seated in the slots 214, 242, the spring-bias of the release mechanism 220 is configured to cause the rotatable ring to return to the initial, engaged position, thereby engaging the projections 236, 238 within the slots 214, 242 to retain the projections 236, 238 therein, thus retaining the attachment coupling 212 to the attachment mating assembly 202. The release mechanism 220 is configured to secure the attachment coupling 212 to the attachment mating assembly 202 so that the attachment that includes the attachment coupling 212 is securely fixed and immovable relative to the hair care appliance 200 until the release mechanism 220 is actuated, as discussed herein, to allow release of the attachment from the appliance 200. The release mechanism 220 is configured to be rotated by a user to disengage the release mechanism 220 from the attachment coupling 212 to allow removal of the attachment from the hair care appliance 200.

As further shown in FIG. 7, the attachment coupling 212 includes a plurality of electrical connectors 222, such as male pins as shown. The male pins are configured to be received within corresponding female sockets of electrical connectors 224 provided in the attachment mating assembly 202. A variety of non-limiting connector types can be used, such as keyed connectors, locking connectors, pogo pins, crown spring connectors, crimp connectors, or blade connectors. Additionally, the arrangement of the electrical connectors 222, 224 can vary. For example, in some embodiments, the attachment coupling 212 can include female connectors and the attachment mating assembly 202 can include male connectors, or vice versa. The location or arrangement of the electrical connectors 222, 224 on the attachment mating assembly 202 (and the corresponding location on the attachment coupling 212) can also vary. For example, as shown in FIG. 7, two sets of adjacent 4-pin connectors are shown in corresponding locations about circumferences of the attachment mating assembly 202 and the attachment coupling 212. In some embodiments, the sets of electrical connectors 222, 224 may be opposite one another or positioned separately from one another around the circumferences of the attachment mating assembly 202 and the attachment coupling 212. In some embodiments, a set of connectors can include 2, 3, 4, 5, 6, 7, 8, 9, 10, 11, or 12 connectors. The arrangement of the electrical connectors 222, 224 can be configured to provide the appliance 200 with a small diameter body or housing, ease of wire routing, and can reduce airflow obstruction through the appliance 200.

The electrical connectors 222 of the appliance 200 and the electrical connectors 224 of the attachment, with the attachment coupled to the appliance 200, are configured to be communicatively coupled via wiring to electrical components of the appliance 200, e.g., a PCB, a fan assembly, a motor, a user interface, a switch, or other components configured in the appliance 200. The electrical connectors 222, and the electrical connectors 224 when connected thereto, are further configured to communicatively coupled via wiring to electrical components of the attachment, e.g., a heating element, a heating assembly, a sensor, or a user interface configured in the attachment. The electrical connectors 222, 224, when connected, are configured to convey power signals and/or data signals between the appliance 200 and the attachment.

For example, in one embodiment, a first set of the electrical connectors 222, 224 are configured to convey power between the appliance 200 and the attachment coupled thereto, or vice versa. The first set can include first and second power pins, first and second neutral pins, and a local earth or ground pin. A second set of the electrical connectors 222, 224 is configured to convey data between the appliance 200 and the attachment coupled thereto, or vice versa. The second set can include first and second user interface control pins, first and second sensor data pins, and a spare pin.

Figure 8A:
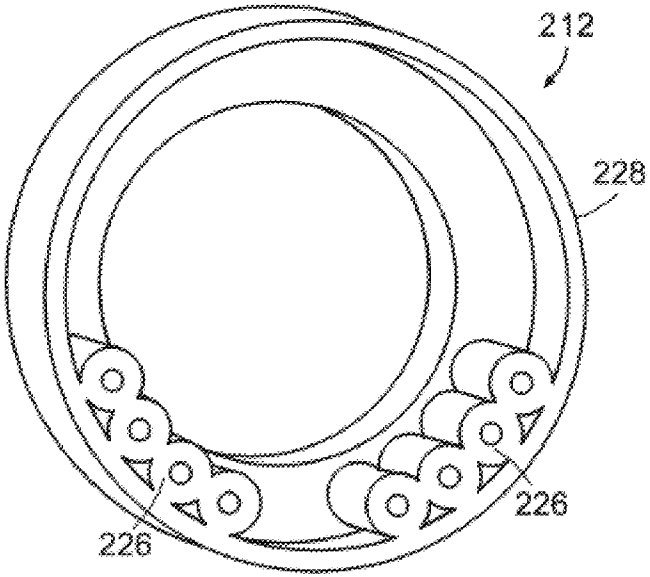
FIG. 8A is a perspective view of a first side of the attachment coupling of FIG. 7.

As indicated above, the attachment coupling 212 can be, as in this illustrated embodiment, include a ring-shaped structure having an opening 218 therein for air flow to pass from the outlet 210 of the appliance 200 into the attachment coupled with the appliance 200. The attachment coupling 212 includes a first, distal side, as shown in FIG. 8A, including housings 226 at which the electrical connectors 222 are configured to receive wires from the electrical components of the attachment that includes the attachment coupling 212. The first side also includes a collar 228 extending distally away from the first side. The collar 228 is configured to secure the attachment coupling 212 to the attachment. The opposite, second, proximal side of the attachment coupling 212, shown in FIG. 8B, includes a plurality of pins 230 that extend proximally from the housings 226 on the first side of the attachment coupling 212 and are configured to be received by receiving portions of the electrical connectors 222 configured in the attachment mating assembly 202 of the appliance 200. The second side also includes a second collar 232 extending proximally away from the second side. The second collar 232 includes engagement features 234 configured to align and secure the attachment coupling 212 within the attachment mating assembly 202. For example, as shown, the second collar 232 includes the protrusions 216 and the engagement features 234. The engagement features 234 include a pair of features configured to engage with the release mechanism 220 of the attachment mating assembly 202. A first element 236 of the pair of engagement features 234 can be, as shown, a protrusion extending radially away along their length from the second collar 232. The first element 236 is configured to be received through the slots 242 of attachment mating assembly's lock ring 244 (see FIGS. 7 and 9) and seated within the slots 214 (see FIG. 9) of the housing of the appliance 200. A second element 238 of the pair of engagement features 234 includes angle-faced protrusions co-located on the second collar 232 with the first engagement features 236 immediately adjacent to the second side. The angled faces of the second elements 238 are configured to be received through the slots 242 (see FIGS. 7 and 9) of the lock ring 244 and to engage corresponding angle-faced protrusions 240 on the release mechanism 220.

As indicated above, the attachment mating assembly 202 of the appliance 200 includes a lock ring 244 configured to secure the release mechanism 220 and the electrical connectors 222 in place at the distal end of the appliance 200. The lock ring 244 includes projecting tabs 246 extending proximally toward the appliance 200 that pass through the release mechanism 220 and engage with the slots 214 provided on the inner surface of appliance body or housing 260. The projecting tabs 246 are configured to secure the lock ring 244 to the appliance 200 and to maintain the release mechanism 220 in an operable position for rotation. The projecting tabs 246 also include the slots 242 into which engagement features 234 on the second collar 232 of the attachment coupling 212 are configured to be received as the attachment is mated with the appliance 200. An additional set of protrusions 216 (see FIG. 8B) on the second collar 232 that are co-located with the pins 230 of the attachment coupling 212 are configured to be received within respective slots 248 formed on the surface of the electrical connectors 224 to provide additional stability when the attachment is secured to the appliance 200.

The attachment mating assembly 202 also includes a compression spring 250 (see FIG. 9) or other force generating element provided in a channel 252 formed within the housing 260 of the appliance 200. The compression spring 250 is configured to be compressed within the channel 252 as a user rotates the release mechanism 220 to detach the attachment coupling 212 (and thus the attachment that includes the attachment coupling 212) from the appliance 200. The spring 250 is configured to engage the protrusion 240 of the release mechanism 220 at a first end of the spring 250 and a terminal end of the channel 252 at a second, opposite end of the spring 250. The compression spring 250 is configured to extend against the terminal end of the channel 252 and exert force against the release mechanism protrusion 240 responsive to a user releasing the release mechanism 220, thereby causing the release mechanism 220 to return or reset to a position ready for receiving an attachment, which can be either the same attachment as just released or a different attachment.

When an attachment is secured to the appliance 200, the second features 238 of the pair of engagement features on the second side of the attachment coupling 212 are configured to engage with the protrusions 240 on the release mechanism 220. For example, the angle-faced portions of the second features 238 are oriented in correspondence with the angled faces on the protrusions 240 of the release mechanism 220. The release mechanism 220 is configured to rotate slightly, by way of movement of the compression spring 250, to enable the corresponding angled faces of the second features 238 of the attachment coupling 212 to engage with the protrusions 240 of the release mechanism 220. The first features 236 of the pair of engagement features on the second side of the attachment coupling 212 are configured to engage with a non-angled face of the release mechanism protrusion 240 to prevent rotation of the attachment within the attachment mating assembly 202. In this way, the release mechanism 220 is configured to securely fix the attachment to the appliance 200 by linearly connecting the attachment coupling 212 to the attachment mating assembly 202.

Figure 10:
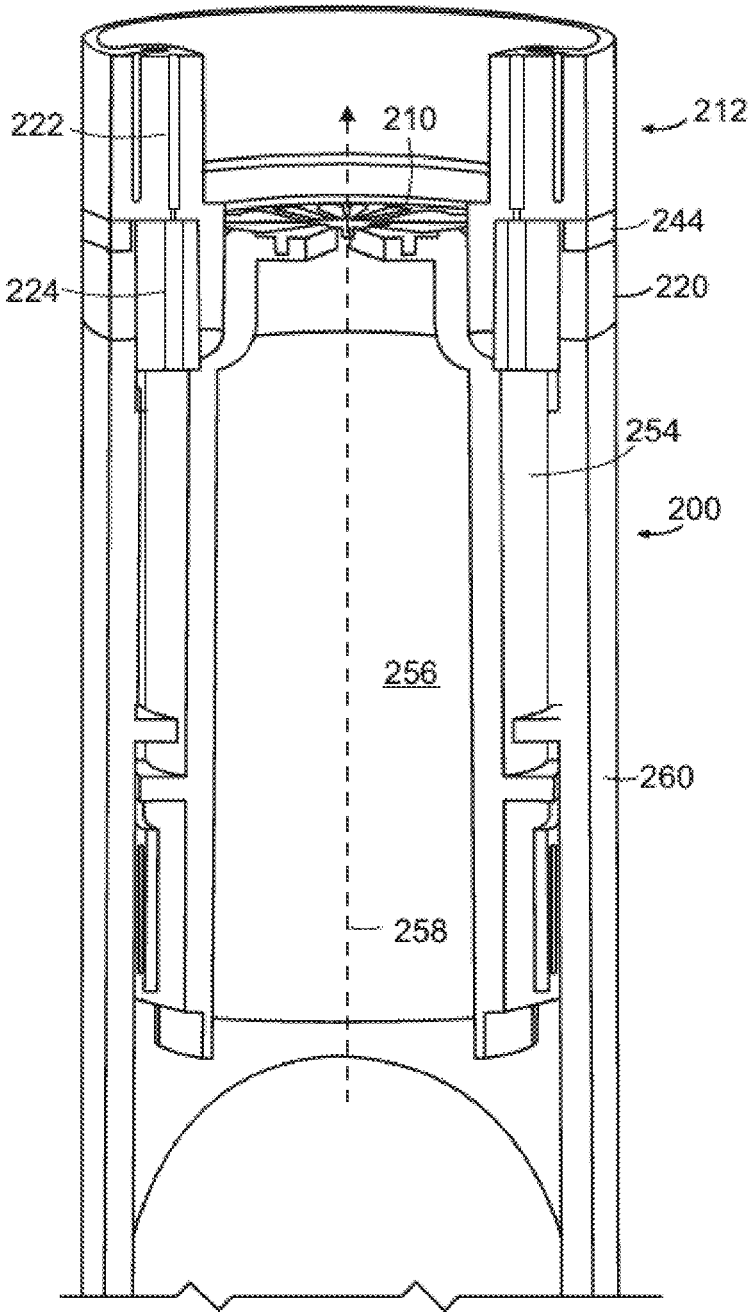
FIG. 10 is a cross-sectional view of the attachment mating assembly of FIG. 7 coupled with the attachment coupling of FIG. 7.

The attachment mating assembly 202 is configured to receive the attachment coupling 212 therein and brings the electrical connectors 224 of the attachment mating assembly 202 into contact with the corresponding electrical connectors 222 of the attachment coupling 212 as shown in the cross-sectional view of FIG. 10. As further shown in FIG. 10, the body 260 of the appliance 200 includes a frame 254 therein. The frame 254 includes a lumen 256 therein extending along a length of the frame 254. A fluid flow path 258 (shown as a dotted line) extends through the lumen 256 of the frame 254.

Figure 11:
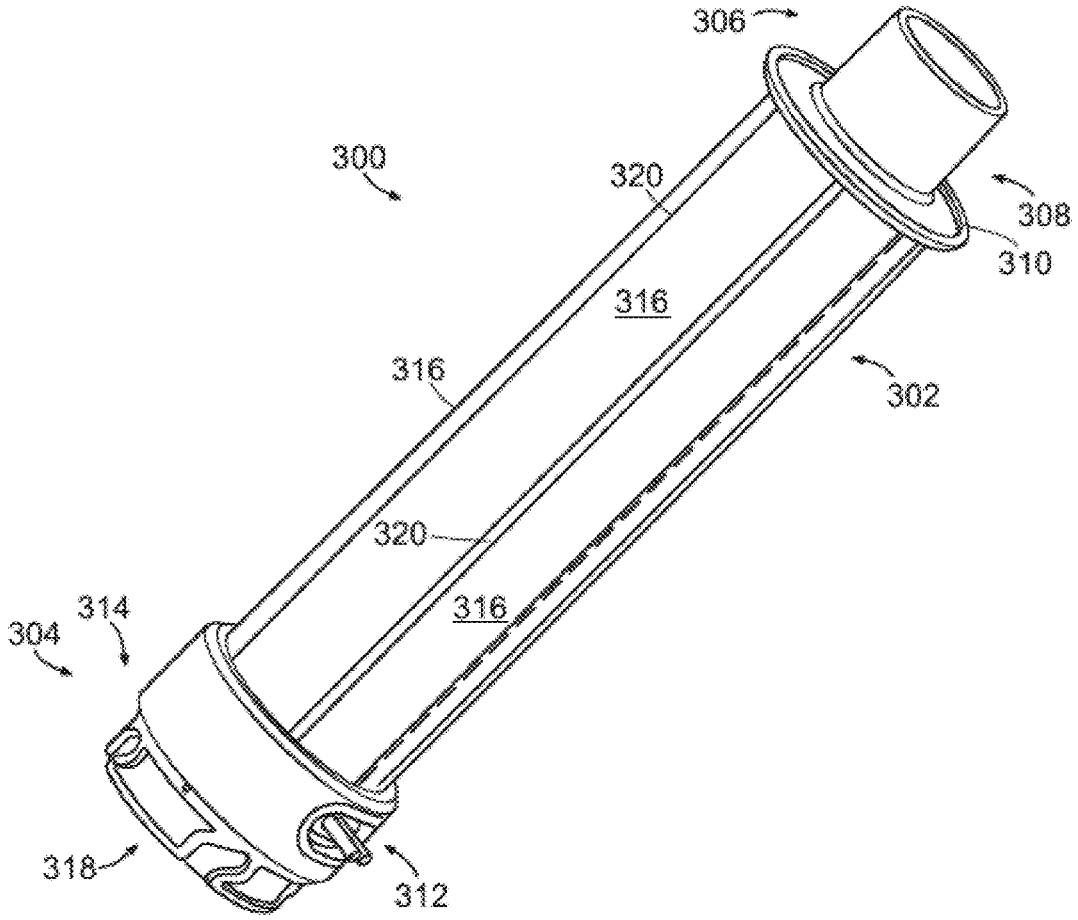
FIG. 11 is a perspective view of an exemplary embodiment of a curling attachment configured for use with the attachment coupling of FIG. 7.
Figure 12:
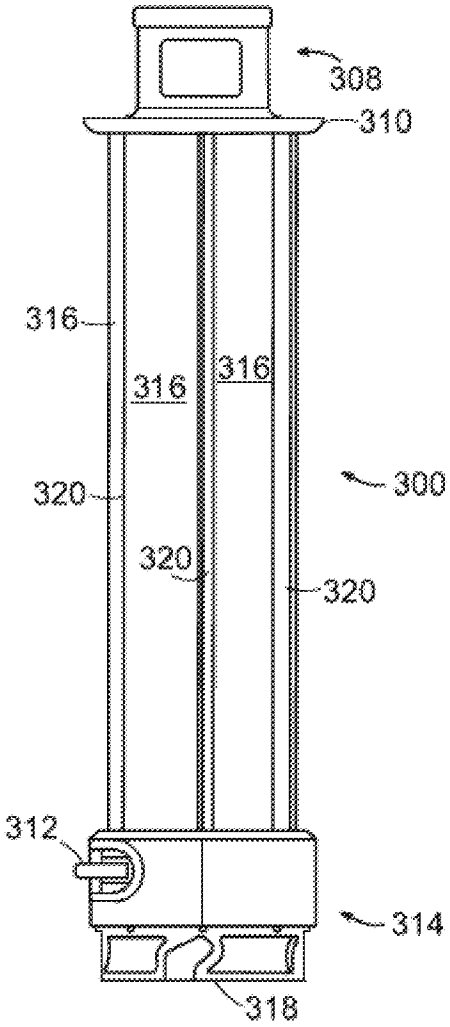
FIG. 12 is side view of the curling attachment of FIG. 11.

One exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein includes a curling attachment. One exemplary embodiment of a curling attachment is shown in FIG. 6 and is configured and used similar to another exemplary embodiment of a curling attachment 300 is shown in FIG. 11. The curling attachment 300 includes an elongate body 302 extending between an attachment end 304 and a distal end 306. The attachment end 304 is configured to mate or couple with a hair care appliance (e.g., the hair care appliance 100 of FIGS. 1-5, the hair care appliance 200 of FIGS. 6-10, or other hair care appliance) via an attachment coupling 314 (e.g., the attachment coupling 212 of FIGS. 7-10, or other attachment coupling) as described herein. The distal end 306 includes an end cap 308 having a cylindrical or other-shape protrusion extending away from an end plate 310 of the end cap 308 as shown in FIG. 12. The end plate 310 has a diameter that is greater than a diameter of the body 302 to protect a user's fingers from the heated surfaces of the body 302 when grasping the curling attachment 300 at the distal end 306.

As also shown in FIGS. 12-15, the attachment 300 includes wiring 312 configured to mate electrical connectors of the attachment coupling 314 with electrical components of the curling attachment 300, such as LEDs (and/or other types of lights), sensors, haptic feedback mechanisms, etc. The LEDs (and/or other types of lights), sensors, haptic feedback mechanisms, etc. in the attachment 300 are configured to provide user feedback regarding operation of the attachment 300. In some embodiments, the user feedback can be visual, audible, and/or tactile feedback. For example, a haptic feedback mechanism can be configured to generate vibrations which can be sensed by a user with accessibility requirements. In some embodiments, a motor of the hair care appliance to which the attachment 300 is coupled can be configured to generate haptic feedback. In some embodiments, the wiring 312 may be completely enclosed within the curling attachment 300.

The curling attachment 300 includes a plurality of longitudinally arranged plates 316 that are configured to be heated and form a curl in hair when the heated plates 316 are contacted with hair. Air flow is configured to be received from the hair care appliance to which the curling attachment 300 is attached via an inlet 318 of the curling attachment 300 and pass through the body 302 of the curling attachment 300. Air flow is configured to exit the curling attachment 300 via outlets 320 arranged longitudinally along the body 302 in between adjacent plates 316. Air flow exiting tangentially to the surface of the curling attachment 300 is configured to induce a Coanda effect. The Coanda effect allows hair to wrap around the external surface of the curling attachment 300 without a user directly manipulating hair onto the heated curling attachment 300.

Figure 13:
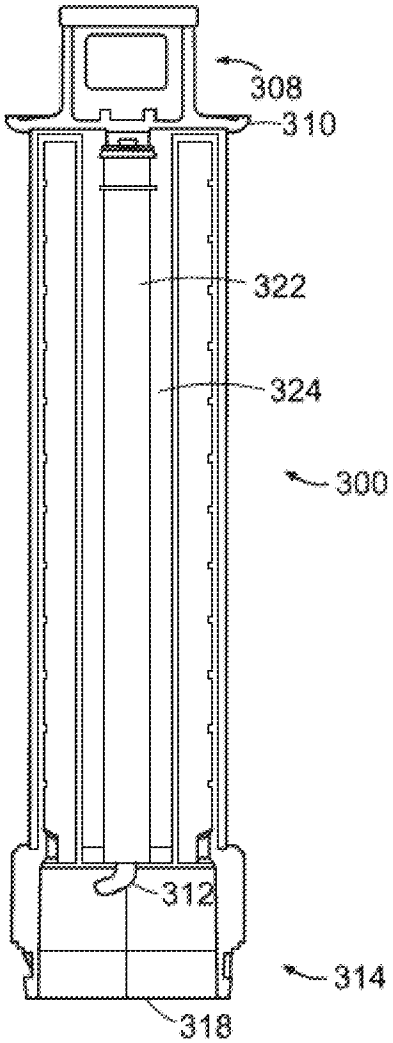
FIG. 13 is a cross-sectional view of the curling attachment of FIG. 11.
Figure 14:
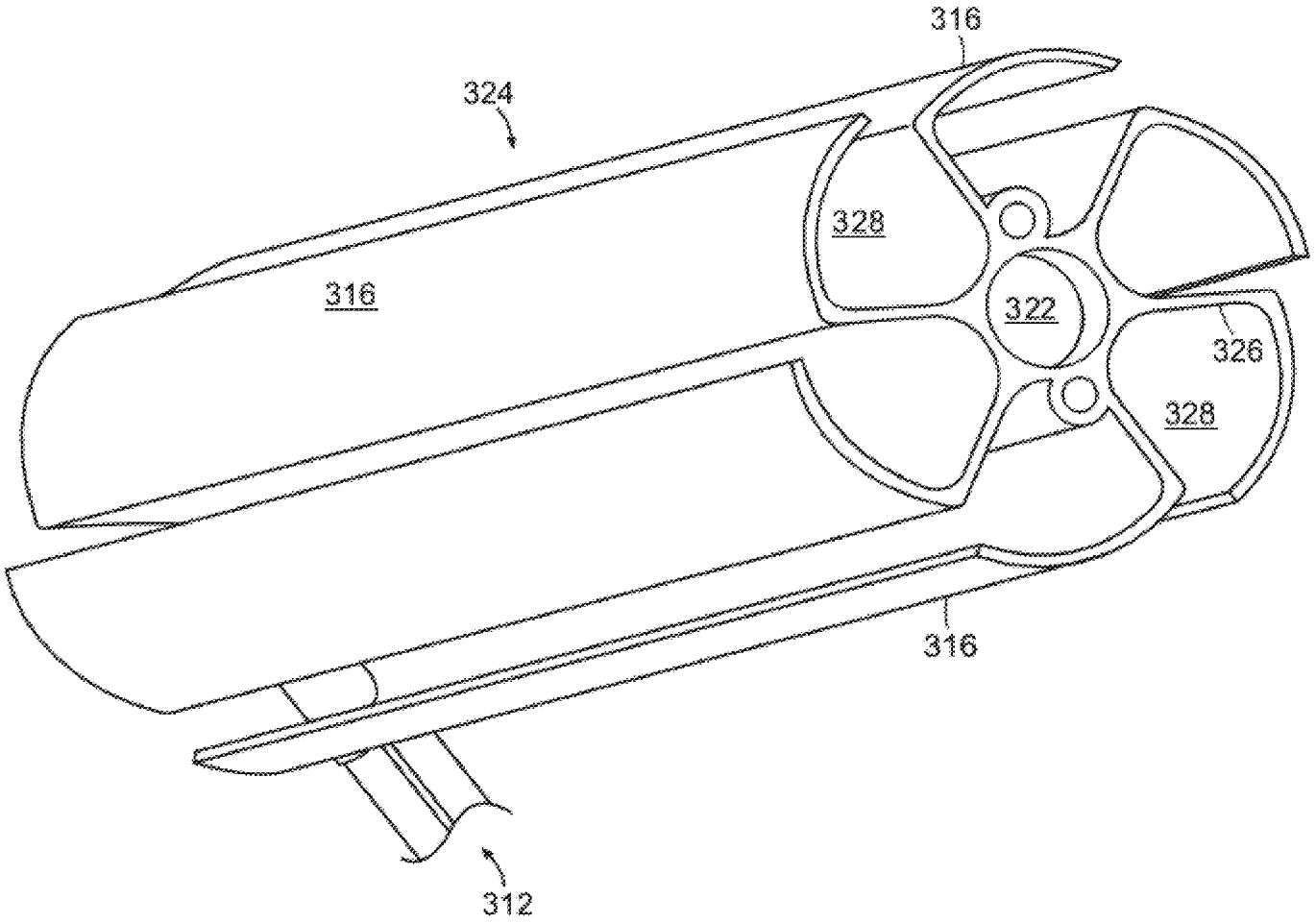
FIG. 14 is a perspective view of a heater frame of the curling attachment of FIG. 11.

The curling attachment 300 also includes a heater 322, as shown in FIGS. 13 and 14. The heater 322 in this illustrated embodiment is in the form of a cylindrical or rod-shaped heater, such as a cartridge heater, arranged within an inner lumen of a heater frame 324. The heater 322 extends along the lumen for the entire length of the body 302 or partially within the lumen at one or more portions of the body 302. The heater frame 324 includes a thermally conductive material, such as metal. In some embodiments the plates 316 can further include a coating on a surface of each plate 316 to aid heat retention and distribution. The end cap 308 is coupled to the heater frame 324. The combination of the airflow and the heater 322 configured within the curling attachment 200 allows a user to obtain the benefits of conductive thermal curling with auto-wrapping hair around a heated appliance.

As shown in FIG. 14, the heater frame 324 includes a plurality of arms 326 that extend radially from a central longitudinal axis of the heater frame 324. As in this illustrated embodiment, a plate 316 can be integrally formed with each arm 326 and can have a curved profile forming a circumference of the curling attachment 300. The number of arms 326 and plates 316 can vary and may not be limited to the number of arms 326 and plates 316 shown in FIG. 14. The heater frame 324 can be formed via extrusion for efficient manufacturing.

Figure 15:
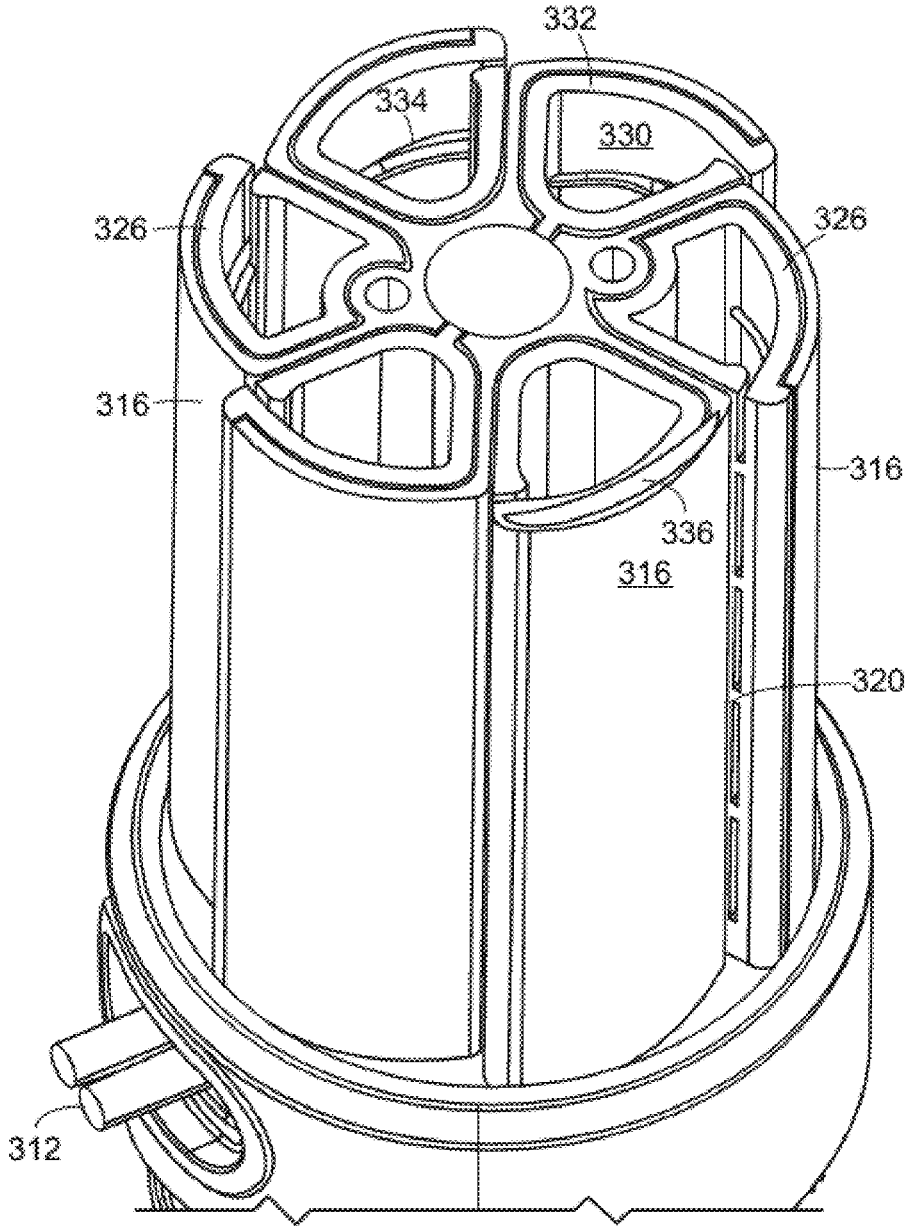
FIG. 15 is a perspective view of a cross-sectional portion of the curling attachment of FIG. 11.

The heater frame 324 also includes a plurality of flow path tunnels 328 formed between adjacent arms 326 of the heater frame 324 and bounded circumferentially by the plates 316. The flow path tunnels 328 extend longitudinally along the length of the body 302 and include a flow path lumen 330 therein. A conduit 332 is arranged within the flow path lumen 330 as shown in FIG. 15. The conduit 332 includes a heat resistant material. The conduit 332 is configured to guide air flow from the inlet 318 to the outlets 320 via vanes 334 formed on an inner surface of the conduit 332. The conduit 332 has longitudinal openings at which the outlets 320 of the curling attachment 300 are formed adjacent to longitudinal edges of respective plates 316 of the heater frame 324. For ease of manufacture, the conduit 332 can be inserted into the flow path tunnels 328 of the heater frame 324.

The curling attachment 300 also includes a moisture sensor 336 configured to detect an amount of moisture in hair of a user using the attachment 300. One moisture sensor 336 is shown in FIG. 15, but in some embodiments, the curling attachment 300 can include more than one moisture sensor 336. As shown in this illustrated embodiment of FIG. 15, the moisture sensor 336 can be positioned between the conduit 332 and the plate 316. In some embodiments, the moisture sensor 336 can extend the entire length of the body 302 or partially within the body 302. In some embodiments, the moisture sensor 336 can include a capacitive moisture sensor. The moisture sensor 336 is configured to be communicatively coupled, via the attachment coupling 314, to other electrical components of the hair care appliance to which the curling attachment 300 is attached. Sensed data obtained by the moisture sensor 336 is configured to be provided to a microprocessor or controller of the hair care appliance to which the curling attachment 300 is attached and is configured to be used by the microprocessor or controller of the hair care appliance to control operation of the hair care appliance. For example, in some embodiments, the hair care appliance can be configured to perform predetermined heating and/or drying (e.g., air flow) operations based on the amount of moisture determined from the sensor data obtained via the moisture sensor 336.

Figure 16:
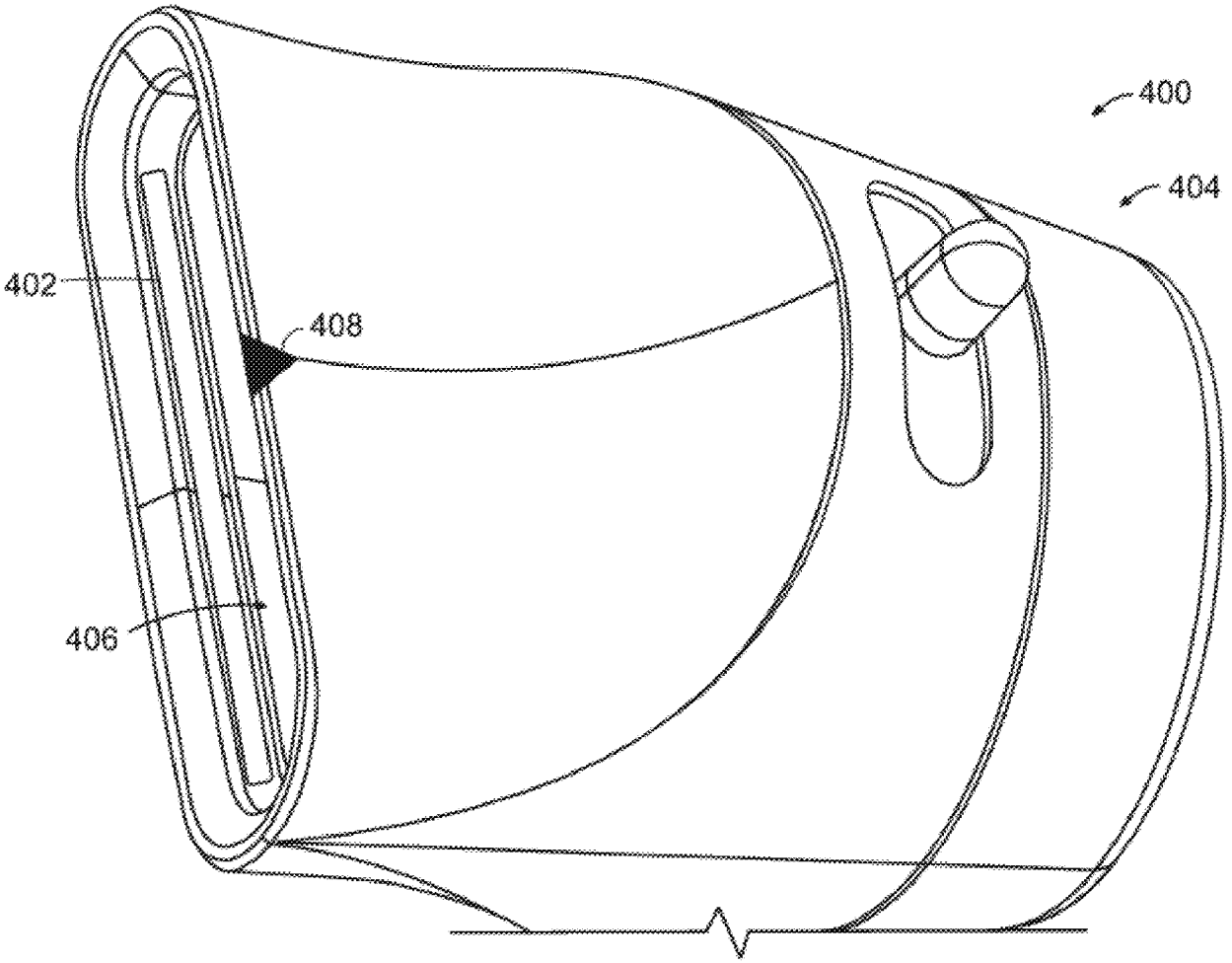
FIG. 16 is a perspective view of an exemplary embodiment of a concentrator attachment configured for use with the attachment coupling of FIG. 7.

Another exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein includes a concentrator attachment. One exemplary embodiment of a concentrator attachment 400 is shown in FIG. 16 and includes a heating element 402. The heating element 402 is configured to be communicatively coupled to electrical components of the hair care appliance to which the concentrator attachment 400 is attached via electrical connectors of the concentrator attachment's attachment coupling 404 (e.g., the attachment coupling 212 of FIGS. 7-10, or other attachment coupling) described herein. In this way, the heating element 402 is configured to provide additional heat to air flow output at an outlet 406 of the concentrator attachment 400 and in close proximity to the hair for improved styling effects.

In some embodiments, an attachment can include an ionizer therein. The ionizer can be positioned in the attachment to maximize the amount of ions received by the hair. The ionizer is configured to be communicatively coupled to electrical components of the hair care appliance to which the attachment is attached via electrical connectors of the attachment's attachment coupling described herein. As shown in FIG. 16, the illustrated embodiment of the concentrator attachment 400 includes an ionizer 408 positioned within the outlet 406.

Figure 17:
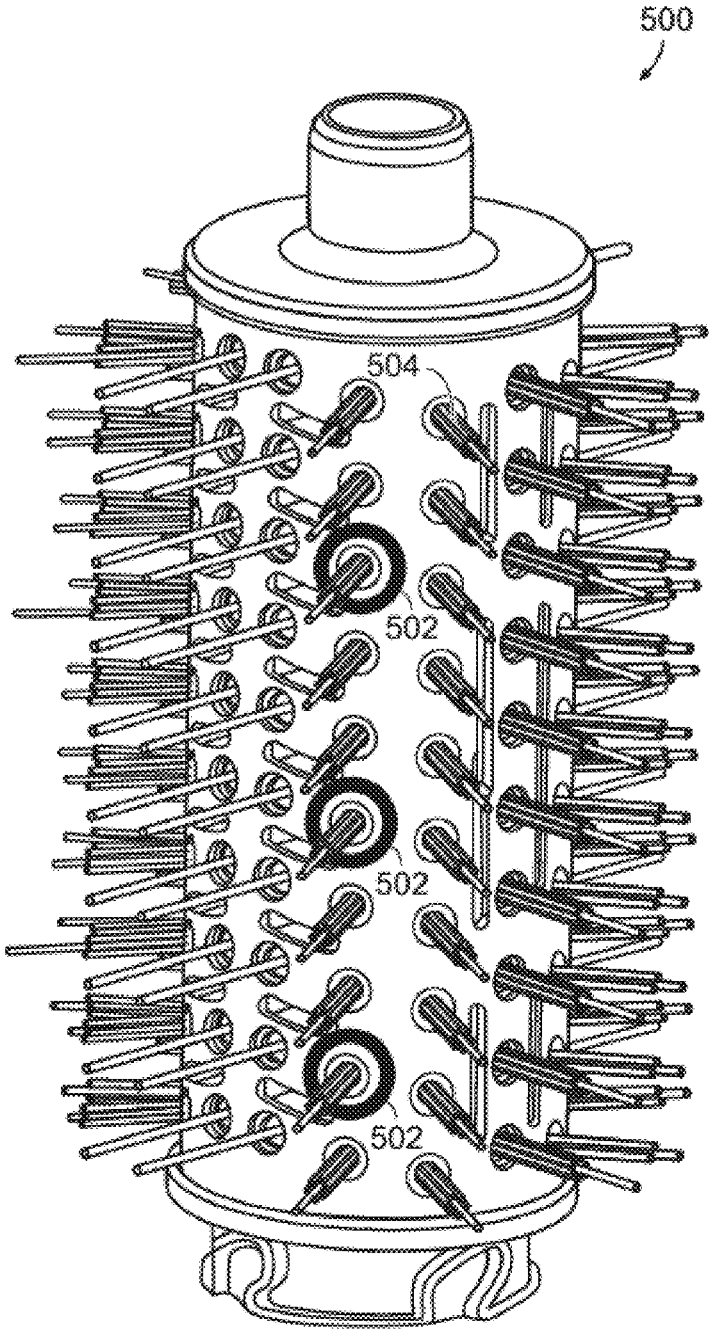
FIG. 17 is a perspective view of an exemplary embodiment of a brush attachment configured for use with the attachment coupling of FIG. 7.

In some embodiments, an attachment can include one or more torque sensors therein. The torque sensors can be configured with respect to bristles, such as bristles 504 of a brush attachment 500, as shown in FIG. 17. The brush attachment 500 is another exemplary embodiment of an attachment configured for use with a hair care appliance (e.g., the hair care appliance 100 of FIGS. 1-5, the hair care appliance 200 of FIGS. 6-10, or other hair care appliance) and an attachment mating assembly (e.g., the attachment mating assembly 202 of FIG. 7, or other attachment mating assembly) described herein. The torque sensors (e.g., torque sensors 502 of the brush attachment 500, or other torque sensors of another attachment) are configured to be coupled to electrical components of a hair care appliance to which an attachment including the torque sensors is attached via electrical connectors of the attachment's attachment coupling described herein. The torque sensors are configured to generate sensor data associated with an amount of torque applied to at least one bristle or group of bristles as a user uses the attachment, e.g., brushes hair using the brush attachment 500. The amount of torque is associated with a condition of the hair and an operating parameter of the hair care appliance can thus be determined. For example, the torque sensor data can be used to determine whether the user has dry or tangled hair based on elevated torque values indicating more force is required to brush the dry or tangled hair. Lower torque values are associated with wet, oily, or fine hair indicating less force is required to brush the hair. The hair care appliance to which the attachment is attached as described herein can be configured to adjust one or more of a heating temperature or an air flow setting based on the sensed torque data.

Styling hair can require specific skills and hair treatments to achieve a desired style. Some users may lack particular skill necessary to utilize a hair care appliance to achieve their desired style. Thus, it can be desirable for a hair care appliance and/or attachment to provide user feedback and/or automated styling assistance. For example, Coanda curling is a particular method of curling hair that can be difficult to master. A user is required to use a curling attachment, e.g., the curling attachment 204 of FIG. 6, the curling attachment 300 of FIG. 11, or other curling attachment, that automatically wraps hair around a curler by creating an airflow that pulls hair into place around the heated plates of the curling attachment. After the hair is wrapped around a body of a curling attachment, the user then heats the hair for a set period of time, before cooling the hair for a set period of time to implement the curl in the hair. A user may not know where to contact the hair on the attachment, have difficulty performing the styling for the required time periods or lose track of time, or have difficulty performing the styling while looking at their reflection in a mirror.

The hair care appliance and powered attachments described herein can remedy these problems by acquiring data about the user's hair and providing feedback to the user as they style their hair. The feedback can ensure best practices associated with a particular styling technique, are communicated to the user. The feedback can be provided via visual, audio, and/or haptic feedback mechanisms provided in the powered attachments described herein. The electrical coupling enabled between attachments and the hair care appliance herein can provide a robust array of feedback and operation modes to improve a user's experience and produce improved, long-lasting styling effects.

Figure 18:
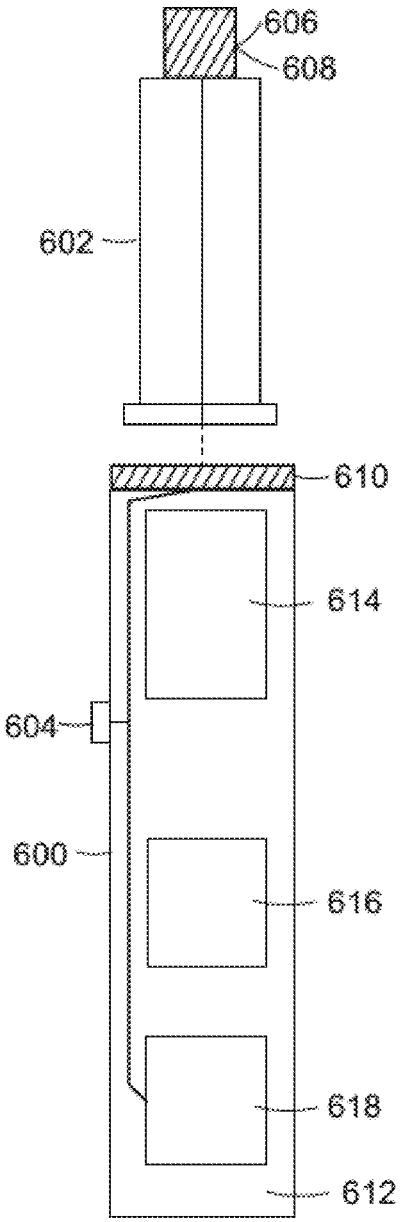
FIG. 18 is a diagram illustrating a power and data architecture of the hair care appliance of FIG. 6 used in a manual mode of operation.

For example, in one embodiment shown in FIG. 18, a user can operate a hair care appliance 600 (e.g., the hair care appliance 100 of FIGS. 1-5, the hair care appliance 200 of FIGS. 6-10, or other hair care appliance) and a powered curling attachment 602 (e.g., the curling attachment 204 of FIG. 6, the curling attachment 300 of FIG. 11, or other curling attachment) as described herein in a manual mode of operation. As shown in FIG. 18, a user can activate a manual actuator 604 (shown as a switch in this illustrated embodiment) of the hair care appliance 600, with the appliance 600 attached to the powered curling attachment 602, to initiate a timed program for curling hair. The switch 604 is configured to be communicatively coupled via electrical connectors of the curling attachment's attachment coupling to the curling attachment 602, which can include user interfaces such as an LED 606 and an audio output 608 as shown in this illustrated embodiment. The switch 604 is further configured to be communicatively coupled to electrical components of the hair care appliance 600, which can include user interfaces (e.g., an LED 610 and an audio output 612) as shown in this illustrated embodiment, heaters 614, a motor 616, a microprocessor and/or controller 618 coupled to a memory storing non-transitory computer-executable instructions associated with one or more operating parameters and/or modes of operation of the hair care appliance 600 (e.g., "software control").

Activating the manual switch 604 is configured turn on the hair care appliance 600, and a user can wrap their hair around the curling attachment 602 attached to the hair care appliance 600. A user can then manually actuate a timing actuator, e.g., press a timing starter of the hair appliance's user interface, to initiate a sequence of operational modes necessary to perform the curling. The software control is configured to generate control signals provided to various electrical components in the attachment 602 and the hair care appliance 600, such as the user interfaces 606, 608, 610, 612, heaters 614, or motor 616. The control signals are configured to initiate pre-determined timing cycles necessary to curl the hair. The control signals are further configured to cause one or more of the user interfaces 606, 608, 610, 612 to provide feedback to the user indicating a point at which the user should manually switch to the next stage of curling.

Figure 19:
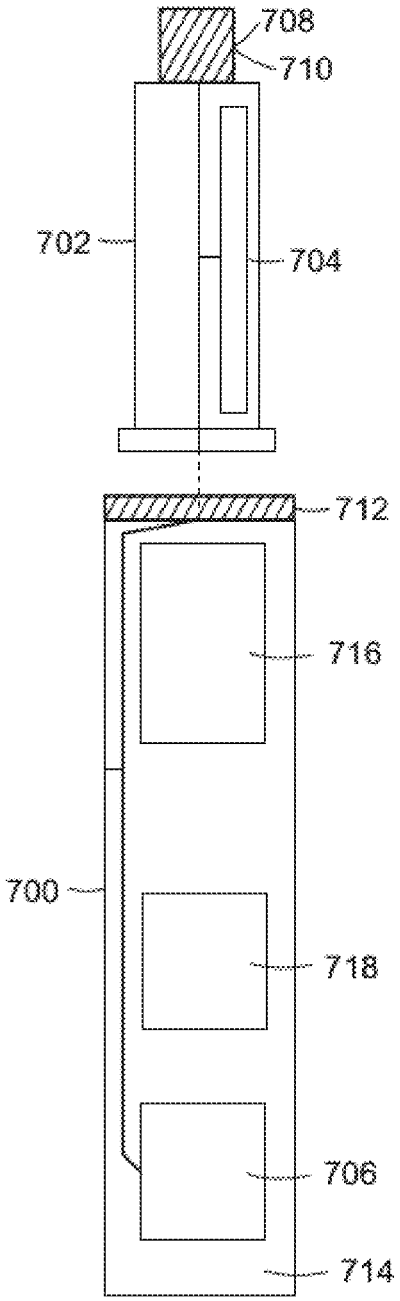
FIG. 19 is a diagram illustrating a power and data architecture of the hair care appliance of FIG. 6 used in a semi-automated mode of operation.

In some embodiments, a curling attachment is configured to provide sensor data from a moisture sensor of the curling attachment to control operation of the attachment and a hair care appliance to which the attachment is attached via software control of the hair care appliance. For example, as shown in FIG. 19, a user can turn on a hair care appliance 700 (e.g., the hair care appliance 100 of FIGS. 1-5, the hair care appliance 200 of FIGS. 6-10, or other hair care appliance) and wrap their hair around a curling attachment 702 attached to the hair care appliance 700. Moisture data determined from a moisture sensor 704 of the curling attachment 702 is configured to be used by software control 706 of the appliance 700 to determine requirements for styling the moist hair. Based on detecting the moist hair wrapped around the curling attachment 702, the software control 706 is configured to initiate a timing program cycling through pre-determined timing cycles. The software control 706 is configured to generate control signals provided to various electrical components in the attachment 702 and the hair care appliance 700, such as the user interfaces (e.g., an LED 708 of the attachment 702, an audio output 710 of the attachment 702, an LED 712 of the appliance 700, an audio output 714 of the appliance 700, etc.), sensors (e.g., moisture sensor 704, etc.), heaters 716, or motor 718. The control signals are configured to initiate pre-determined timing cycles necessary to curl the hair based on the moisture data obtained via the moisture sensor 704. The control signals are further configured to cause one or more of the hair care appliance's and/or attachment's user interfaces to provide feedback to the user indicating a point at which the user should manually switch to the next stage of curling.

Figure 20:
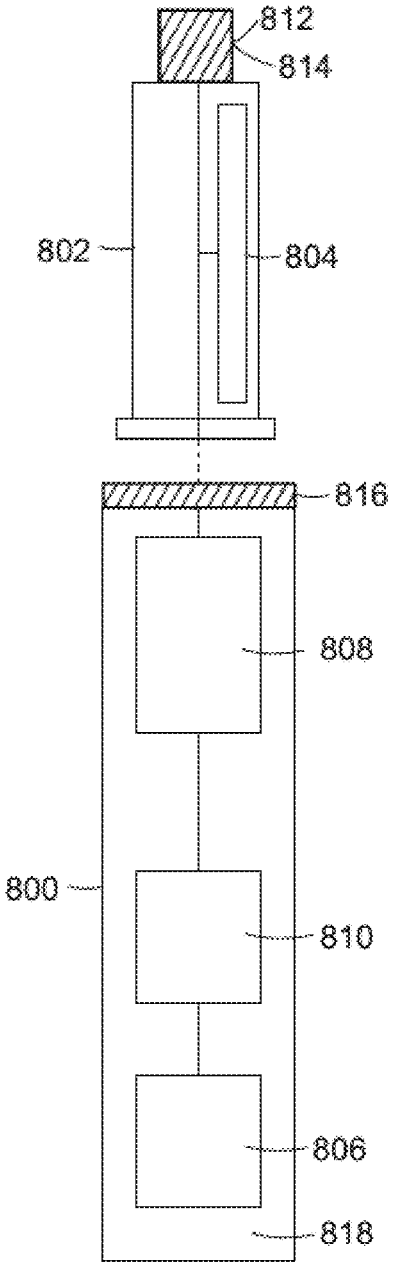
FIG. 20 is a diagram illustrating a power and data architecture of the hair care appliance of FIG. 6 used in a fully-automated mode of operation.

In some embodiments, a hair care appliance (e.g., the hair care appliance 100 of FIGS. 1-5, the hair care appliance 200 of FIGS. 6-10, or other hair care appliance) and powered attachments (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) attachable to the appliance are configured to provide fully automated monitoring and control of operational modes of the hair care appliance and/or attachments. For example, as shown in one embodiment in FIG. 20, a user can turn on a hair care appliance 800 (e.g., the hair care appliance 100 of FIGS. 1-5, the hair care appliance 200 of FIGS. 6-10, or other hair care appliance) and wrap their hair around a curling attachment 802 releasably attached to the appliance 800. Moisture data determined from a moisture sensor 804 of the curling attachment 802 is configured to be used (e.g., by software control 806 of the appliance 800) to determine requirements for styling the moist hair. Based on detecting the moist hair wrapped around the curling attachment 802, the software control 806 is configured to initiate a gradually progressive heating program. When the moisture data indicates a predetermined level of moisture, the software control 806 is configured to generate control signals to cause a heater 808 and a motor 810 of the hair care appliance 800 to generate a short blast of hotter air for a predetermined period. Continuing to sense the moist hair, the software control 806 is configured to cause the heater 808 and the motor 810 to generate cool air for a subsequent predetermined period of time. Responsive to sensing the appropriate moisture level and completion of previous predetermined periods of treatment, the software control 806 is configured to cause the hair care appliance 800 to shut off. FIG. 20 also shows an LED 812 of the attachment 802, an audio output 814 of the attachment 802, an LED 816 of the appliance 800, and an audio output 818 of the appliance 800 configured to provide information to the user, as discussed herein.

Figure 21:
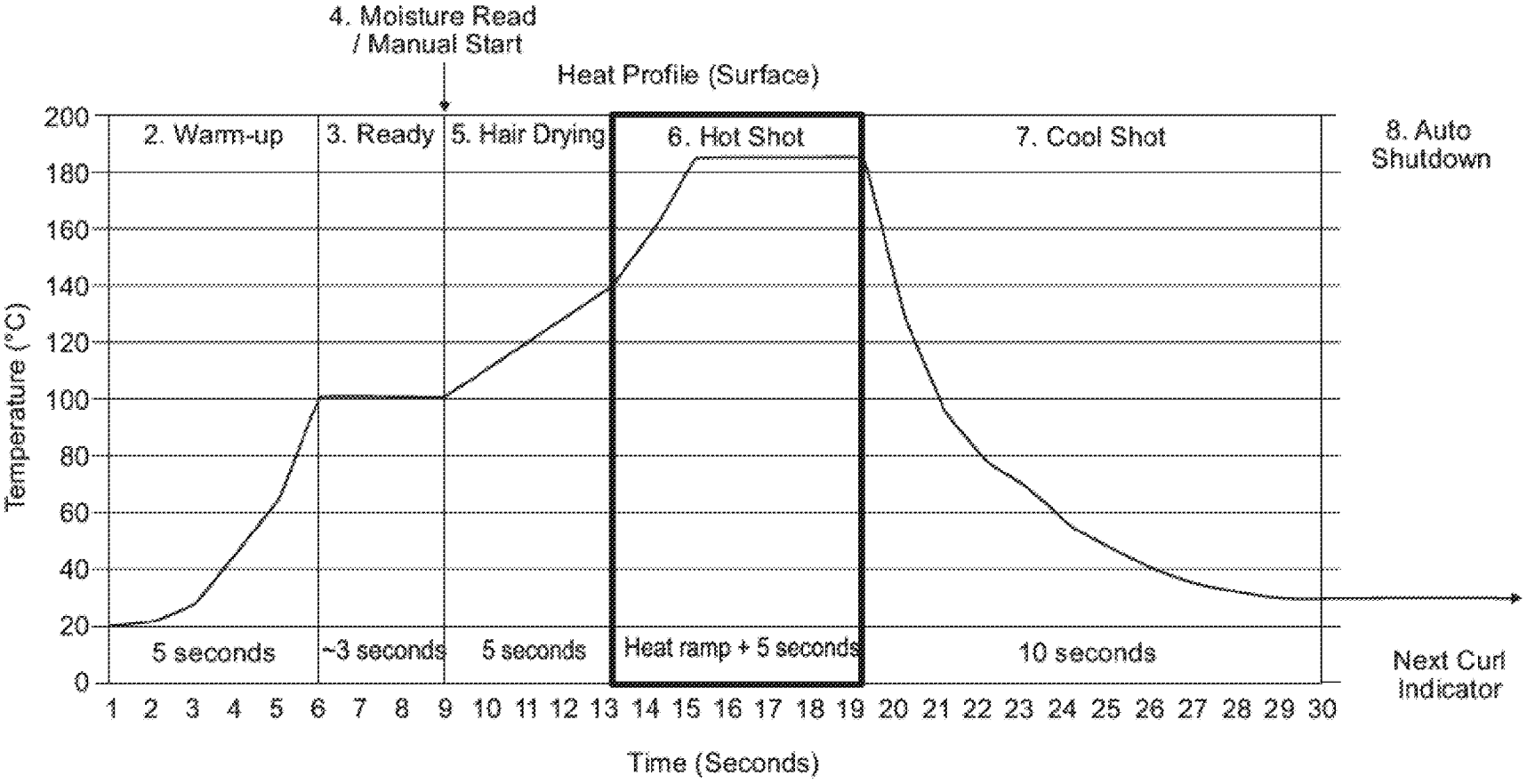
FIG. 21 is a plot illustrating an exemplary embodiment of a sequence of predetermined cycles of operation performed by the hair care appliance of FIG. 6.

In some embodiments, a hair care appliance (e.g., the hair care appliance 100 of FIGS. 1-5, the hair care appliance 200 of FIGS. 6-10, or other hair care appliance) and powered attachments (e.g., the attachment 204 of FIG. 6, the attachment 300 of FIG. 11, the attachment 400 of FIG. 16, the attachment 500 of FIG. 17, the attachment 602 of FIG. 18, the attachment 702 of FIG. 19, or other attachment) described herein is configured to perform pre-determined timing cycles associated a variety of styling methods and/or attachment usage. For example, as shown in FIG. 21, one embodiment of a plot of temperature settings and corresponding timing is provided that can be executed by software control configured in a hair care appliance (e.g., the hair care appliance 100 of FIGS. 1-5, the hair care appliance 200 of FIGS. 6-10, or other hair care appliance) in regard to curling hair via a curling attachment (e.g., the curling attachment 204 of FIG. 6, the curling attachment 300 of FIG. 11, the curling attachment 602 of FIG. 18, the curling attachment 702 of FIG. 19, or other curling attachment). An initial stage 1 can be assumed to correspond to the hair care appliance being shut off. Responsive to a user activating a switch of the hair care appliance, stage 2 "Warm-up" starts and last for about 5 seconds. During stage 2, the temperature of the heating element in the frame of the attachment, which is attached to the hair care appliance, initiates heating to cause heated plates of the attachment to heat to about 100° C. A first feedback indication associated with stage 2 can be provided to the user via a user interface of the attachment and/or the hair care appliance. In some embodiments, the first feedback indication includes a first color (e.g., of a light, etc.), a first sound, or the like.

Following stage 2, the hair care appliance enters stage 3 associated with a "Ready" stage in which the heated plates of the attachment are about 100° C. A second feedback indication can be provided to the user via a user interface of the attachment and/or the hair care appliance. In some embodiments, the second feedback indication can include a second color (e.g., of a light, etc.), a second sound, or the like that is different than the first feedback indication.

Responsive to manual activation or sensed moisture data obtained from hair wrapped around the attachment by a moisture sensor of the attachment at point 4, stage 5 commences for drying hair. During the "hair drying" stage 5, the heater of the attachment causes the heated plates of the attachment to heat to about 140° C. for a period of about 5 seconds to dry the moist hair. Also during this stage, the motor is activated to generate heated air flow via the heating element of the hair care appliance. The generated heated air flow is provided through the outlets of the attachment for drying the hair. A third feedback indication can be provided to the user via a user interface of the attachment and/or the hair care appliance. In some embodiments, the third feedback indication can include a third color (e.g., of a light, etc.), a third sound, or the like that is different than the first feedback indication and the second feedback indication.

Following stage 5, the hair care appliance enters stage 6, associated with provision of a "Hot Shot" volume of heated air for about 5-10 seconds. The heater of the attachment causes the heated plates to heat from about 140° C. to about 185° C., and the motor is activated to increase the velocity of the air heated via a heating element of the hair care appliance. A fourth feedback indication can be provided to the user via a user interface of the attachment and/or the hair care appliance. In some embodiments, the fourth feedback indication can include a fourth color (e.g., of a light, etc.), a fourth sound, or the like that is different than the first feedback indication, the second feedback indication, and the third feedback indication.

After completion of stage 6, a "Cool Shot" stage 7 is started. During stage 7, a volume of lower temperature air is provided for a period of about 10 seconds to set the curl. During this stage, the heater of the attachment is powered off so that the temperature of the heated plates drops from about 185° C. to about 30° C. In addition, the motor is activated to provide a volume of air at a reduced or ambient temperature via the heating element of the hair care appliance. A fifth feedback indication can be provided to the user via a user interface of the attachment and/or the hair care appliance. In some embodiments, the fifth feedback indication can include a fifth color (e.g., of a light, etc.), a fifth sound, or the like that is different than the first feedback indication, the second feedback indication, the third feedback indication, and the fourth feedback indication.

Following stage 7, the hair care appliance is configured to automatically shut down or otherwise enter a stand-by mode awaiting a next usage or input from a user as shown in stage 8 "Auto Shutdown". A sixth feedback indication can be provided to the user via a user interface of the attachment and/or the hair care appliance. In some embodiments, the sixth feedback indication can include a sixth color (e.g., of a light, etc.), a sixth sound, or the like that is different than the first feedback indication, the second feedback indication, the third feedback indication, the fourth feedback indication, and the fifth feedback indication. One of skill in the art will appreciate that the times and temperatures shown in FIG. 21 are exemplary and the software controls can be configured to implement a variety of temperature and air flow settings for any time periods in various sequences without limit. Thus, a variety of specific styling methods can be performed using the hair care appliance and the powered attachments described herein, which can improve the overall user experience of the appliance and create longer-lasting styling results.

In some embodiments, the hair care accessories described herein can facilitate heating, brushing, and/or straightening of hair. Advantageously, the hair care accessories can facilitate increased shine and/or decreased frizz in the user's hair. For example, FIGS. 22A-22E illustrate one exemplary embodiment of a hair care accessory comprising a brush accessory 1000. The brush accessory 1000 can include an attachment coupling 1010 positioned at a proximal end of a body 1002. The attachment coupling 1010, which can be referred to as an attachment collar, can be configured to receive and/or couple to a hair care appliance (not shown). The hair care appliance can provide air flow to the brush accessory 1000 using one or more fans positioned within the hair care appliance. Furthermore, the hair care appliance can heat up the air via one or more heating elements positioned within and/or adjacent a fluid flow path through the hair care appliance. The air provided by the hair care appliance can flow into the brush accessory 1000, via the attachment coupling 1010, in a direction indicated by the arrow in FIG. 22B. Additionally, the hair care appliance can provide an electrical signal to the brush accessory 1000 to facilitate heating up one or more elements thereof.

The body 1002 can be hollow to facilitate airflow therethrough. For example, the body 1002 can be formed with a rounded sidewall, referred to herein as a barrel, and with a lumen inside of the body 1002 extending from the proximal end to the distal end thereof. The brush accessory 1000 can include a cap 1020 positioned at the distal end of the body 1002. The cap 1020 can be configured to prevent air from flowing through the distal end of the body 1002 by forming an airtight seal therewith. For example, the cap 1020 can be securely coupled to the body 1002 via one or more adhesives, fasteners, or combination thereof. The cap 1020 can include a knob 1022 extending therefrom. The knob 1022 can be configured to be handled by a user. For example, the knob 1022 can be fixed in place relative to the body 1002, such that the user can rotate the entire brush accessory 1000 by twisting the knob 1022. In some variations, the knob 1022 can include one or more buttons (not shown). For example, the one or more buttons can be configured to release the brush accessory 1000 from a hair care appliance.

The body 1002 of the brush accessory 1000 can include a drying region 1014 and a heating region 1016. The drying region 1014 can be configured for brushing and/or drying hair, and the heating region 1016 can be configured for heating hair. In some embodiments, the drying region 1014 and the heating region 1016 can be joined together and positioned to enhance the ease of use for a user styling hair. For example, a user can style hair using either the drying region 1014 or the heating region 1016 merely by rotating the hair care appliance along a longitudinal axis extending through a length of the brush accessory 1000. This arrangement requires minimal manipulation of the brush accessory 1000 as the user switches between drying hair and heating hair. As a result, the brush accessory 1000 can provide faster styling of hair without requiring the need for separate devices to dry hair and heat hair.

Figure 22A:
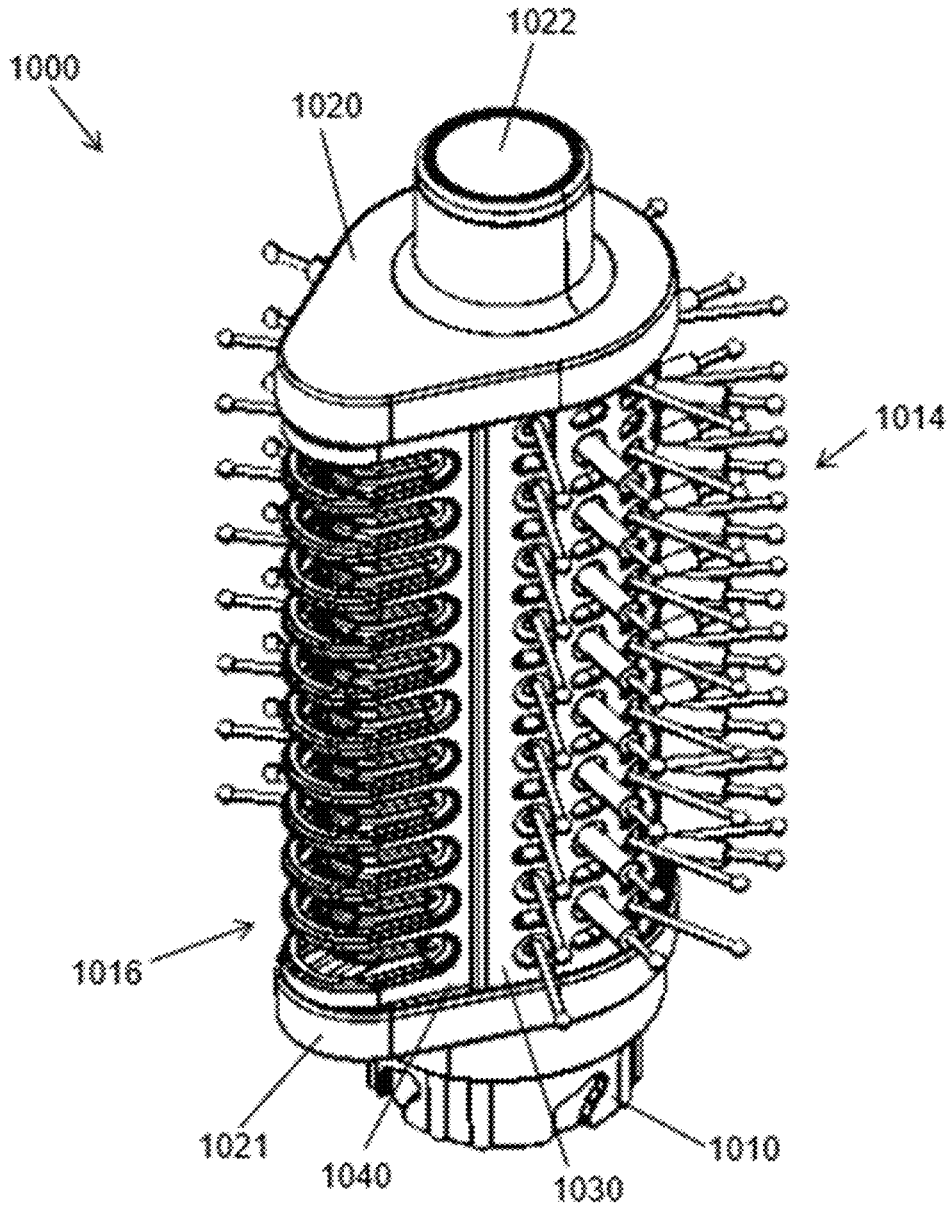
FIG. 22A is a perspective view of an exemplary embodiment of a brush accessory for use with a hair care appliance.
Figure 22B:
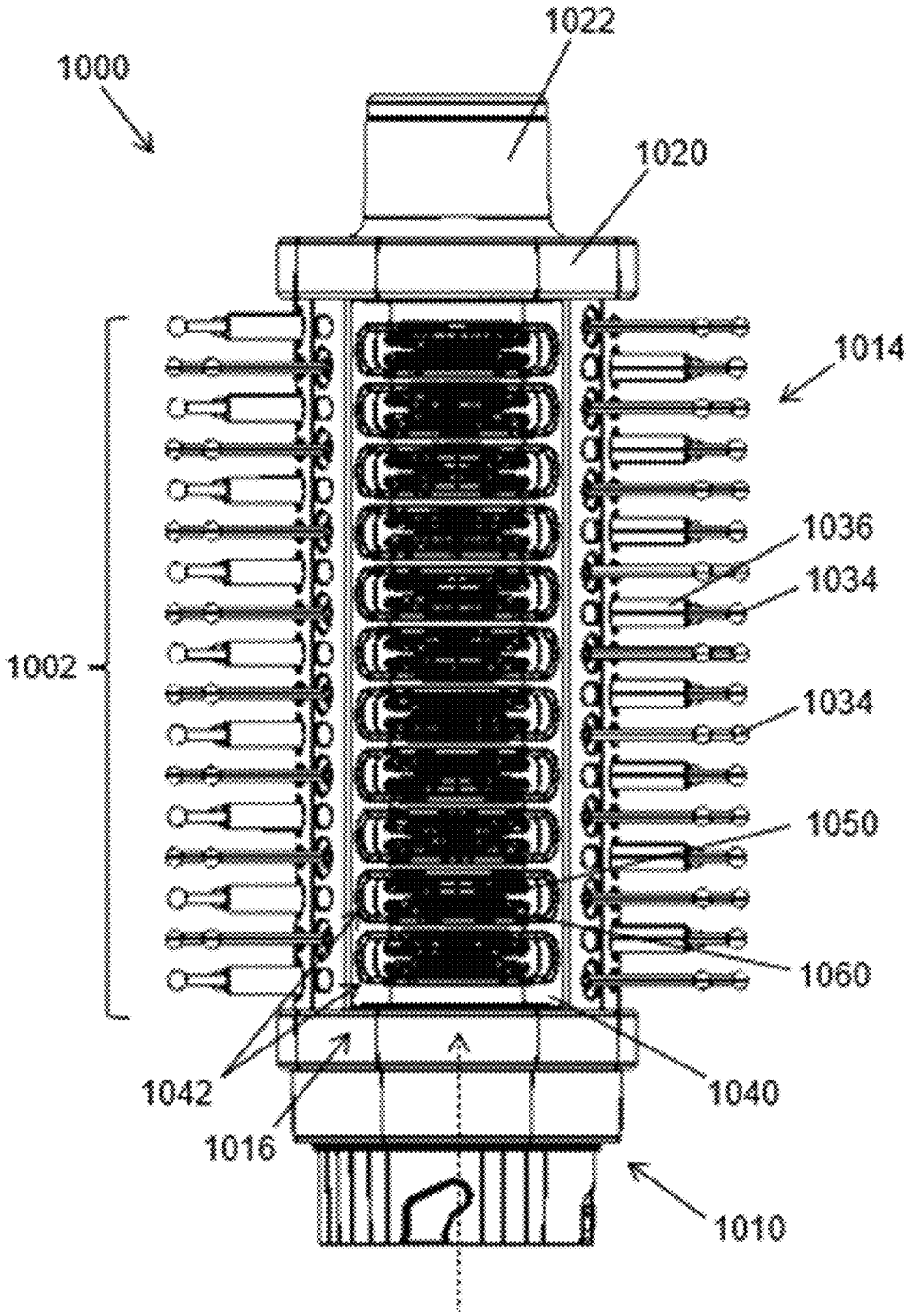
FIG. 22B is a front view of the brush accessory of FIG. 22A.
Figure 22C:
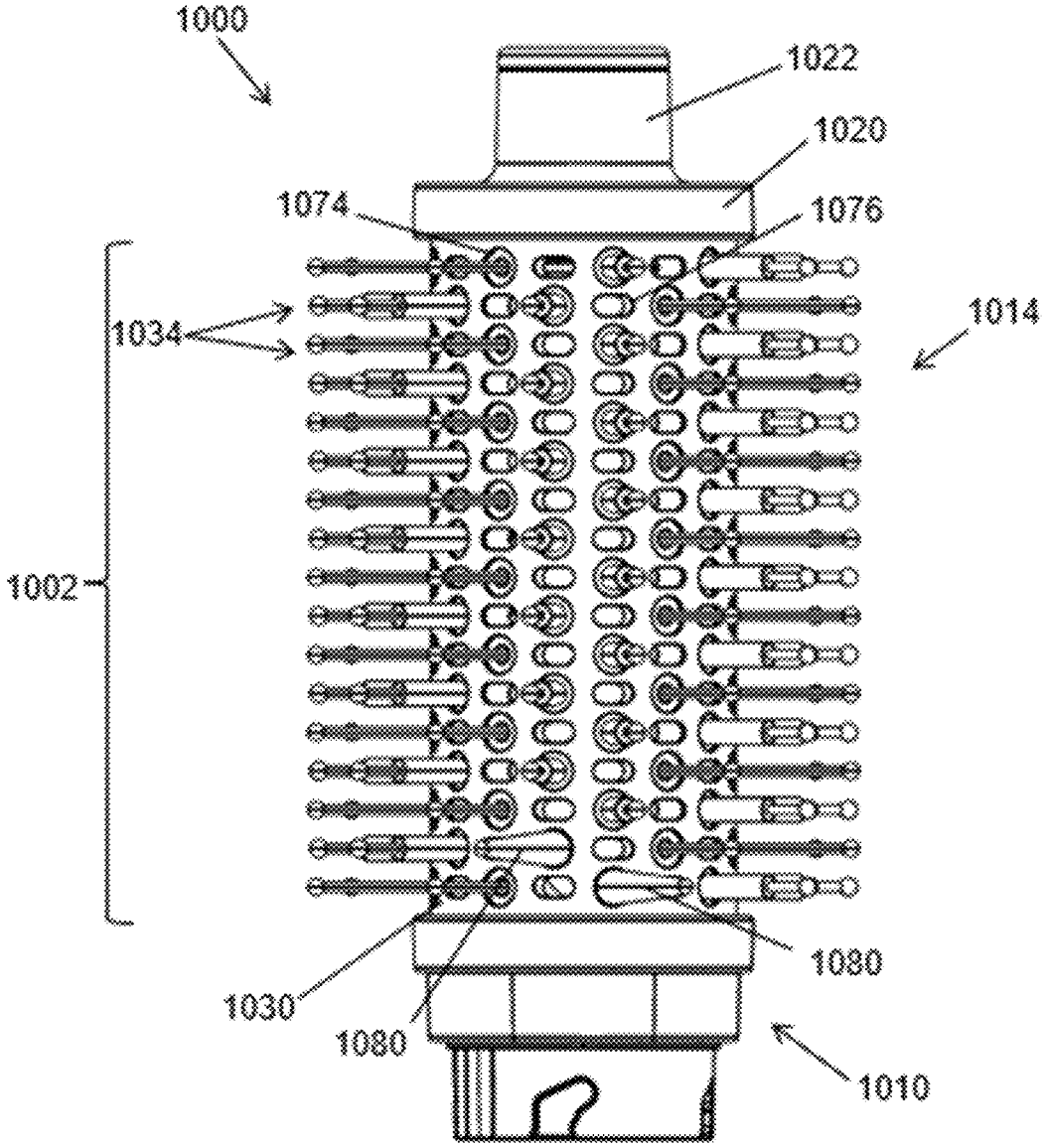
FIG. 22C is a rear view of the brush accessory of FIG. 22A.
Figure 22D:
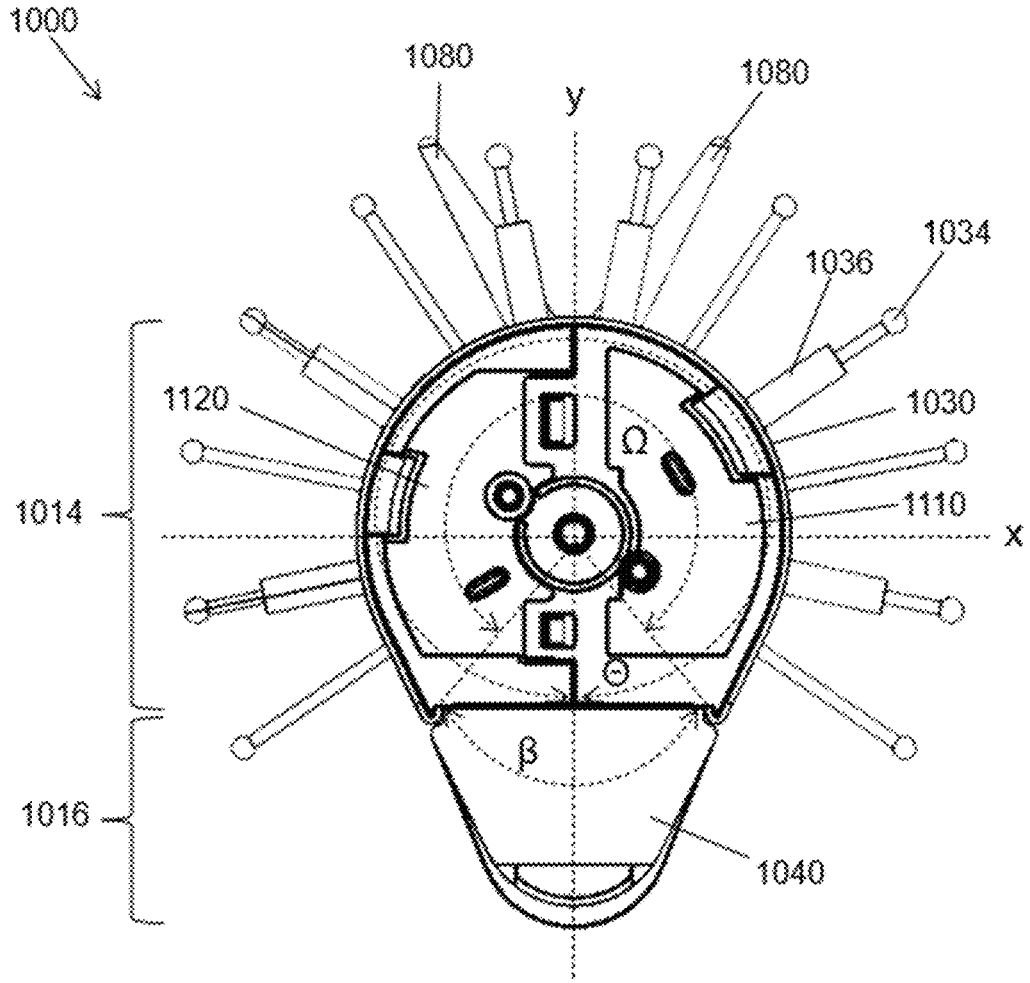
FIG. 22D is a cross-sectional view of the brush accessory of FIG. 22A.

As shown in FIG. 22D, the shape of the body 1002 can be defined by each of the drying region 1014 and the heating region 1016. In some embodiments, the drying region 1014 and the heating region 1016 can have different cross-sectional shapes. For example, in the exemplary embodiment illustrated, the drying region 1014 can have a generally circular cross-sectional shape, while the heating region 1016 can have a generally triangular cross-sectional shape. The circular cross-sectional shape of the drying region 1014 can facilitate smooth engagement with hair during use by a user. Meanwhile, the triangular cross-sectional shape of the heating region 1016 can facilitate close contact between the heating elements of the heating region 1016 and the roots of the user's hair. One or more corners of the triangular shape of the heating region 1016 can be rounded. Advantageously, the triangular shape and associated rounded corners of the heating region 1016 can avoid risks associated with sharp edges, such as damaging, cutting, or otherwise injuring a user's hair during use of the brush accessory 1000. Taken together, the cross-sectional shape of the body 1002 can correspond to a pear, a tear drop, a parabola, or a combination thereof, as shown in FIG. 22D.

The drying region 1014 and the heating region 1016 can be sized relative to each other according to an optimized ratio. For example, as shown in FIG. 22D, the circular cross-sectional shape of the drying region 1014 can have an arc length Θ and an arc length Q, and the heating region 1016 has an arc length 3. The arc length Θ corresponds to a circumference of the circular cross-sectional shape of the drying region 1014. The arc length Θ can be between about 50 mm and about 150 mm, about 75 mm and about 150 mm, or about 130 mm and about 140 mm. In an exemplary variation, the arc length Θ is about 135.7 mm. The arc length Q corresponds to a portion (e.g., an external surface) of the circular cross-sectional shape of the drying region 1014 that can contact hair. The portion of the drying region 1014 corresponding to the arc length Q includes any bristles extending therefrom. The arc length Q can be between about 50 mm and about 150 mm, about 75 mm and about 150 mm, or about 100 mm and about 110 mm. In an exemplary variation, the arc length Q is about 106.5 mm. The arc length R corresponds to a length of the portion of the drying region 1014 that is joined with the heating region 1016. Thus, the portion of the drying region 1014 to which the heating region 1016 is joined (e.g., attached, coupled) can not touch hair. The arc length R can be between about 10 mm and about 100 mm, about 15 mm and about 50 mm, or about 10 mm and about 30 mm. In an exemplary variation, the arc length R is about 22 mm. One or more ratios of the arc lengths can be used to characterize the size of the drying region 1014 and/or heating region 1016. For example, a first ratio of the arc length R to the arc length Θ can be between about 1:20 and about 10:20, about 2:20 and about 6:20, or about 3:20 and about 4:20. In an optimized variation, the first ratio of the arc length R to the arc length Θ is about 3:20. As another example, a second ratio of the arc length R to the arc length Q can be between about 1:20 and about 10:20, about 2:20 and about 6:20, or about 3:20 and about 4:20. In an optimized variation, the second ratio of the arc length R to the arc length Q is about 4:20. In this way, the drying region 1014 can extend along a greater length of the perimeter than the heating region 1016, which advantageously allows bristles of the drying region 1014 to engage a greater volume of hair. As a result, a greater amount of tension can be applied to the volume of hair as the hair is pulled through the heating region 1016 when styling. Furthermore, the optimized first and second ratios described herein advantageously corresponds to increased contact between hair and the heating region 1016, which corresponds to an increased amount of heat transferred to hair during a given pass of the brush accessory 1000 through hair when compared to devices with a lower ratio. Additionally, the optimized ratios described herein may not be so great that the efficacy of the drying region 1014 is diminished. Therefore, in some variations, the first and/or second ratios can be less than 5:20. Increasing the first and/or second ratios beyond 5:20 can reduce a total outlet area associated with the plurality of outlet openings of the drying region 1014, which can lead to a lower airflow volume therethrough and/or an increased dry time (i.e., time required for wet hair to become dry).

Additionally, the body 1002 can be symmetrical about one or more axes. For example, as also shown in FIG. 22D, the body 1002 is symmetrical about a y-axis. The symmetry of the body 1002 about the y-axis advantageously allows the user to operate the brush accessory 1000 with either hand, as the functionality of the brush accessory 1000 will be consistent when used in any orientation. Furthermore, the body 1002 can be asymmetric about the x-axis. The asymmetry of the body 1002 about the x-axis allows the user to selectively use the heating region 1016, the drying region 1014, or both.

The drying region 1014 can include at least one bristle configured to engage hair and at least one opening configured to provide air to hair. For example, as shown in FIG. 22D, the drying region 1014 can include a first bristle support 1110 and a second bristle support 1120 configured to support a plurality of bristles 1034. In some embodiments, the bristles 1034 can be made of nylon, although the material of the bristles 1034 is not limited thereto. A portion of the bristles 1034 can include a collar 1036 around a base of the bristle 1034. In some embodiments, the collar 1036 can include an animal-fur material, such as boars' hair. The collar 1036 can improve distribution of oil within the hair when brushing and can increase tension on the hair before directing hair into the heating regions 1016. The collar 1036 and the position of the portions of the bristles 1034 including the collar 1036 can improve grabbing, smoothing, and shining of hair when the hair is straightened via the heating regions 1016.

The bristles 1034 can be arranged in a pattern optimized for combing and detangling hair. For example, the bristles 1034 are shown in FIGS. 22A-22D as arranged in a series of rows. Each row can extend along a longitudinal axis of the body 1002, specifically from a first end of the body 1002 to a second end of the body 1002. Each of the rows can have bristles with or without collars. In the exemplary variation shown in FIGS. 22A-22D, the respective rows include bristles 1034 that all include collars 1036 adjacent to rows with bristles 1034 that do not include collars 1036. The number of rows having bristles 1034 with collars 1036 can be between 2 and 10 rows. In the embodiment shown in FIGS. 22A-22D, for example, the brush accessory 1000 includes 6 rows having bristles 1034 with collars 1036. Advantageously, the number of rows having bristles 1034 with collars 1036 can be optimized to provide ideal tension between the drying region 1014 and hair.

Figure 29B:
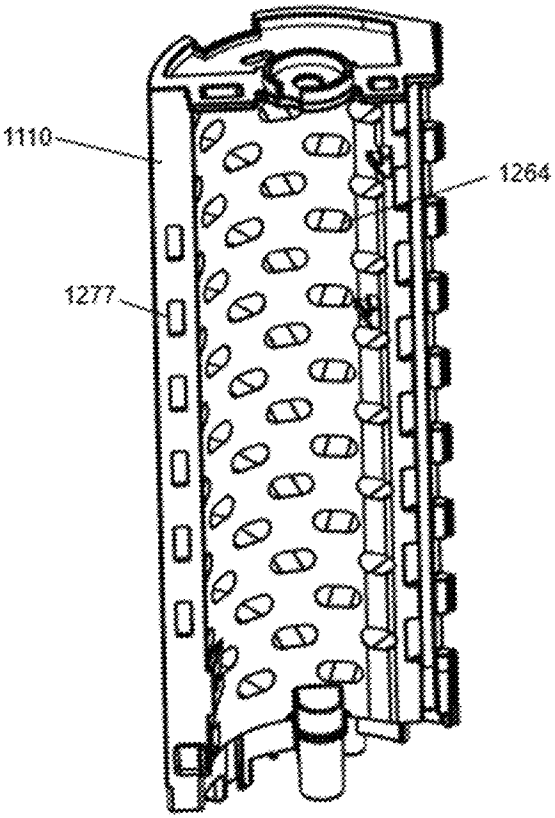
FIG. 29B is a rear perspective view of the first bristle support of FIG. 29A.
Figure 29A:
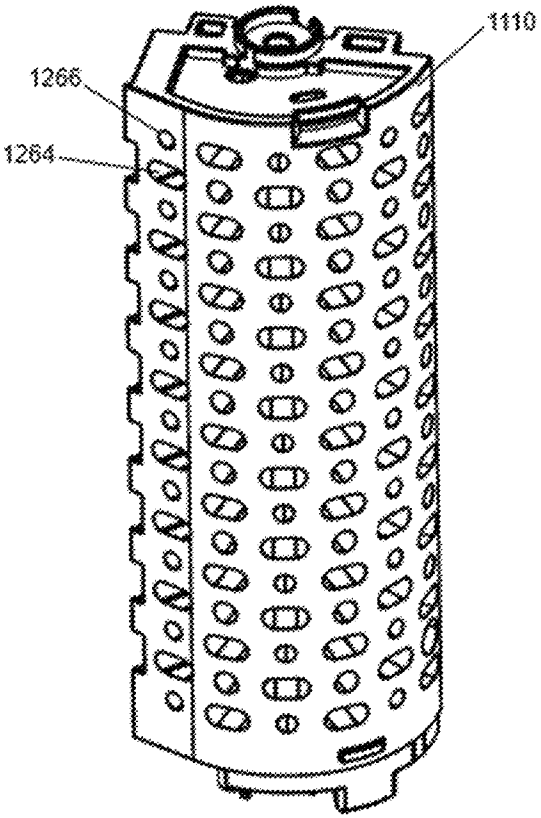
FIG. 29A is a front perspective view of a first bristle support of the brush accessory of FIG. 22A.

FIGS. 29A-29B further illustrate the first bristle support 1110. As shown, the first bristle support 1110 can be formed with a plurality of openings including, for example, a plurality of bristle openings 1266 and a plurality of support outlet openings 1264. The support outlet openings 1264 can be through-holes that form a part of a fluid flow path between the inner lumen of the body 1002 and an external environment to allow air to flow from within the body 1002 to the external environment. In contrast, the bristle openings 1266 can be configured to receive a bristle, such as the bristles 1034, and can include a surface to which the bristles 1034 can be attached. Therefore, according to the embodiments shown in FIGS. 29A-29B, the bristle openings 1266 do not extend through the entire sidewall of the first bristle support 1110.

Figure 30B:
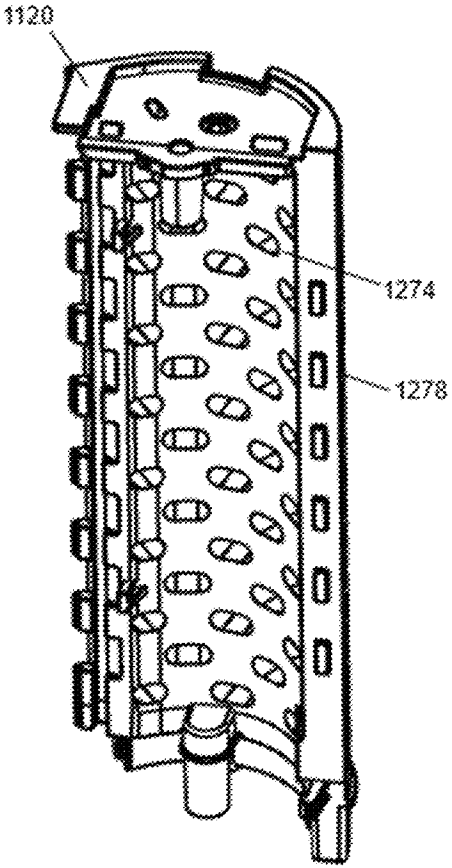
FIG. 30B is a rear perspective view of the second bristle support of FIG. 30A.
Figure 30A:
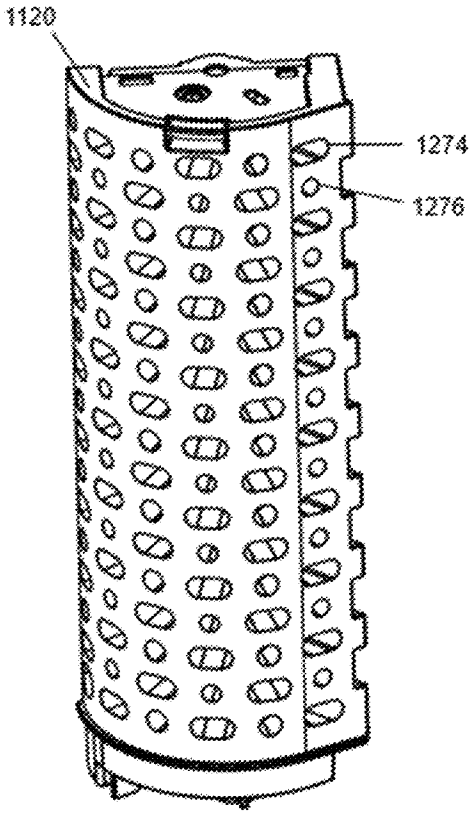
FIG. 30A is a front perspective view of a second bristle support of the brush accessory of FIG. 22A.

FIGS. 30A-30B further illustrate the second bristle support 1120. Similar to the first bristle support 1110, the second bristle support 1120 can be formed with a plurality of bristle openings 1276 and a plurality of support outlet openings 1274. The description of the bristle openings 1276 corresponds to the description of the bristle openings 1266, and the description of support outlet openings 1274 corresponds to the description of the support outlet openings 1264. Therefore, the first and second bristle supports 1110, 1120 together can form a portion of the drying region 1014. In one example, the first and second bristle supports 1110, 1120 can be connected with one another, such as via connectors 1277 of the first bristle support 1110 and connectors 1278 of the second bristle support 1120.

As shown in FIGS. 22C and 22D, the drying region 1014 can further include support elements 1080 that are positioned near the proximal end of the body 1002. The support elements 1080 can be configured to position the body 1002 at a distance from a surface on which the brush accessory 1000 can be placed when not in use to style hair. In particular, the support elements 1080 can prevent the bristles 1034 from contacting or pressing against the surface on which the brush accessory 1000 can be placed, and thus prevent deformation of the bristles 1034.

Figure 28:
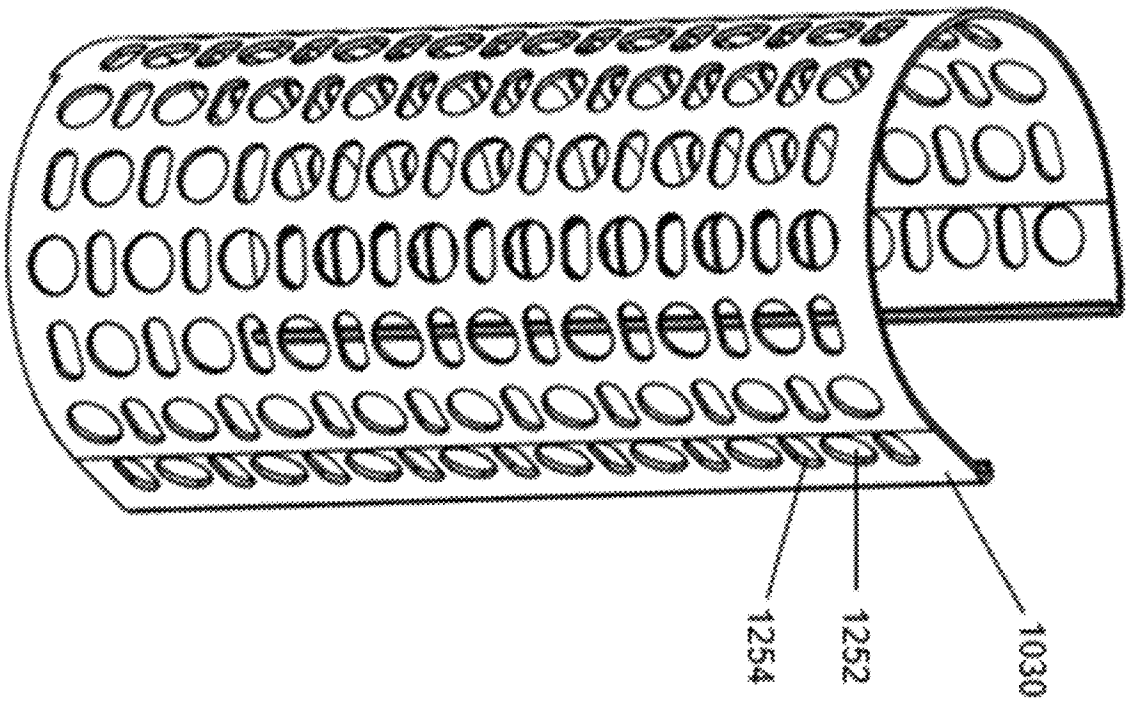
FIG. 28 is a perspective view of a bristle shell of the brush accessory of FIG. 22A.

The drying region 1014 can further include a bristle shell 1030. The bristle shell 1030 can be configured to cover at least a portion of each of the first and second bristle supports 1110, 1120. As shown in FIG. 28, the bristle shell 1030 can be formed with a plurality of openings, including, for example, bristle openings 1252 and outlet openings 1254. Each of the bristle openings 1252 can be configured to receive at least one bristle 1034. Conversely, each of the outlet openings 1254 can be configured to allow air to flow from within the body 1002 into the external environment by being aligned with one of the support outlet openings 1264, 1274. Therefore, air may flow through the attachment coupling 1010, into inner lumen of the hollow body 1002, through the support outlet openings 1264, 1274, and through the outlet openings 1254. In some variations, the air may or may not be heated.

Figure 23:
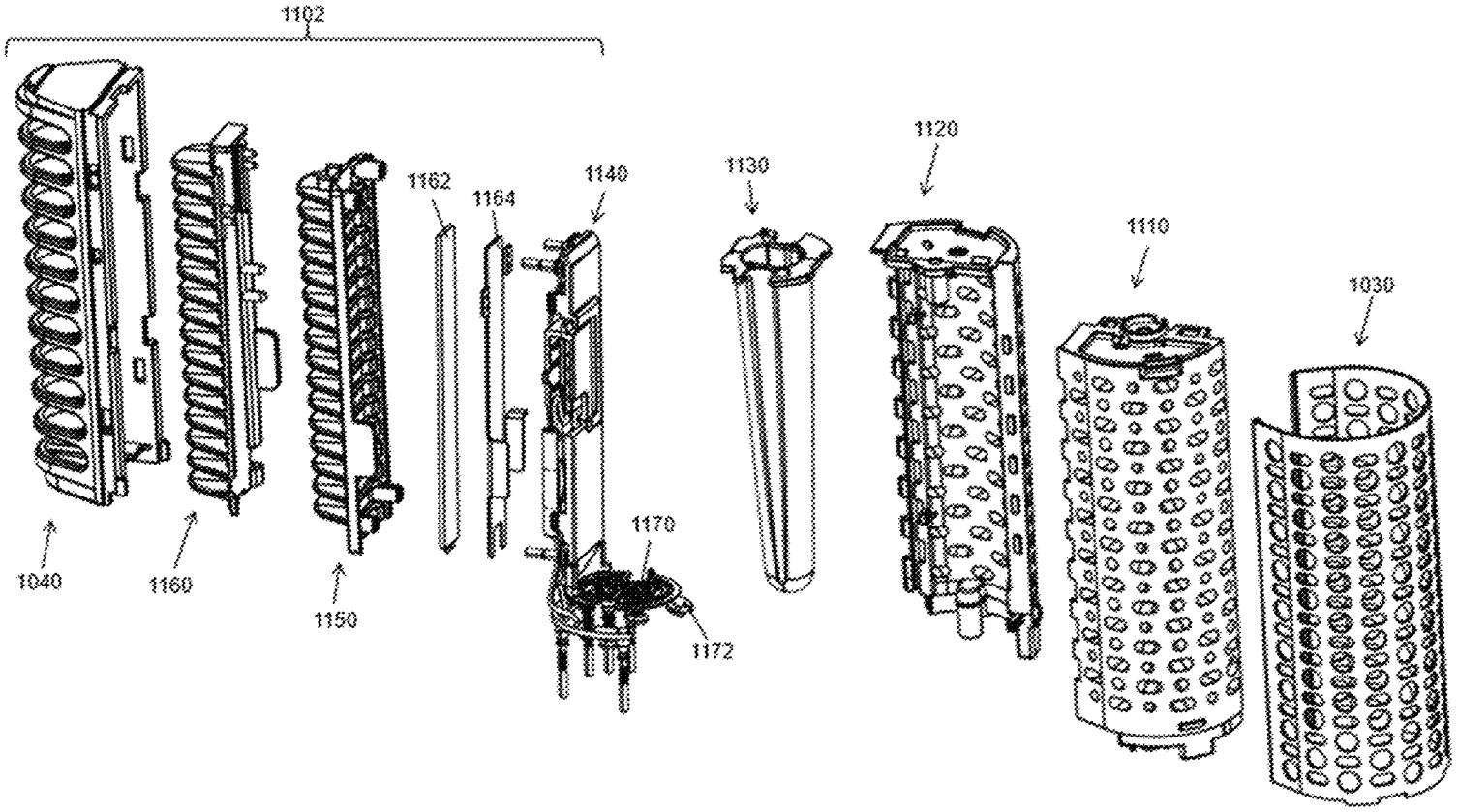
FIG. 23 is an exploded view of the brush accessory of FIG. 22A.

The heating region 1016 can include at least one heater assembly configured to heat hair. For example, as shown in FIGS. 22D and 23, the heating region 1016 can include a heater assembly 1102 with a heater shell 1040, a first tine support 1150, and a second tine support 1160. The heater shell 1040 can be configured to prevent a user from unintentionally touching a heated surface (e.g., the tine supports 1150, 1160). As shown in FIG. 2C, the heater shell 1040 can surround at least a portion of the tine supports 1150, 1160, defining a hollow interior within which at least the tine supports 1150, 1160 may be positioned. Furthermore, the heater shell 1040 can have a rounded shape with a plurality of shell openings 1042 and a tine support opening 1043. The shell openings 1042 can be configured to receive hair therethrough. The tine support opening 1043 can be configured to receive one or more tine supports, such as the tine supports 1150, 1160.

Figure 26C:
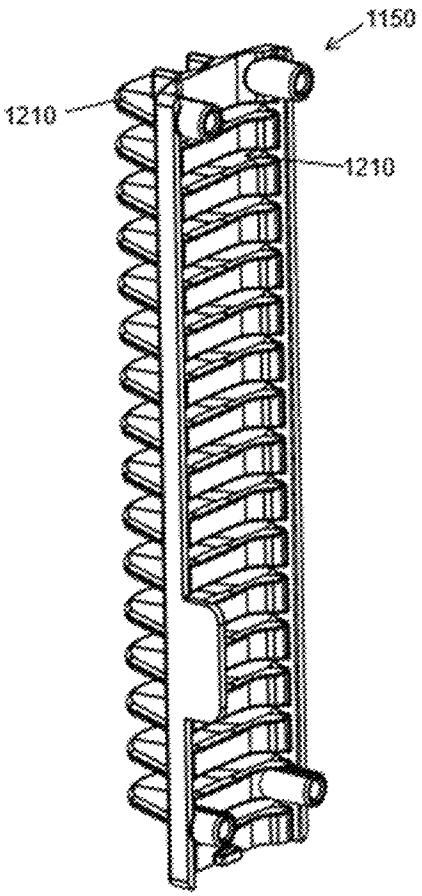
FIG. 26C is a rear perspective view of the first tine support of FIG. 26A.
Figure 26B:
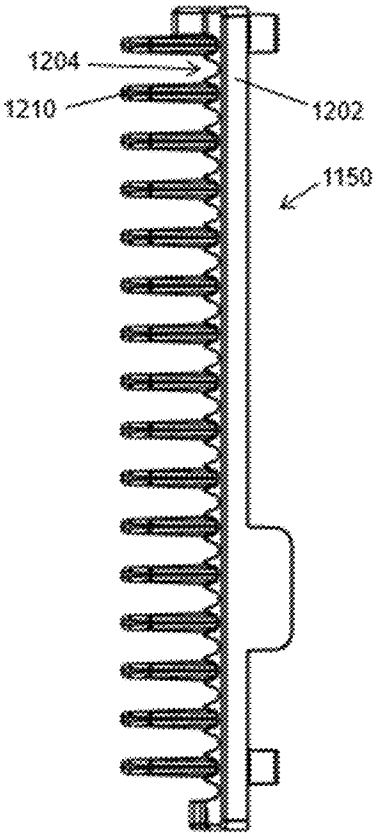
FIG. 26B is a side view of the first tine support of FIG. 26A.
Figure 26A:
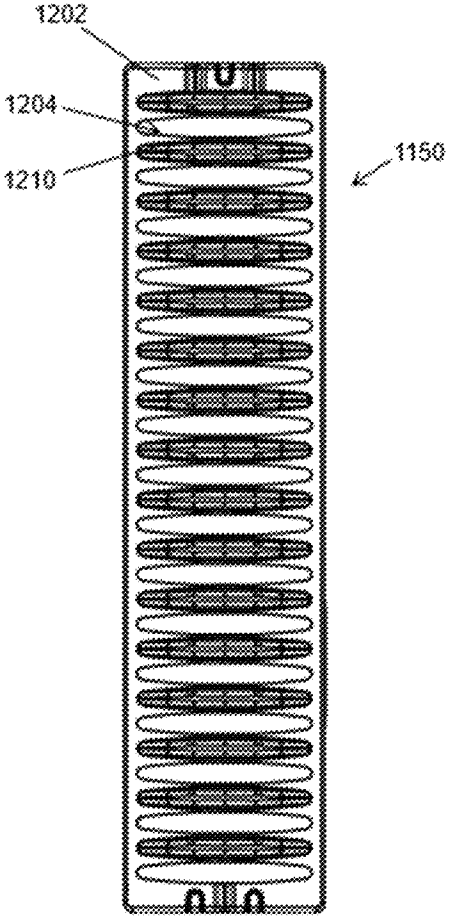
FIG. 26A is a front view of a first tine support of the heater assembly of FIG. 24A.

The first tine support 1150 can support a plurality of tines configured to transfer heat to hair, including, for example, tines 1210 that protrude from a first tine base 1202, as shown in FIGS. 26A-26C. The tines 1210 can be heated and transfer heat to any hair in contact therewith. Accordingly, the tines 1210 can be manufactured from a material with a relatively high heat transfer coefficient, such as a metal or a plastic. In some embodiments, each of the tines 1210 can include a ceramic coating or a tourmaline coating to aid heat distribution and retention. In some variations, the first tine support 1150 can include between 10 and 40 tines, including any value or sub-range therein. As shown in FIGS. 26A-26C, for example, the first tine support 1150 includes 16 tines. Each of the tines 1210 can have a top surface and a bottom surface. The top and bottom surfaces of the tines 1210 can be substantially smooth and flat, which advantageously prevents the tines 1210 from bending hair when in contact therewith. Furthermore, each tine 1210 can have a generally triangular cross-sectional shape, with one or more rounded corners configured to avoid poking, cutting, or otherwise injuring a user. The first tine base 1202 can further define tine openings 1204. For example, the tines 1210 and tine openings 1204 can be positioned in an alternating pattern, such that a tine opening 1204 is positioned between adjacent tines 1210. Each tine opening 1204 can be configured to receive a tine of a different tine support, as will be described below.

Figure 27C:
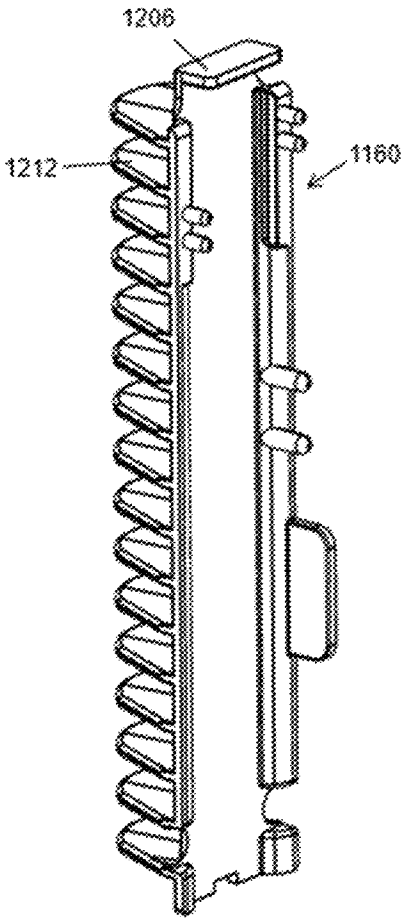
FIG. 27C is a rear perspective view of the second tine support of FIG. 27A.
Figure 27B:
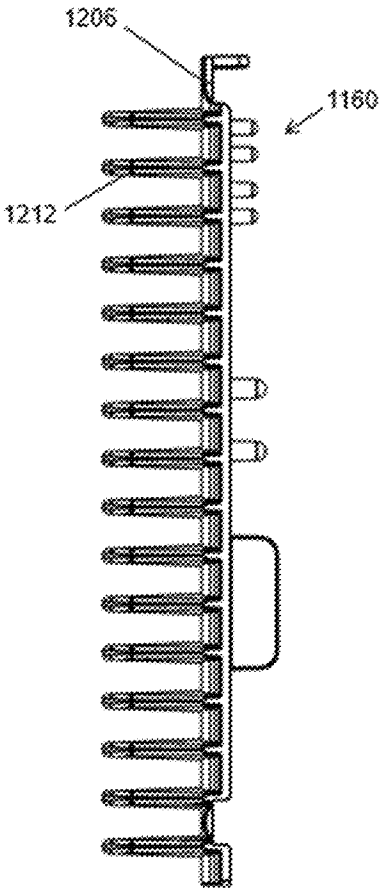
FIG. 27B is a side view of the second tine support of FIG. 27A.
Figure 27A:
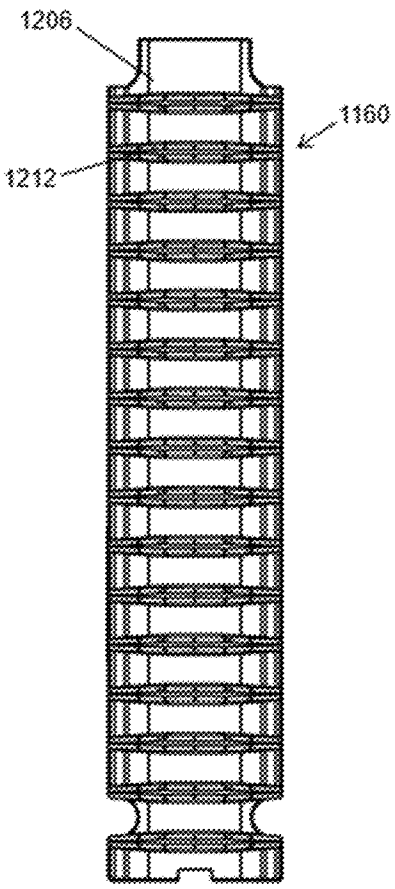
FIG. 27A is a front view of a second tine support of the heater assembly of FIG. 24A.

The second tine support 1160 can also support a plurality of tines configured to transfer heat to hair, including, for example, tines 1212 that protrude from a second tine base 1206, as shown in FIGS. 27A-27C. The description of the tines 1212 corresponds to the description provided with reference to the tines 1210. In the exemplary variation shown in FIGS. 27A-27C, the second tine support 1160 includes 16 tines 1212, although the second tine support 1160 is not limited thereto.

Figure 24A:
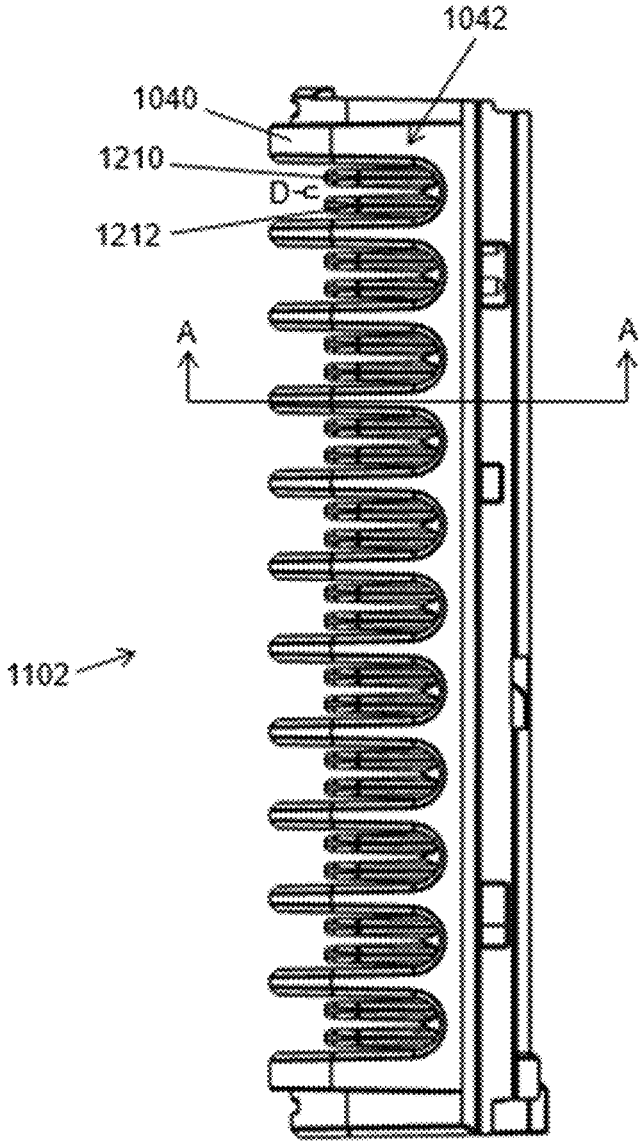
FIG. 24A is a side view of a heater assembly of the brush accessory of FIG. 22A.
Figure 24B:
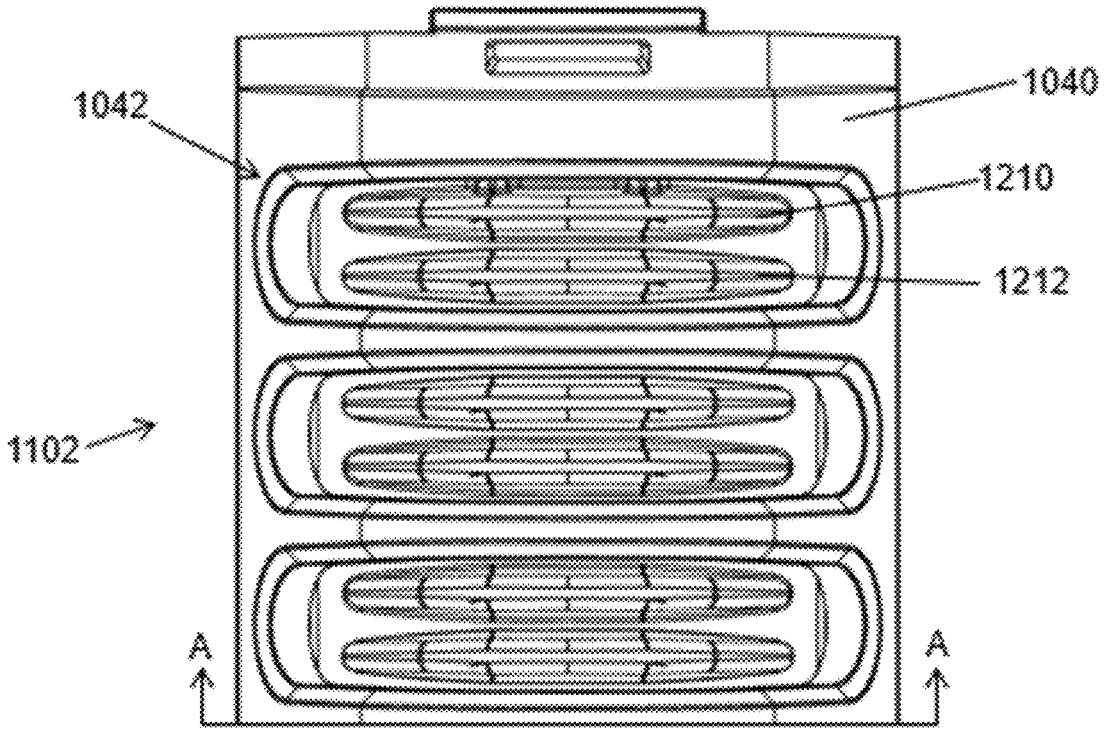
FIG. 24B is a front view of a portion of the heater assembly of FIG. 24A.
Figure 25C:
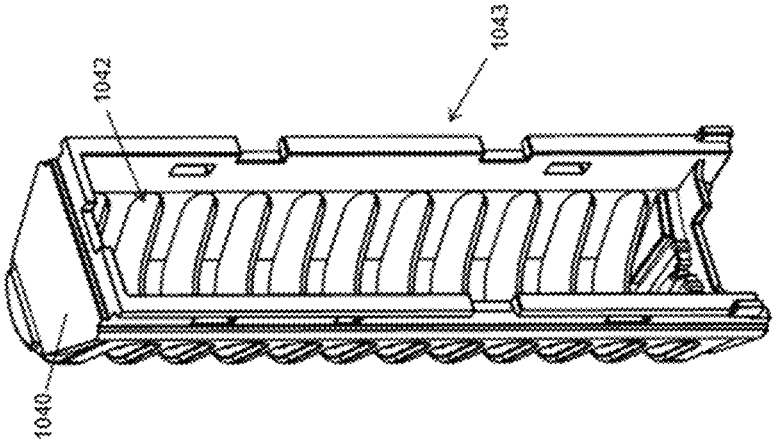
FIG. 25C is a rear perspective view of the heater shell of FIG. 25A.
Figure 25B:
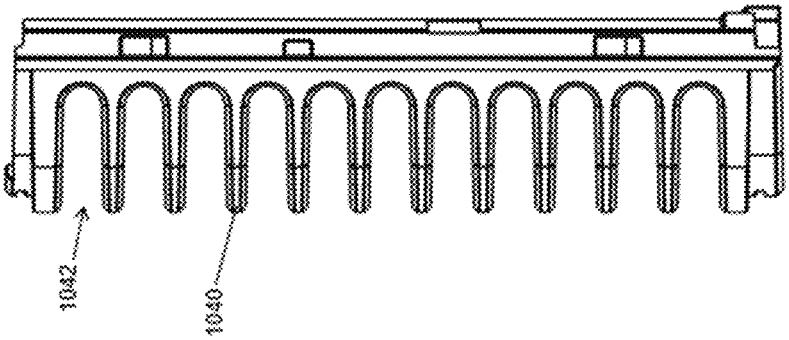
FIG. 25B is a side view of the heater shell of FIG. 25A.
Figure 25A:
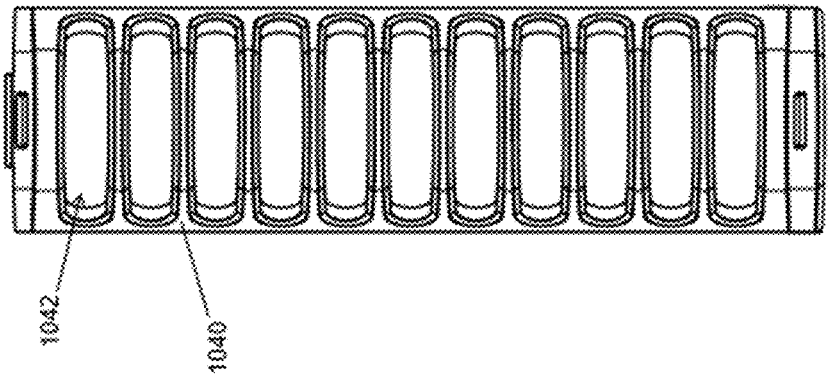
FIG. 25A is a front view of a heater shell of the heater assembly of FIG. 24A.

The tine supports 1150, 1160 can be configured to interlock, such that the tines 1210, 1212 may be in close proximity to each other. For example, FIGS. 24A-24B show the tine supports 1150, 1160 interlocked by positioning the tines 1212 of the second tine support 1160 within the tine openings 1204 of the first tine support 1150. Interlocking the tine supports 1150, 1160 can cause the tines 1210, 1212 to be arranged in an alternating pattern, such that a tine 1210 is positioned between two tines 1212. Adjacent tines may be referred to herein as a pair of tines. As shown in FIG. 24A, a pair of tines 1210, 1212 can be positioned within an opening 1042 of the heater shell 1040, defining a slot therebetween. Each slot can be configured to receive hair therein. In some embodiments, the brush accessory 1000 can include between 10 slots and 50 slots, 20 slots and 40 slots, or 30 slots and 40 slots. In an exemplary embodiment, the brush accessory 1000 includes about 32 slots, for example.

Furthermore, in the interlocked configuration shown in FIGS. 24A-24B, the tines 1210, 1212 are separated by a distance, D. The distance, D, can correspond to a width of a slot defined by adjacent tines. The distance, D, can be larger than a width of at least one hair. For example, the distance, D, can be between about 0.5 mm and about 1.5 mm, about 0.6 mm and about 1.3 mm, about 0.5 mm and about 1 mm, or about 0.5 mm and about 0.7 mm. In an exemplary variation, the distance, D, is about 0.6 mm, for example. A small distance, D, advantageously facilitates increased contact between the tines 1210, 1212 and hair received between adjacent tines 1210, 1212. Consequently, increased contact between the tines 1210, 1212 and hair positioned therebetween results in more effective heat transfer to the hair.

Figure 22E:
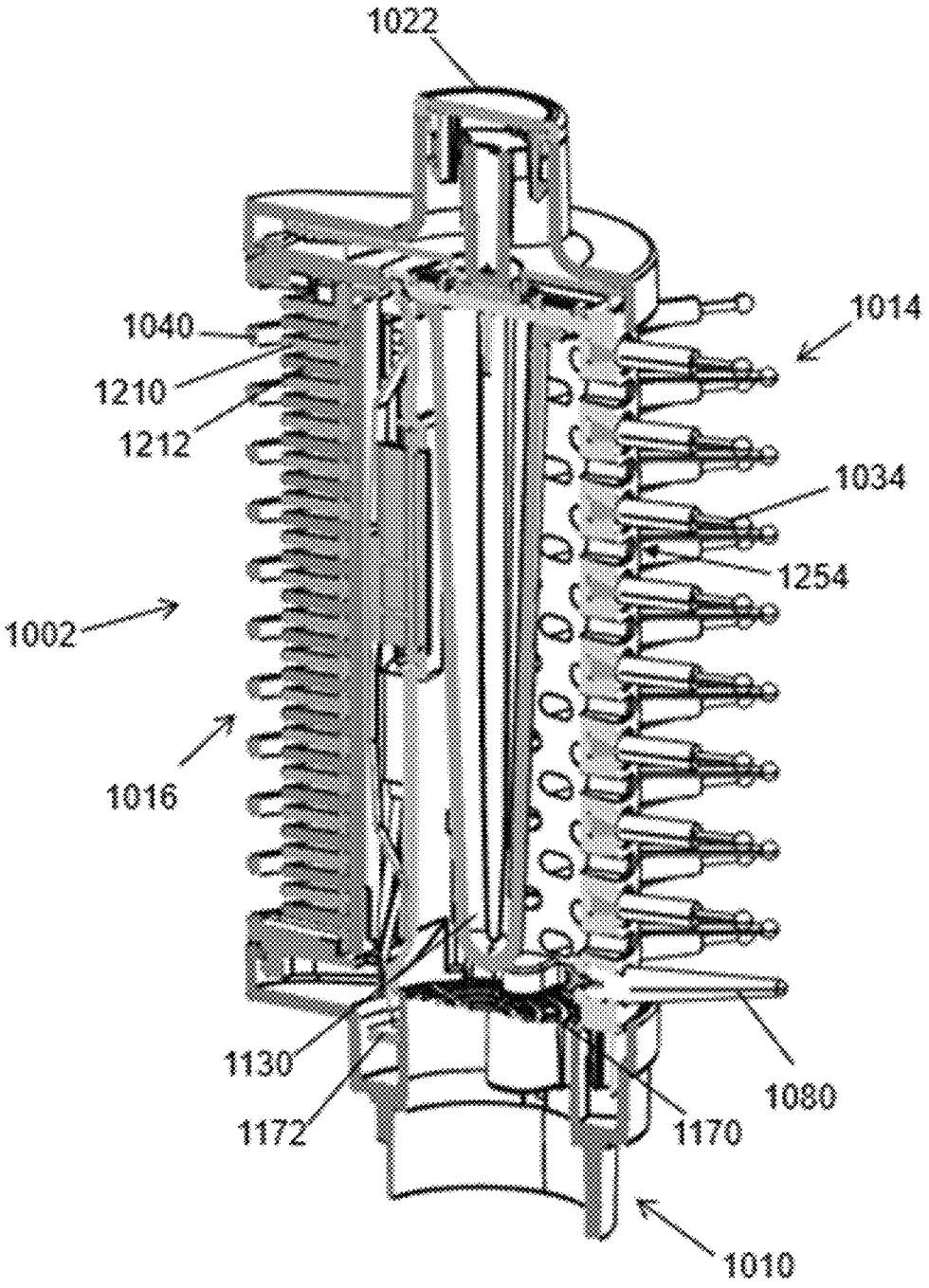
FIG. 22E is another cross-sectional view of the brush accessory of FIG. 22A.

The heater assembly 1102 can further include a heating element 1162 configured to generate and provide heat to the tine supports 1150, 1160. The heating element 1162 can be coupled to a heating element support 1164 and positioned between the second tine support 1160 and the heating element support 1164. Each heater assembly 1102 can also include a heater assembly support 1140 which can couple to the attachment coupling 1010 via an attachment mechanism 1172, as shown in FIG. 22E. As would be appreciated by a person of ordinary skill in the art, electrical components can be coupled to the heater assembly support 1140 to receive an electrical signal from a controller (not shown) configured to control the temperature, power status, or any other setting associated with the heater assembly 1102. Additionally, the heater assembly support 1140 can be connected to an air flow controller 1170 positioned within the body 1002 to direct air flow around the internal lumen of the body 1002.

Figure 31B:
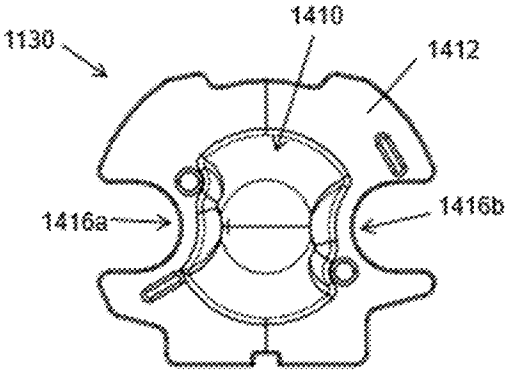
FIG. 31B is a top view of the baffle of FIG. 31A.
Figure 31A:
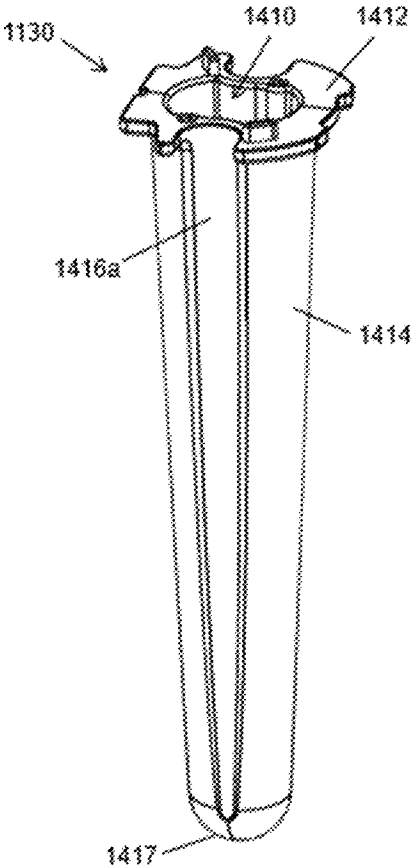
FIG. 31A is a perspective view of a baffle of the brush accessory of FIG. 22A.

The brush accessory 1000 can further include a baffle 1130 positioned within the body 1002. As shown in FIG. 31A, the baffle 1130 can have a hollow baffle body 1414, which may lower the overall mass of the baffle 1130 compared to a variation having a solid baffle. The relatively lower mass of the baffle 1130 advantageously allows a user to more easily carry, move, or otherwise handle the brush accessory 1000. The baffle 1414 can define a baffle opening 1410 positioned in an upper surface 1412 at a first end of the baffle 1130. The baffle opening 1410 can be sealed by the first and/or second tine supports 1150, 1160. Therefore, air may not flow through the baffle opening 1410 and into the cavity of the baffle 1414. At a second end of the baffle 1130 can be a baffle tip 1417 that is rounded to minimize friction with any air flowing against the baffle 1130.

Additionally, the baffle 1130 can be configured to engage and direct air flow to one or more outlet openings of the brush accessory 1000. For example, as shown in FIGS. 31A and 31B, the baffle 1130 can be formed with a first channel 1416*a* and a second channel 1416*b*. The channels 1416*a*, 1416*b* can be configured to direct air flow to the outlet openings 1254 of the bristle shell 1030. In particular, the channels 1416*a*, 1416*b* can be arranged on opposite sides of the baffle body 1414 in order to facilitate even airflow throughout the drying region 1014. A width of the channels 1416*a*, 1416*b* can increase along a longitudinal length of the baffle body 1414, such that the channels 1416*a*, 1416*b* are wider at the first end relative to the second end. The varying width of the channels 1416*a*, 1416*b* facilitates a volume of lower pressure, which can result in air flowing towards the first end of the baffle body 1414. Advantageously, the design of the baffle body 1414 effectively provides air flow through one or more outlet openings in order to dry the user's hair.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, algorithm, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code).

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices). The processor and the memory can be supplemented by, or incorporated in, special purpose logic circuitry.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor). The modules described herein can be combined, integrated, separated, and/or duplicated to support various applications. Also, a function described herein as being performed at a particular module can be performed at one or more other modules and/or by one or more other devices instead of or in addition to the function performed at the particular module.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

What is claimed is:

1. A brush accessory, comprising:

a hollow body having first and second regions, the first region having a circular cross-sectional shape and the second region having a triangular cross-sectional shape;

an attachment collar at a first end of the hollow body and having an inlet for receiving airflow;

a plurality of bristles positioned along the first region of the hollow body;

a plurality of outlet openings positioned along the first region of the hollow body adjacent the plurality of bristles; and a heater assembly positioned along the second region of the hollow body, the heater assembly comprising at least two tines configured to receive hair therebetween.

2. The brush accessory of claim 1, wherein each tine of the at least two tines comprises a triangular cross-sectional shape.

3. The brush accessory of claim 1, wherein each tine of the at least two tines comprises opposed planar surfaces.

4. The brush accessory of claim 1, wherein the heater assembly comprises between 20 tines and 40 tines.

5. The brush accessory of claim 1, wherein the heater assembly comprises a heater shell with an opening, and wherein at least two tines are positioned within the opening.

6. The brush accessory of claim 1, wherein the plurality of bristles is arranged in a plurality of rows spaced circumferentially around the first region.

7. The brush accessory of claim 6, wherein the plurality of rows comprises between 5 and 10 rows.

8. The brush accessory of claim 1, wherein each outlet opening of the plurality of outlet openings is configured as an outlet for airflow.

9. The brush accessory of claim 1 further comprising a baffle positioned within the hollow body and configured to direct air through each of the openings of the plurality of openings.

10. A brush accessory, comprising:

a hollow body having a rounded sidewall with a first section having a circular cross-sectional shape and a second section extending radially from the first section, the second section having a frustoconical cross-sectional shape, wherein the first and second sections are joined together;

an attachment collar at a first end of the hollow body and having an inlet for receiving airflow;

a plurality of outlet openings positioned along the first section of the hollow body; and a heater assembly positioned along the second section of the hollow body, the heater assembly comprising a plurality of slots oriented perpendicular to a longitudinal axis of the hollow body.

11. The brush accessory of claim 10, wherein the heater assembly comprises a heater shell with an opening, and wherein at least one slot is positioned within the opening.

12. The brush accessory of claim 10 further comprising a plurality of bristles extending from the first section.

13. The brush accessory of claim 12, wherein the plurality of bristles is arranged in a plurality of rows spaced circumferentially around the first section.

14. The brush accessory of claim 13, wherein the plurality of rows comprises between 5 and 10 rows.

15. The brush accessory of claim 10, wherein the heater assembly comprises between 20 slots and 40 slots.

16. The brush accessory of claim 10, wherein each outlet opening of the plurality of outlet openings is configured as an outlet for airflow.

17. The brush accessory of claim 10, wherein each slot of the plurality of slots is defined by a pair of tines.

18. The brush accessory of claim 17, wherein each tine of the pair of tines comprises opposed planar surfaces.

* * * * *